US006075957A

United States Patent [19]

Batori et al.

[11] Patent Number: 6,075,957

[45] **Date of Patent: *Jun. 13, 2000**

[54] PROCESS CARTRIDGE AND ELECTROPHOTOGRAPHIC IMAGE FORMING APPARATUS

[75] Inventors: Yoshiyuki Batori, Toride; Isao Ikemoto, Kashiwa; Minoru Sato, Toride, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/193,863

[22] Filed: Nov. 18, 1998

[30] Foreign Application Priority Data

Nov. 20, 1997 [JP] Japan ..... 9-336446

[51] Int. Cl.[7] ..... G03G 15/00; G03G 21/18

[52] U.S. Cl. ..... 399/114; 399/111

[58] Field of Search ..... 399/114, 111, 399/110, 116; 347/138, 152

[56] References Cited

U.S. PATENT DOCUMENTS

| | | | |
|---|---|---|---|
| 5,113,220 | 5/1992 | Kwak | 399/114 |
| 5,331,372 | 7/1994 | Tsuda et al. | 399/114 |
| 5,331,373 | 7/1994 | Nomura et al. | 399/111 |
| 5,404,198 | 4/1995 | Noda et al. | 399/107 |
| 5,452,056 | 9/1995 | Nomura et al. | 399/111 |
| 5,470,635 | 11/1995 | Shirai et al. | 428/131 |
| 5,475,470 | 12/1995 | Sasago et al. | 399/111 |
| 5,488,459 | 1/1996 | Tsuda et al. | 399/167 |
| 5,500,714 | 3/1996 | Yashiro et al. | 399/111 |
| 5,510,878 | 4/1996 | Noda et al. | 399/111 |
| 5,581,325 | 12/1996 | Tsuda et al. | 399/116 |
| 5,583,613 | 12/1996 | Kobayashi et al. | 399/111 |
| 5,585,889 | 12/1996 | Shishido et al. | 399/113 |
| 5,602,623 | 2/1997 | Nishibata et al. | 399/111 |
| 5,608,509 | 3/1997 | Shirai et al. | 399/351 |
| 5,617,579 | 4/1997 | Yashiro et al. | 399/114 |
| 5,623,328 | 4/1997 | Tsuda et al. | 399/111 |
| 5,642,187 | 6/1997 | Nomura et al. | 399/111 |
| 5,659,847 | 8/1997 | Tsuda et al. | 399/113 |
| 5,669,042 | 9/1997 | Kobayashi et al. | 399/111 |
| 5,749,027 | 5/1998 | Ikemoto et al. | 399/111 X |
| 5,828,928 | 10/1998 | Sasago et al. | 399/111 |
| 5,873,012 | 2/1999 | Miyabe et al. | 399/111 X |
| 5,890,036 | 3/1999 | Karakama et al. | 399/119 |

FOREIGN PATENT DOCUMENTS 9-026739 1/1997 Japan .

*Primary Examiner*—William Royer
*Assistant Examiner*—Sophia S. Chen
*Attorney, Agent, or Firm*—Fitzpatrick, Cella, Harper & Scinto

[57] ABSTRACT

A process cartridge which can detachably be mounted to an electrophotographic image forming apparatus, and which includes a cartridge frame, an electrophotographic photosensitive member, a process device acting on the photosensitive member, a shutter for covering a portion of the photosensitive member exposed from the cartridge frame, a support member for supporting one longitudinal end of the shutter to the cartridge frame for shifting movement between an operation position where the photosensitive member is covered by the shutter and a retract position retracted from the operation position, a support member engagement portion provided on the support member to attach the support member to the cartridge frame, and a frame engagement portion provided on the cartridge frame to attach the support member engagement portion to the cartridge frame.

25 Claims, 30 Drawing Sheets

PROCESS CARTRIDGE AND ELECTROPHOTOGRAPHIC IMAGE FORMING APPARATUS

BACKGROUND OF THE INVENTION

1. Field of the Invention

The present invention relates to a process cartridge and an electrophotographic image forming apparatus to which such a process cartridge can detachably be mounted.

The electrophotographic image forming apparatus serves to form an image on a recording medium by using an electrophotographic image forming process, and may be, for example, an electrophotographic copying machine, an electrophotographic printer (for example, LED printer, laser beam printer or the like), an electrophotographic facsimile apparatus or an electrophotographic word processor.

The process cartridge may incorporate an electrophotographic photosensitive member, and a charge means, a developing means or a cleaning means as a cartridge unit, may incorporate an electrophotographic photosensitive member, and at least one of a charge means, a developing means and a cleaning means as a cartridge unit, or may incorporate an electrophotographic photosensitive member and at least a developing means as a cartridge unit, which can detachably be mounted to an electrophotographic image forming apparatus, respectively.

2. Related Background Art

In the above-mentioned process cartridge, when the process cartridge is mounted to the image forming apparatus, a transfer opening through which the electrophotographic photosensitive member is exposed outside is opened, and, when the process cartridge is dismounted from the image forming apparatus, the electrophotographic photosensitive member is covered by a drum shutter to protect the former.

A shutter arm is one of links for opening and closing the drum shutter for light-shielding the photosensitive drum (when the process cartridge is dismounted from the image forming apparatus) and is biased by an elastic body such as a torsion coil spring toward a direction along which the drum shutter is closed. A snap-fit is used to assemble the shutter arm to a frame of the process cartridge.

SUMMARY OF THE INVENTION

The present invention relates to an improvement in conventional techniques.

An object of the present invention is to provide a process cartridge and an electrophotographic image forming apparatus, in which a support member for supporting a shutter is hard to be disengage from a cartridge frame.

Another object of the present invention is to provide a process cartridge and an electrophotographic image forming apparatus, in which, when a shutter is positioned at a retract position (opened position), a support member for supporting a shutter is hard to disengage from a cartridge frame.

A further object of the present invention is to provide a process cartridge and an electrophotographic image forming apparatus, in which a support member for supporting a shutter is attached to a cartridge frame by a snap-fit.

The other object of the present invention is to provide a process cartridge and an electrophotographic image forming apparatus, which include a frame engagement portion provided on a cartridge frame to attach a support member engagement portion to the cartridge frame, and in which the frame engagement portion is provided with an attachment portion for engaging the support member engagement portion with the frame engagement portion, and a shift path through which a shutter is shifted between an operation position where an electrophotographic photosensitive member is covered by the shutter and a retract position retracted from the operation position, and a space of the attachment portion is greater than a space of the shift path.

DESCRIPTION OF THE PREFERRED EMBODIMENTS

The present invention will now be explained in connection embodiments thereof with reference to the accompanying drawings. As an embodiment of an electrophotographic image forming apparatus, a laser beam printer will be described.

First Embodiment

A process cartridge and an image forming apparatus to which the process cartridge is detachably mounted will be fully explained with reference to FIGS. 1 to 4. FIGS. 5 to 12 are explanatory views showing a mounting means for the process cartridge B, and FIGS. 13 to 27 are detailed views showing the first embodiment.

First of all, the entire constructions of the process cartridge and of the image forming apparatus using such a process cartridge will be explained.

Entire Construction

Figure 3:
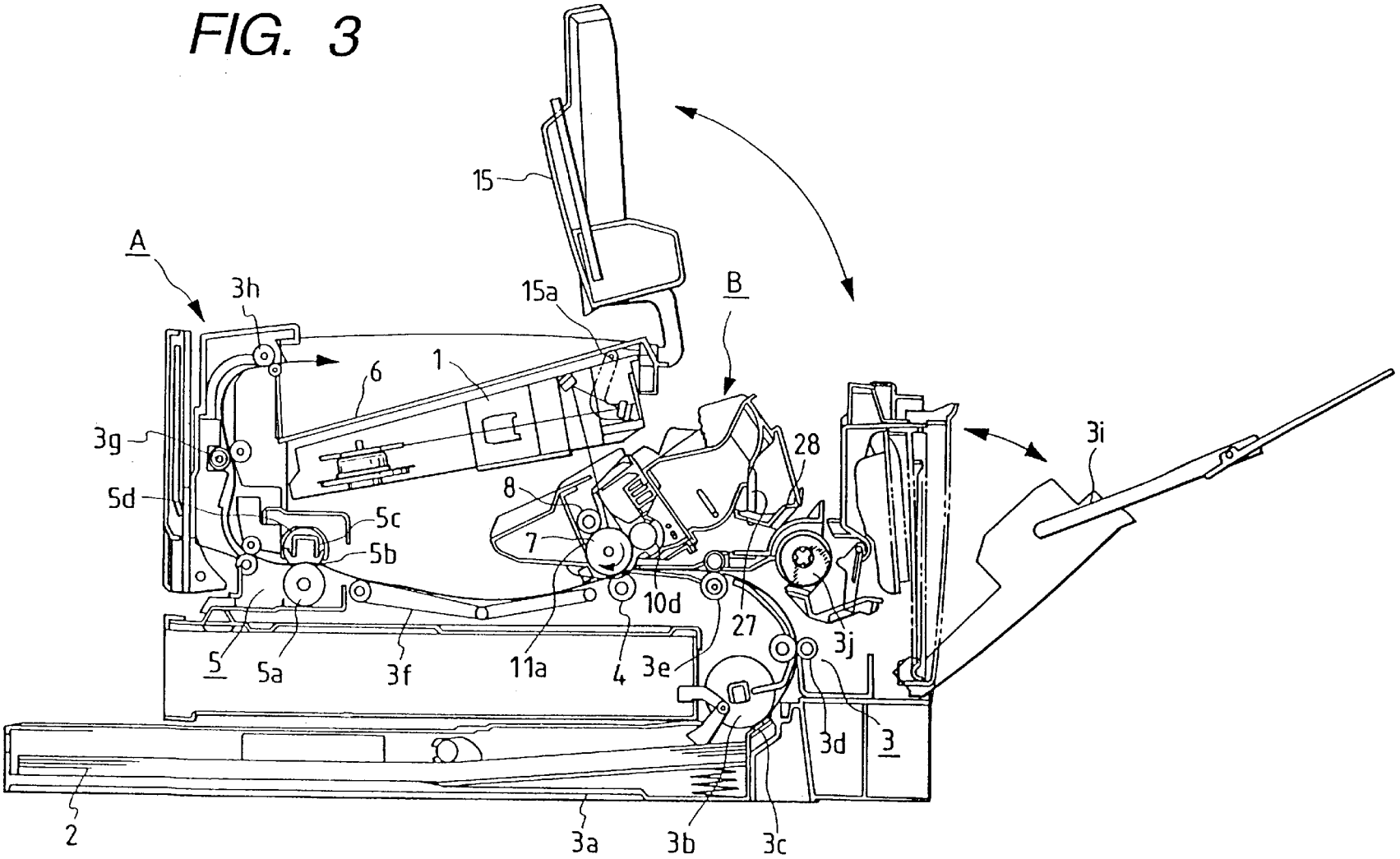
FIG. 3 is a schematic sectional view of an image forming apparatus to which the process cartridge according to the present invention is mounted.

As shown in FIG. 3, in the electrophotographic image forming apparatus (laser beam printer) A, information light corresponding to image information and emitted from an optical system 1 illuminates a drum-shaped electrophotographic photosensitive member (photosensitive drum) 7 to form a latent image on the photosensitive drum 7, and the latent image is developed by developing agent (referred to as "toner" hereinafter) to form a toner image. In synchronism with formation of the toner image, recording medium 2 is supplied, one by one, from a sheet supply cassette 3*a* by means of a pick-up roller 3*b* and a member 3*c* urged against the pick-up roller, and the supplied recording medium is conveyed by a convey means 3, comprised of a pair of convey rollers 3*d* and a pair of regist rollers 3*e*. The toner image formed on the electrophotographic photosensitive member 7 in the process cartridge B is transferred onto the recording medium 2 by applying voltage to a transfer roller (transfer means) 4, and then the recording medium 2 is conveyed to a fixing means 5 via a convey belt 3*f*. The fixing means 5 comprises a drive roller 5*a*, and a fixing rotary member 5*d*, formed from a cylindrical sheet rotatably supported by a support 5*c* and including a heater 5*b* therein. While the recording medium 2 is passing through the fixing means, heat and pressure are applied to the recording medium, thereby fixing the transferred toner image. Thereafter, the recording medium 2 is conveyed by pairs of discharge rollers 3*g*, 3*h* and is discharged onto a discharge portion 6 through a reverse convey path. Incidentally, in the image forming apparatus A, a recording medium can be supplied manually through a manual insertion tray 3*i* and a roller 3*j*.

Process Cartridge

Figure 4:
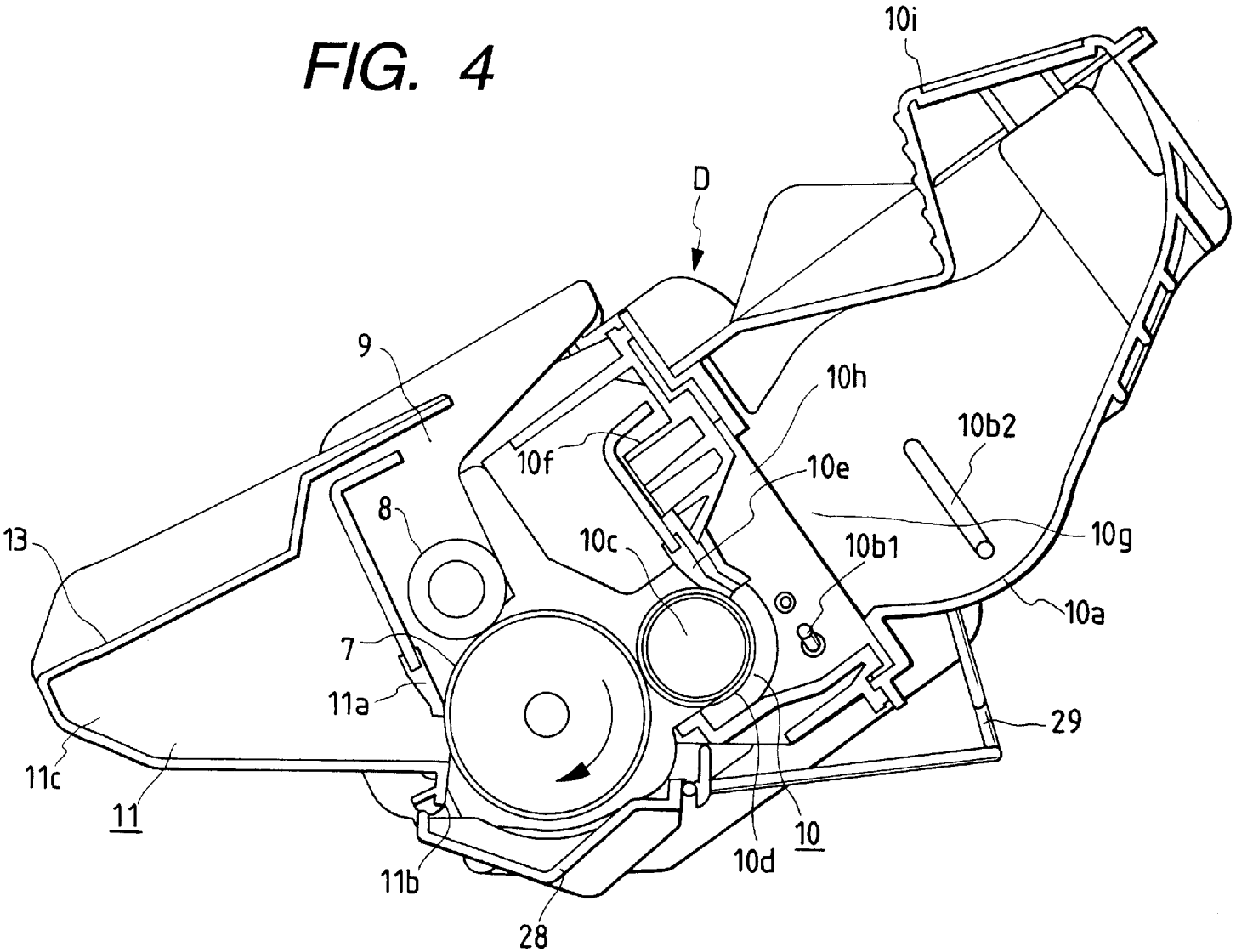
FIG. 4 is a schematic sectional view of the process cartridge according to the present invention.

On the other hand, the process cartridge B includes the electrophotographic photosensitive member, and at least one process means. The process means may include, for example, a charge means for charging the electrophotographic photosensitive member, a developing means for developing the latent image formed on the electrophotographic photosensitive member or/and a cleaning means for cleaning residual toner remaining on a surface of the electrophotographic photosensitive member. As shown in FIG. 4, in the process cartridge B according to the illustrated embodiment, the photosensitive drum (electrophotographic photosensitive member) 7 having a photosensitive layer is rotated, the surface of the photosensitive drum 7 is uniformly charged by applying voltage to the charge roller (charge means) 8, the light image from the optical system 1 illuminates the photosensitive drum 7 through an exposure opening 9 to form the latent image, and the latent image is developed by a developing means 10.

In the developing means 10, toner contained in a toner containing frame 10*a* is sent to an opening portion 10*g* of the toner containing frame 10*a* by means of a rotatable toner feed member (toner feed means) 10*b*2 and is fed out within a toner developing frame 10*f* through an opening portion 10*h* of the toner developing frame 10*f*. The toner is agitated by a toner agitating member 10*b*1. A developing roller (developing rotary member) 10*d* including a fixed magnet 10*c* therein is rotated. A toner layer is formed on a surface of the developing roller 10*d* while applying frictional charges to the toner by means of a developing blade 10*e*. The toner in the toner layer is transferred to the latent image on the photosensitive drum 7 to visualize the latent image as the toner image.

After the toner image is transferred to the recording medium 2 by applying voltage having a polarity opposite to that of the toner image to the transfer roller 4, the residual toner remaining on the photosensitive drum 7 is removed by a cleaning means 11, which scrapes the residual toner by a cleaning blade 11*a* a dip sheet 11*b* and collects it into a waste toner containing portion 11*c*.

Incidentally, various elements such as the photosensitive drum 7 are contained in a cartridge frame obtained by joining a cleaning frame 13 (constituting the waste toner containing portion 11*c* and having the photosensitive drum 7, cleaning blade 11*a*, dip sheet 11*b* and charge roller 8) to a developing unit D formed by welding the toner containing frame 10*a* (rotatingly supporting the toner feed member 10*b*2) and the toner developing frame 10*f* (including the developing members such as the toner agitating member 10*b*1, the developing roller 10*d*, and the developing blade 10*e*) and a lid member 10*i* together, thereby forming the process cartridge which can be detachably mounted to a cartridge mounting means of the image forming apparatus A.

Mounting and Dismounting Construction of Process Cartridge

Next, the construction for mounting and dismounting of the process cartridge B with respect to the image forming apparatus A will be described.

Figure 5:
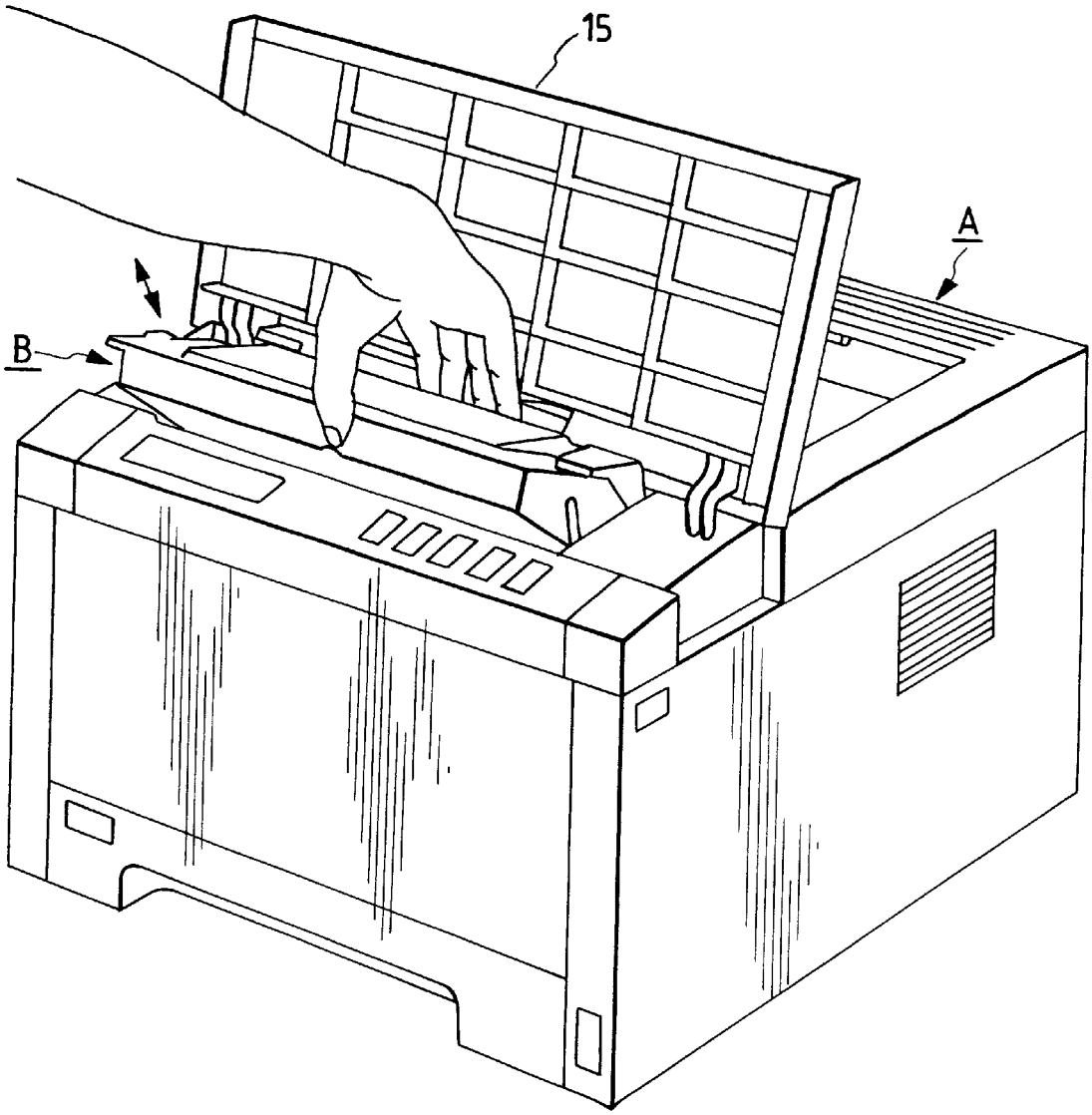
FIGS. 5, 6, and 7 are perspective views showing a process cartridge mounting portion of the image forming apparatus.
Figure 6:
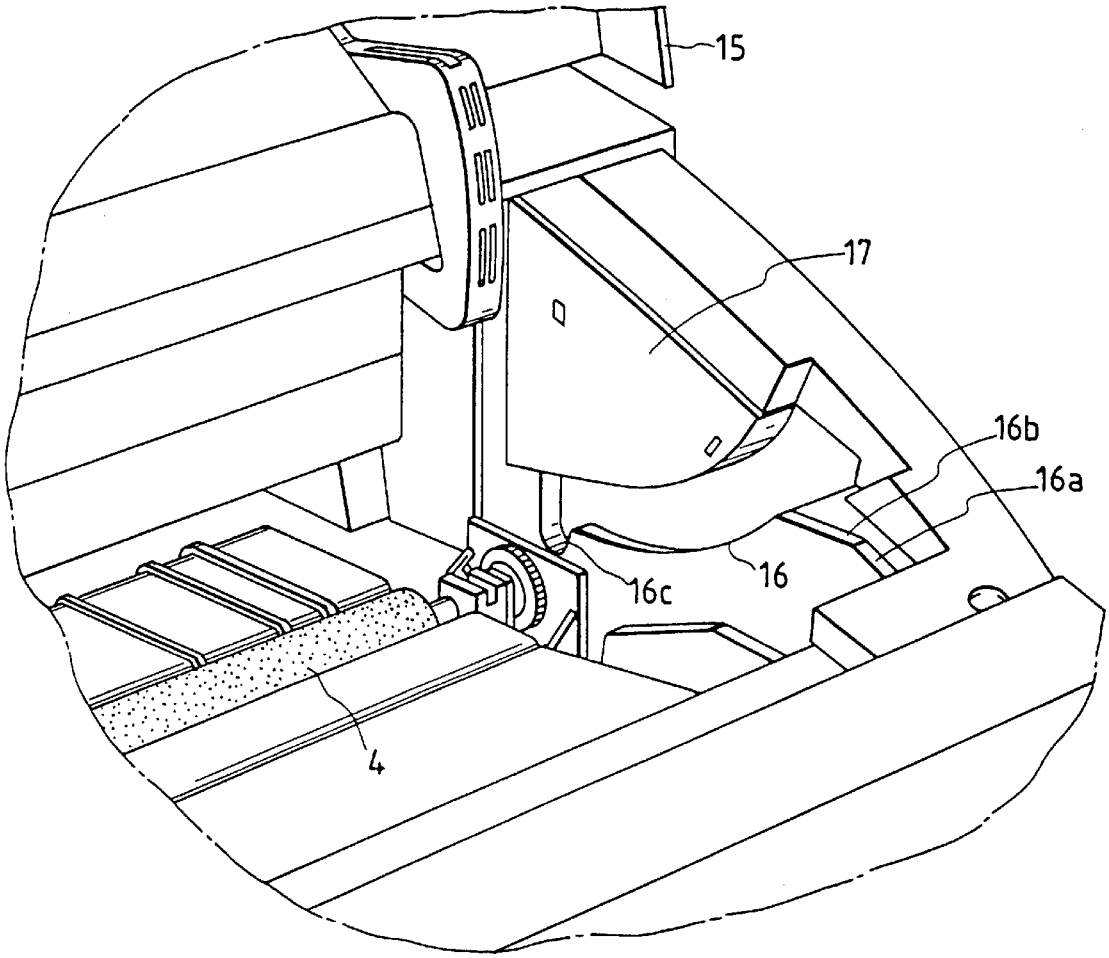
Figure 7:
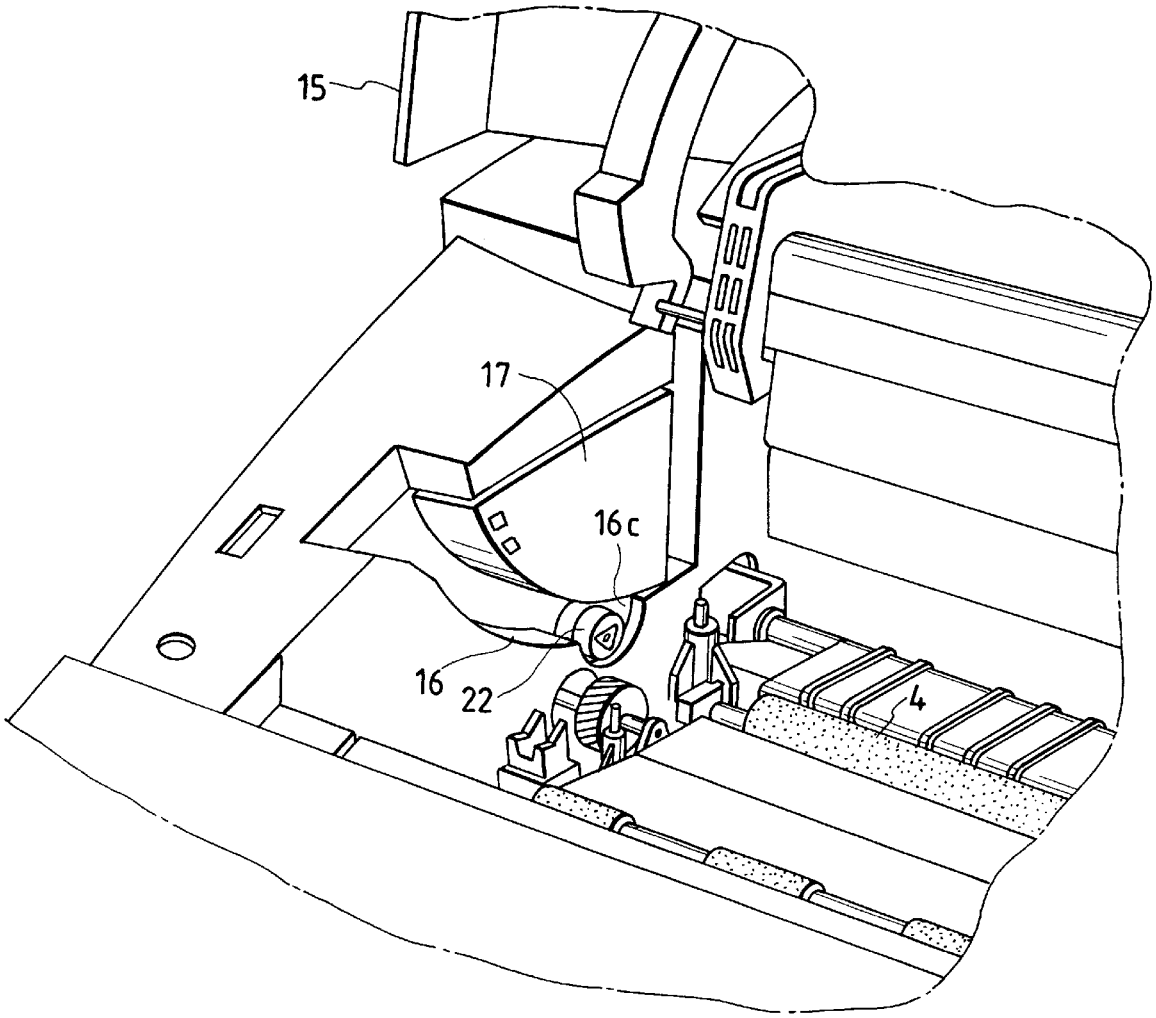
Figure 8:
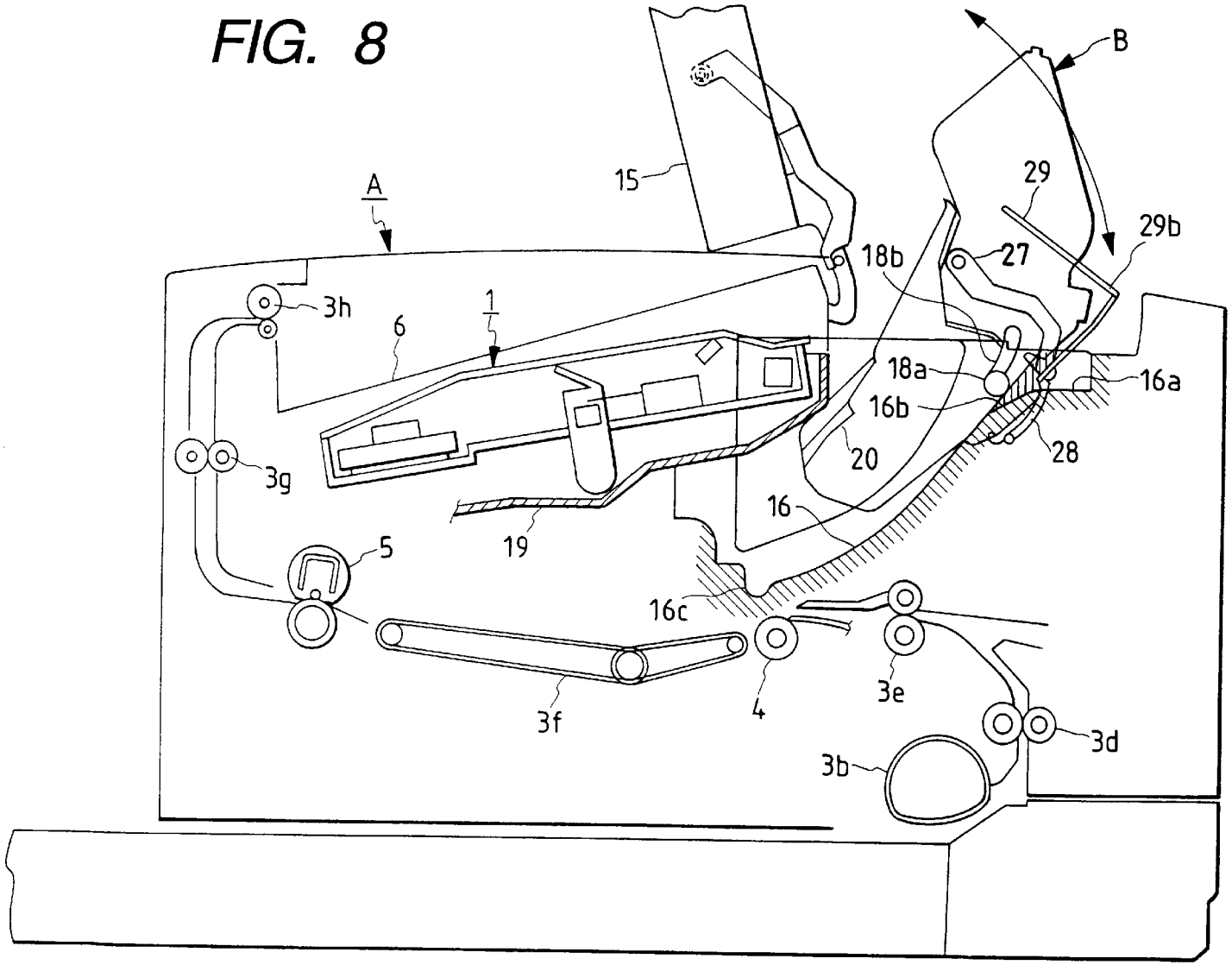
FIGS. 8, 9, 10, 11 and 12 are schematic sectional views for explaining the mounting operation of the process cartridge to the image forming apparatus.
Figure 9:
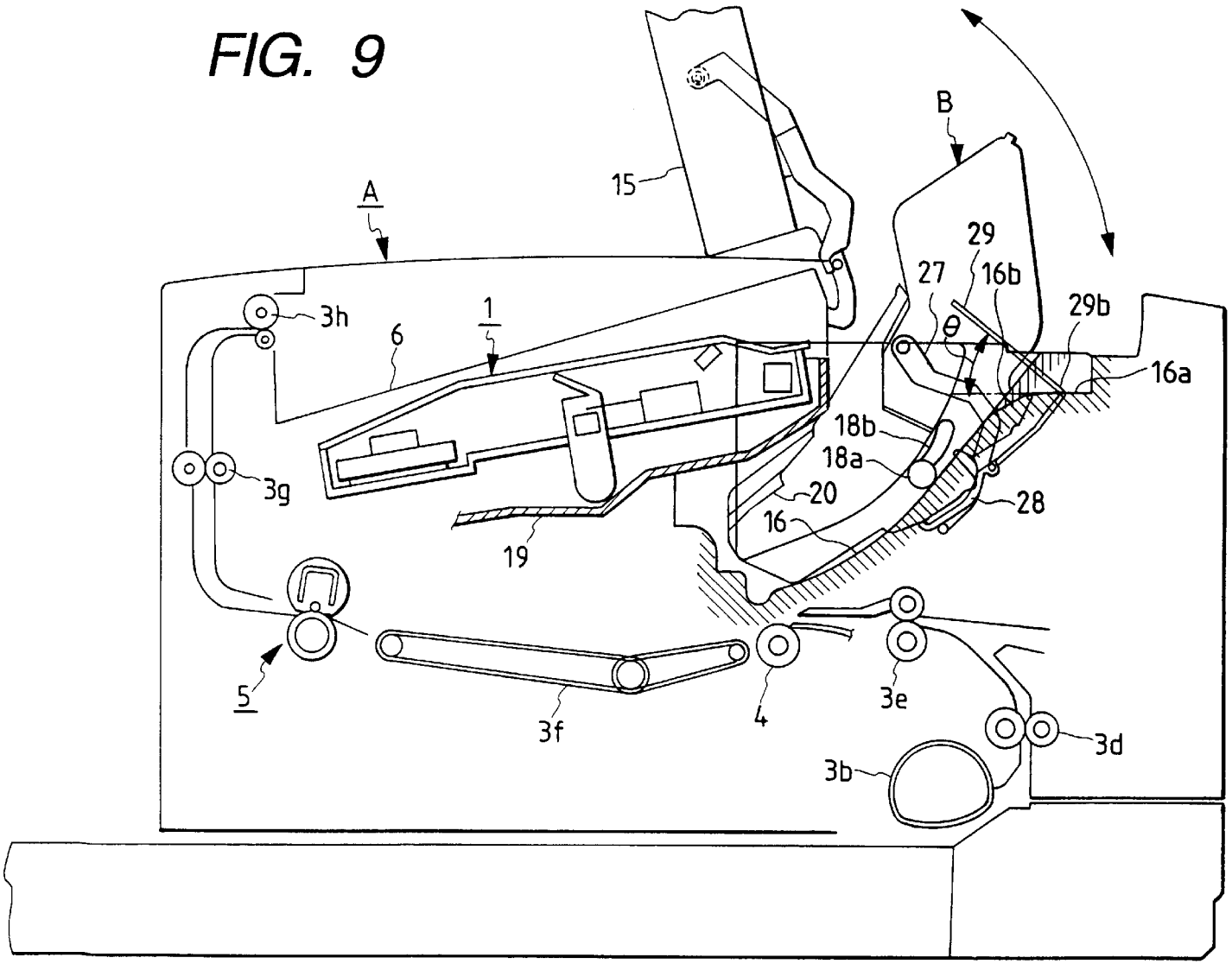
Figure 10:
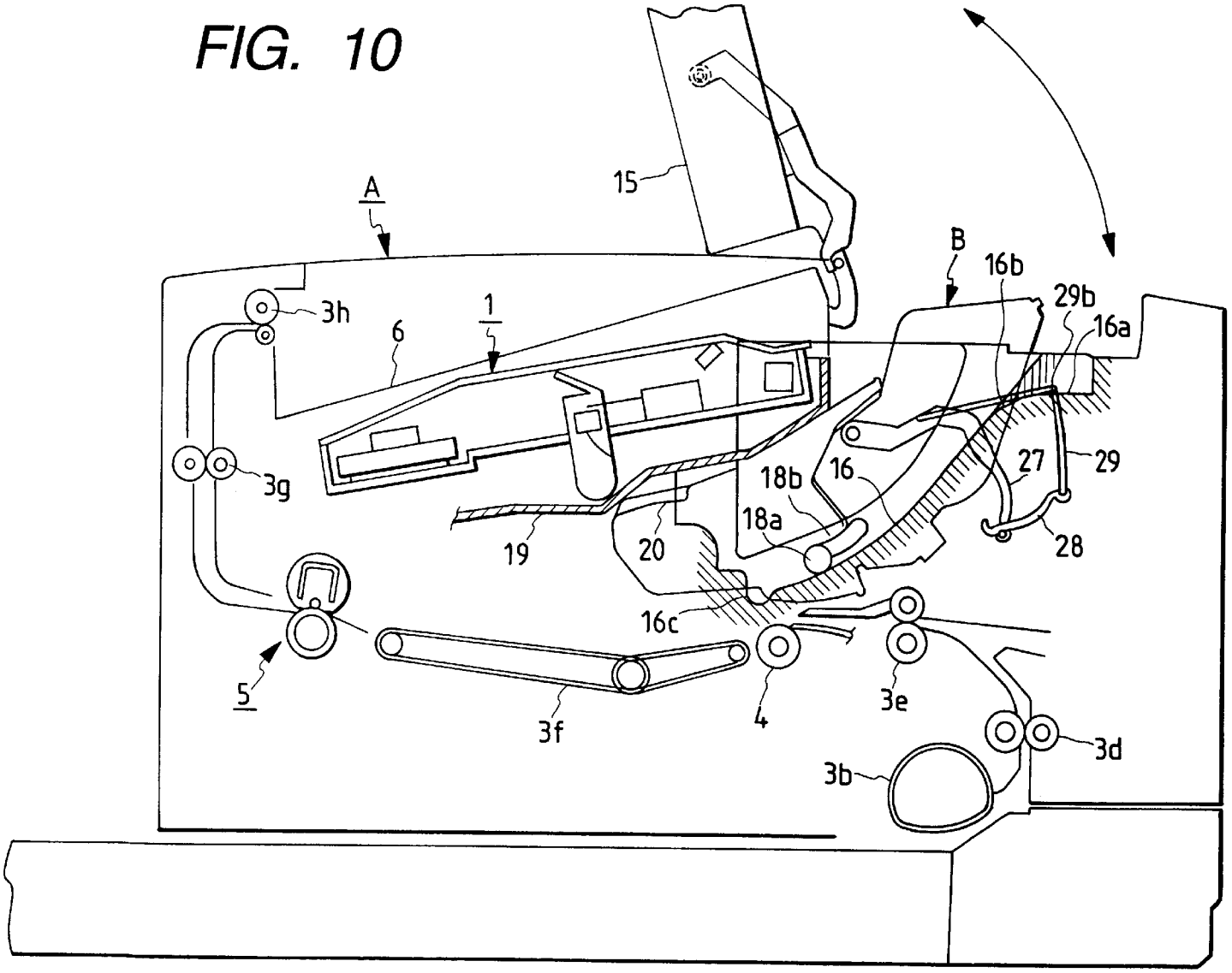
Figure 11:
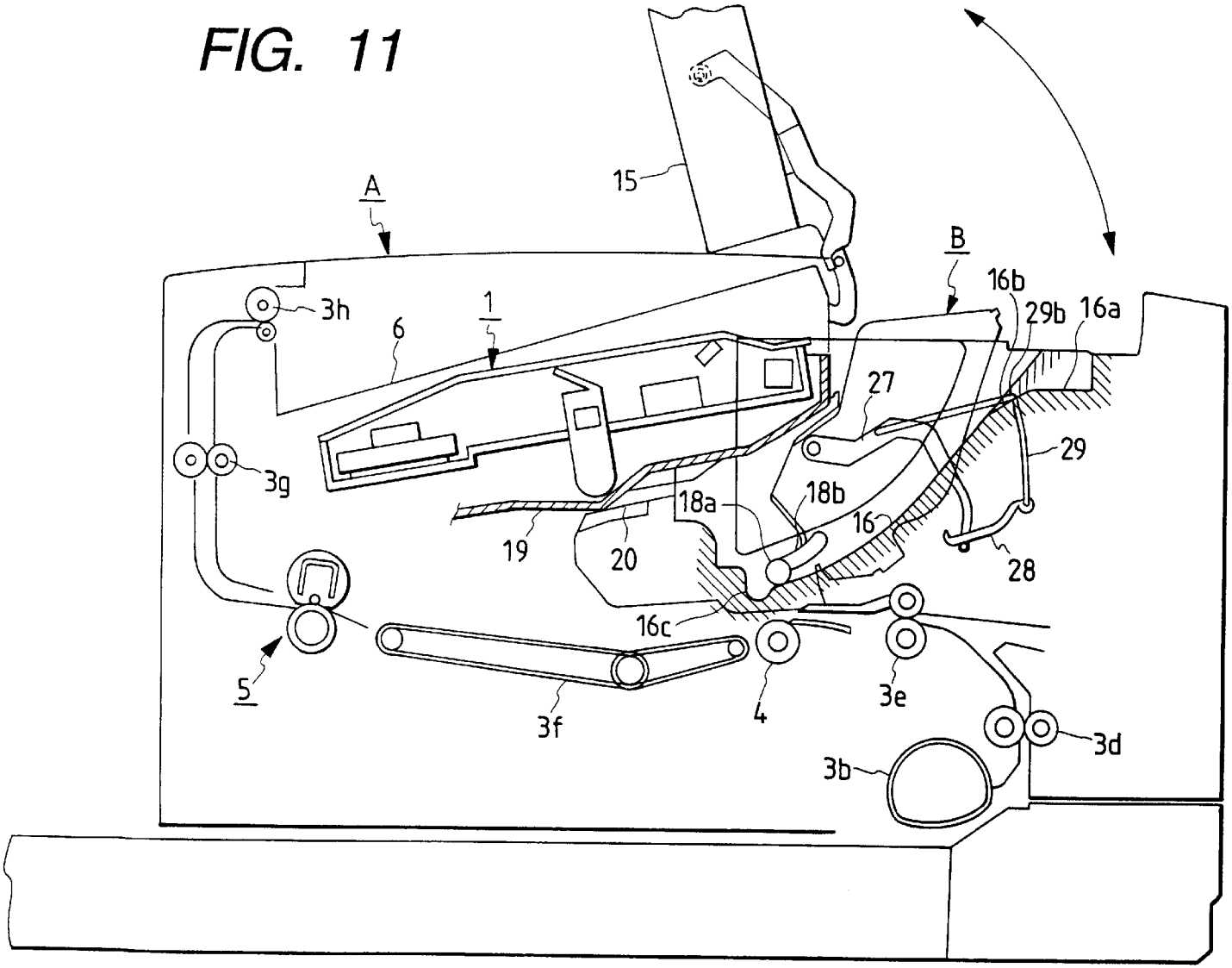

The mounting or dismounting of the process cartridge B is effected after an open/close member 15 is opened as shown in FIG. 5. When the open/close member 15 is opened around a shaft 15*a* (FIG. 3), the cartridge mounting means is exposed. As shown in FIGS. 6 and 7, regarding the cartridge mounting means, guide rails 16 extending forwardly and downwardly and curved downwardly (substantially arc in the illustrated embodiment) are provided on left and side walls of a cartridge mounting space in a substantially symmetrical manner, and guide members 17 are attached above the guide rails. Further, at an inlet side of each guide rail 16, there are provided a first inclined surface 16*a* (hook portion) by which a corresponding projection 29*b* (FIGS. 1 and 2) of the process cartridge B is engaged, and a second inclined surface 16*b* contiguous with the first inclined surface 16*a* and having inclination greater than that of the first inclined surface.

Figure 1:
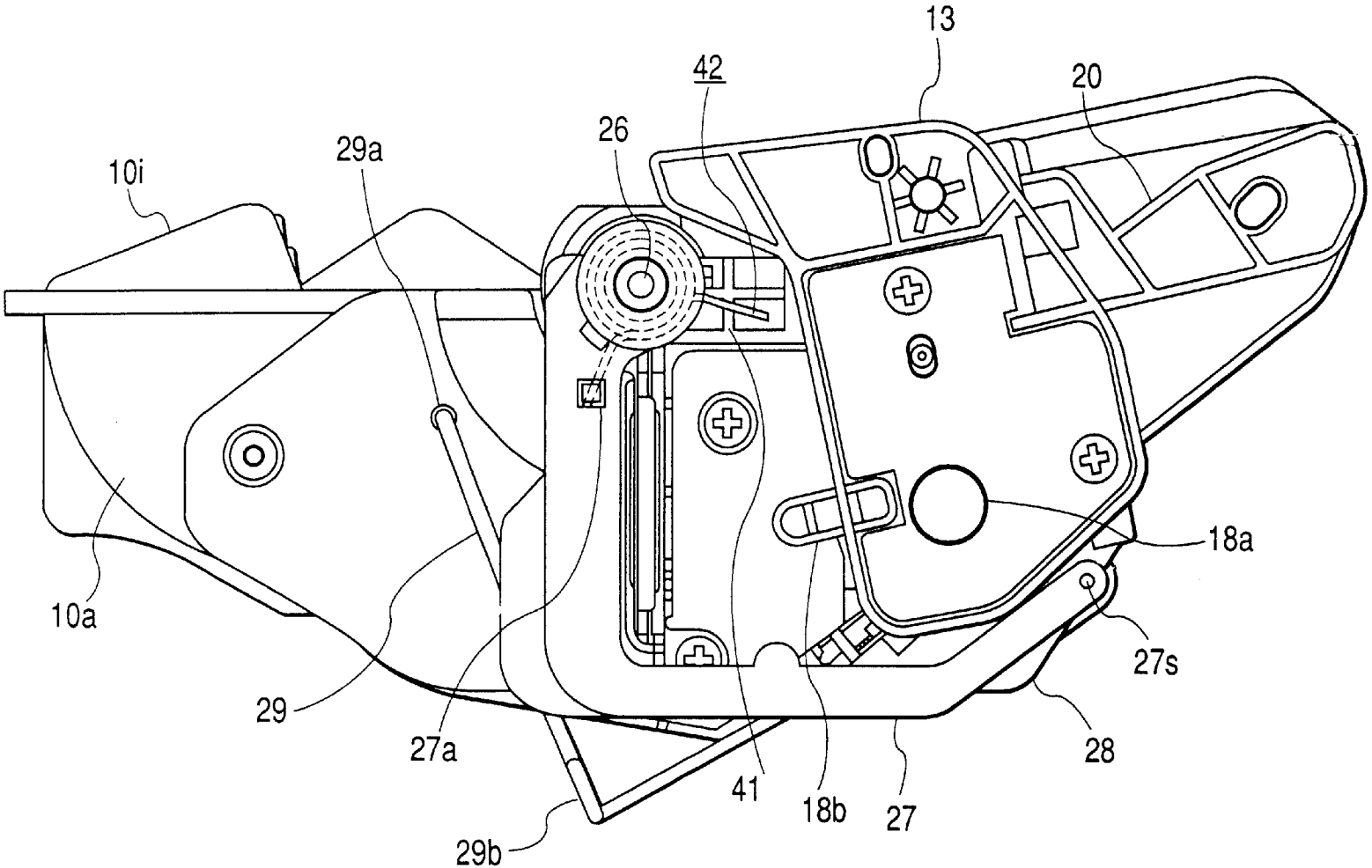
FIG. 1 is a side view for explaining a process cartridge according to the present invention.
Figure 2:
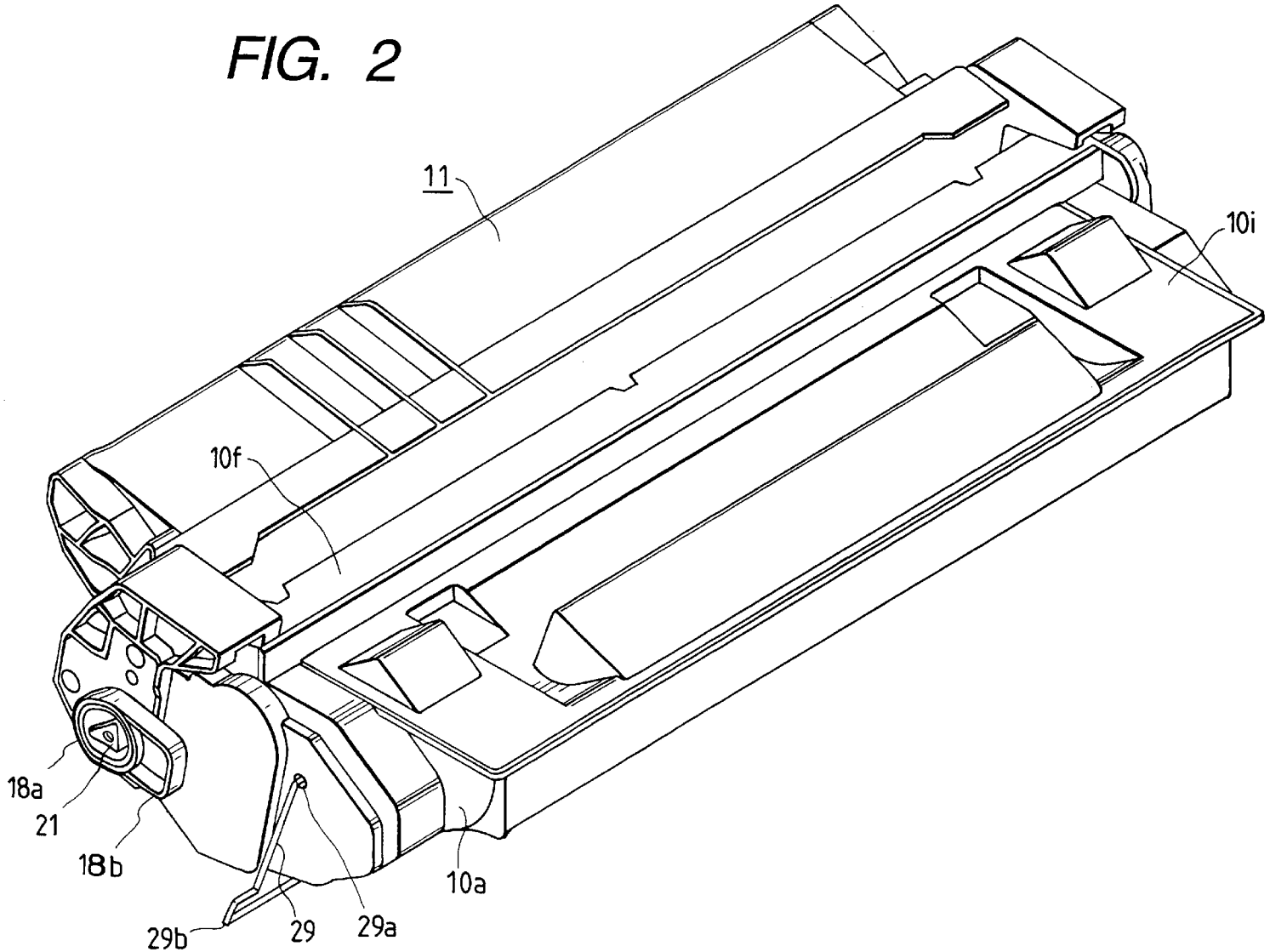
FIG. 2 is a perspective view of the process cartridge according to the present invention.

On the other hand, the process cartridge B is provided at both its longitudinal sides with guide portions to be guided along the guide rails 16. The guide portions protruding from both longitudinal side surfaces of the cartridge frame in a substantially symmetrical manner, and, as shown in FIGS. 1 and 2, each guide portion includes a boss (first guide portion) 18*a* and a rib (second guide portion) 18*b*. The bosses 18*a* are located on an extension line of the rotation axis of the photosensitive drum 7, and the ribs 18*b* extend from the bosses 18*a* toward an inserting direction of the process cartridge and are curved (substantially arc in the illustrated embodiment) in correspondence to the guide rails 16.

Figure 12:
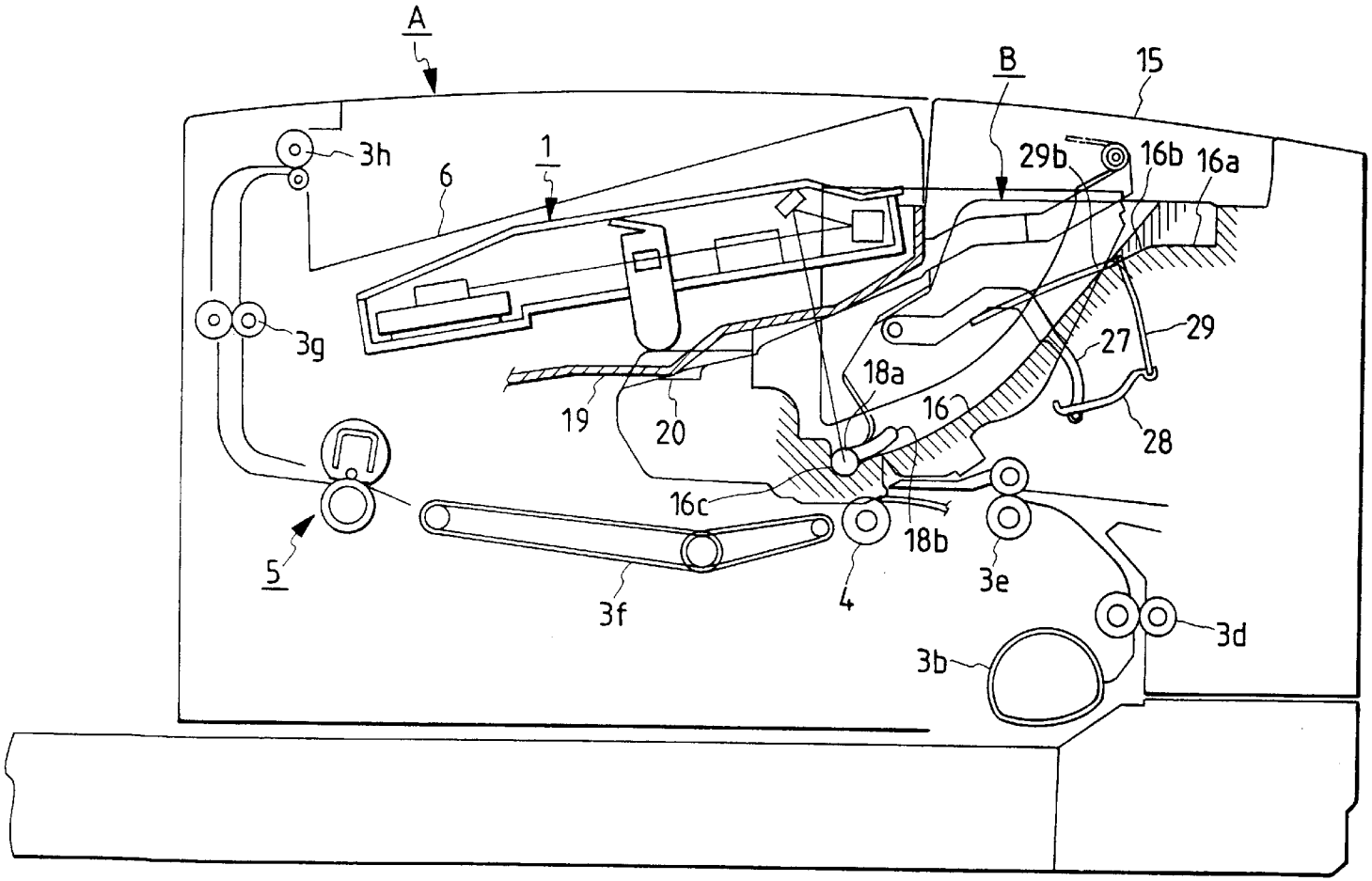

With the arrangement as mentioned above, when the process cartridge B is mounted, as shown in FIGS. 8 to 12, the tip end of the process cartridge B is inserted below the optical system 1 of the image forming apparatus A while guiding the bosses 18*a* and the ribs 18*b* along the guide rails 16. Since the guide rails 16 are curved and the guide members 17 are similarly curved and further the ribs 18*b* are similarly curved, as the process cartridge B is inserted, the posture of the process cartridge becomes substantially horizontal. When the process cartridge is further inserted, as shown in FIG. 12, abutment surfaces 20 provided on both sides of the tip end of the cleaning frame 13 abut against abutment members 19 of the image forming apparatus A, and then, the bosses 18*a* of the process cartridge B enter into recesses 16*c* at the ends of the guide rails 16. As a result, a drum gear 21 (FIG. 2) secured to one side of the photosensitive drum 7 and having a coupling portion is engaged by a drive gear 22 (FIG. 7) of the image forming apparatus A to permit transmission of a driving force to the process cartridge B.

Drum Shutter

The cartridge frame is provided at its lower part with an opening portion through which the photosensitive drum 7 can contact the recording medium 2. When the process cartridge is not used, the opening portion is closed by a drum shutter member 28 to protect the photosensitive drum 7. As shown in FIG. 1, the drum shutter member 28 is rotatably supported by pivotally connecting one end of a shutter arm 27 to a shaft 26 provided on one longitudinal end of the toner developing frame 10*f* and by pivotally inserting a shaft 27s provided at the other end of the shutter arm 27 into a hole of the shutter member 28 and by pivotally connecting the other end of the shutter member to a link member 29 rotatable around a shaft 29*a* inserted into a rotation center hole provided in the longitudinal end of the toner developing frame 10*f*. That is to say, at one side shown in FIG. 1, the drum shutter member 28 constitutes one link of a quadric crank link mechanism, and the shutter arm 27 and the link member 29 act as shutter support members for supporting the drum shutter member 28.

Attachment Method of Shutter Arm

Now, a method for attaching the shutter arm 27 to the toner developing frame 10*f* will be explained.

Figure 14:
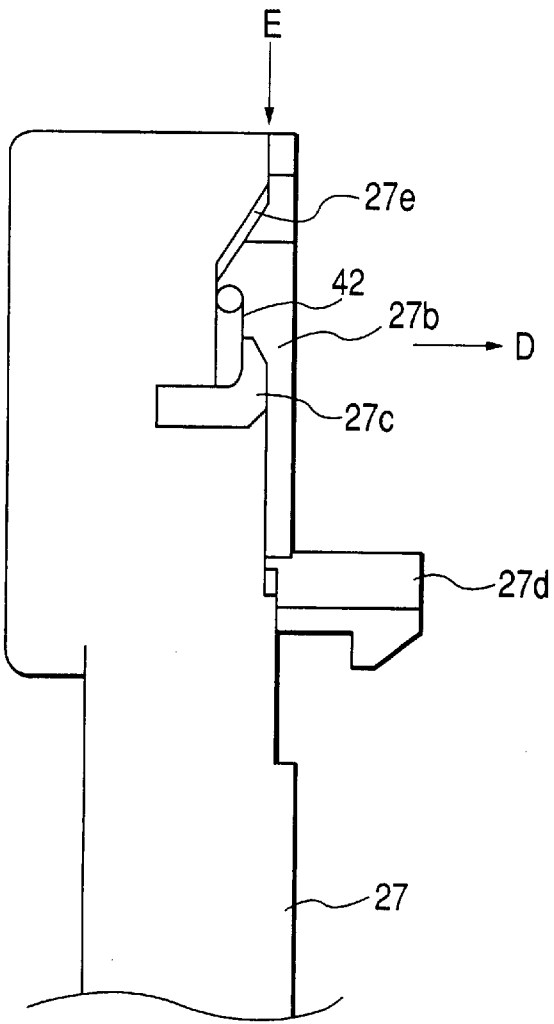
FIG. 14 is a front view of an attachment portion of the shutter arm.
Figure 13:
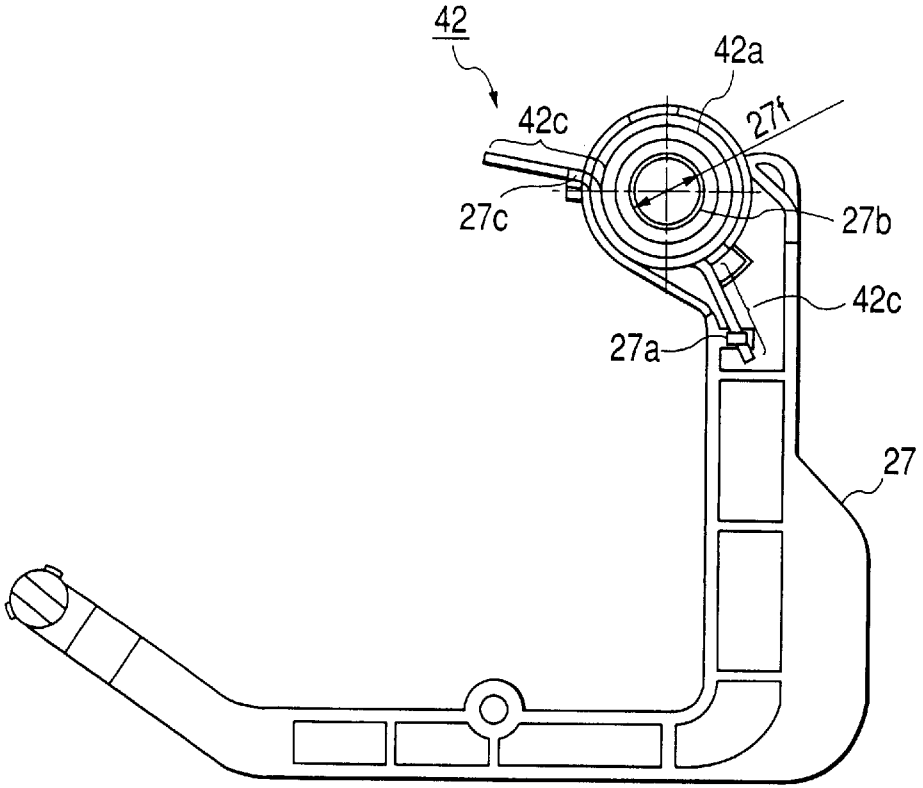
FIG. 13 is a side view showing the condition that a torsion coil spring is included in a shutter arm of the process cartridge according to the present invention is mounted.

As shown in FIGS. 13 and 14, a torsion coil spring 42 is contained in the shutter arm at its root portion. The torsion coil spring 42 for biasing the drum shutter member 28 toward a closed position has a torsion coil portion 42*a* mounted around a rotation bearing portion 27*b* of the shutter arm 27 which is fitted on the shaft 26 (to which the shutter arm 27 is rotatably connected), and straight portions 42*c* at both ends of the torsion coil spring 42 are locked to torsion coil spring support portions 27*a*, 27*c* of the shutter arm 27. The torsion coil spring 42 is already twisted in a condition that the shutter arm 27 is assembled to generate a torsional moment, so that the torsion coil spring 42 is hard to disengage from the shutter arm 27.

Figure 15:
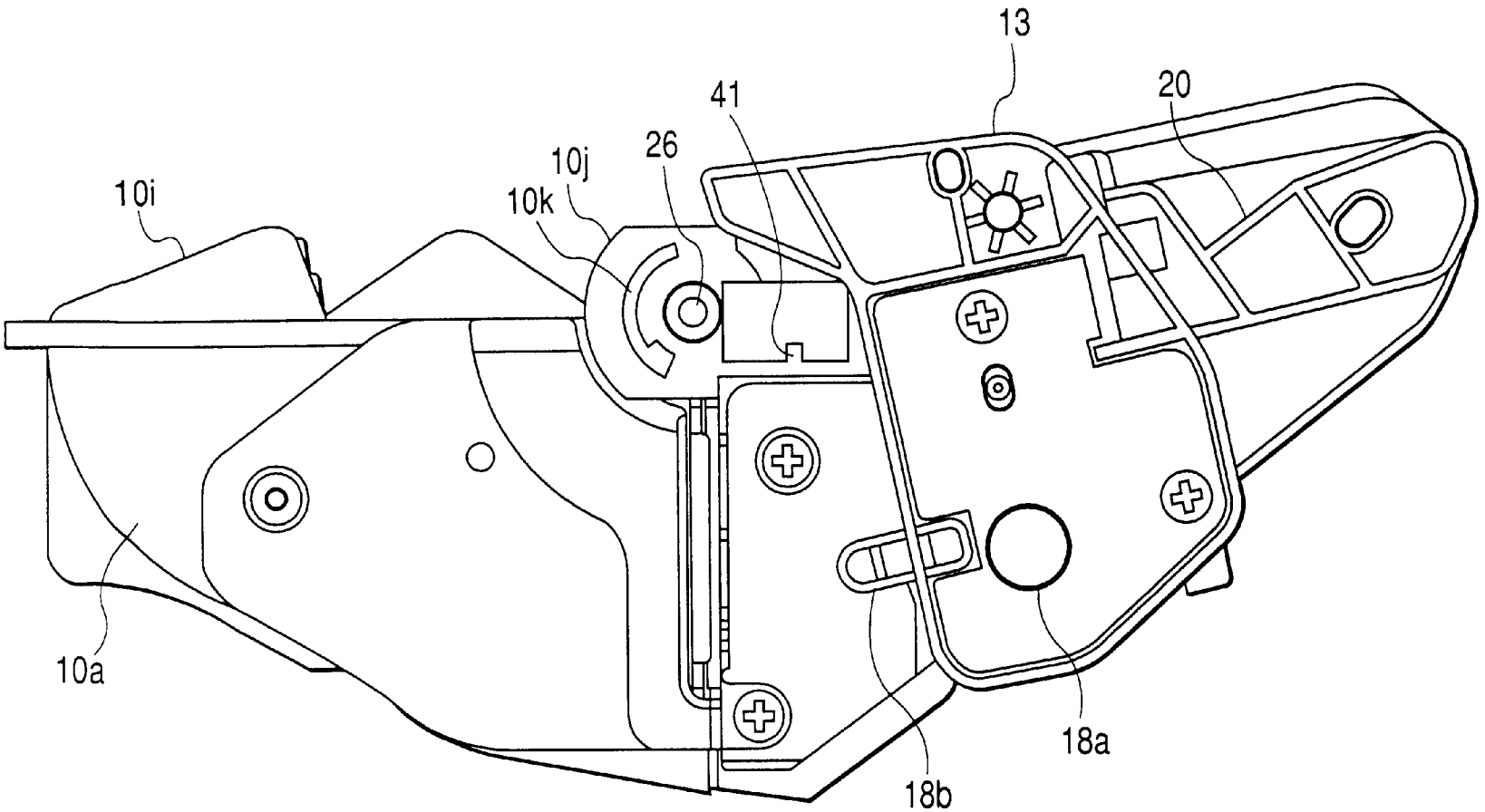
FIG. 15 is a side view of the process cartridge immediately before the shutter arm according to the present invention is attached.

FIG. 15 shows the condition before the shutter arm 27 is attached. A shutter arm attaching flange 10*j* of the toner developing frame 10*f* is provided with a hole (engagement portion) 10*k* through which a snap-fit portion 27*d* (FIG. 14) for pivotally connecting the shutter arm 27 to the flange 10*j* passes. Further, as mentioned above, the flange 10*j* is provided with the shaft 26 on which the shutter arm 27 is pivotally mounted.

The performance of the snap-fit portion 27*d* for attaching the shutter arm 27 will be described later. Now, a method for shifting the locked position of the straight portion 42*c* of the torsion coil spring 42 from the torsion coil spring support portion 27*c* of the shutter arm 27 to a locking projection 41 of the toner developing frame 10*f* will be explained.

Figure 16:
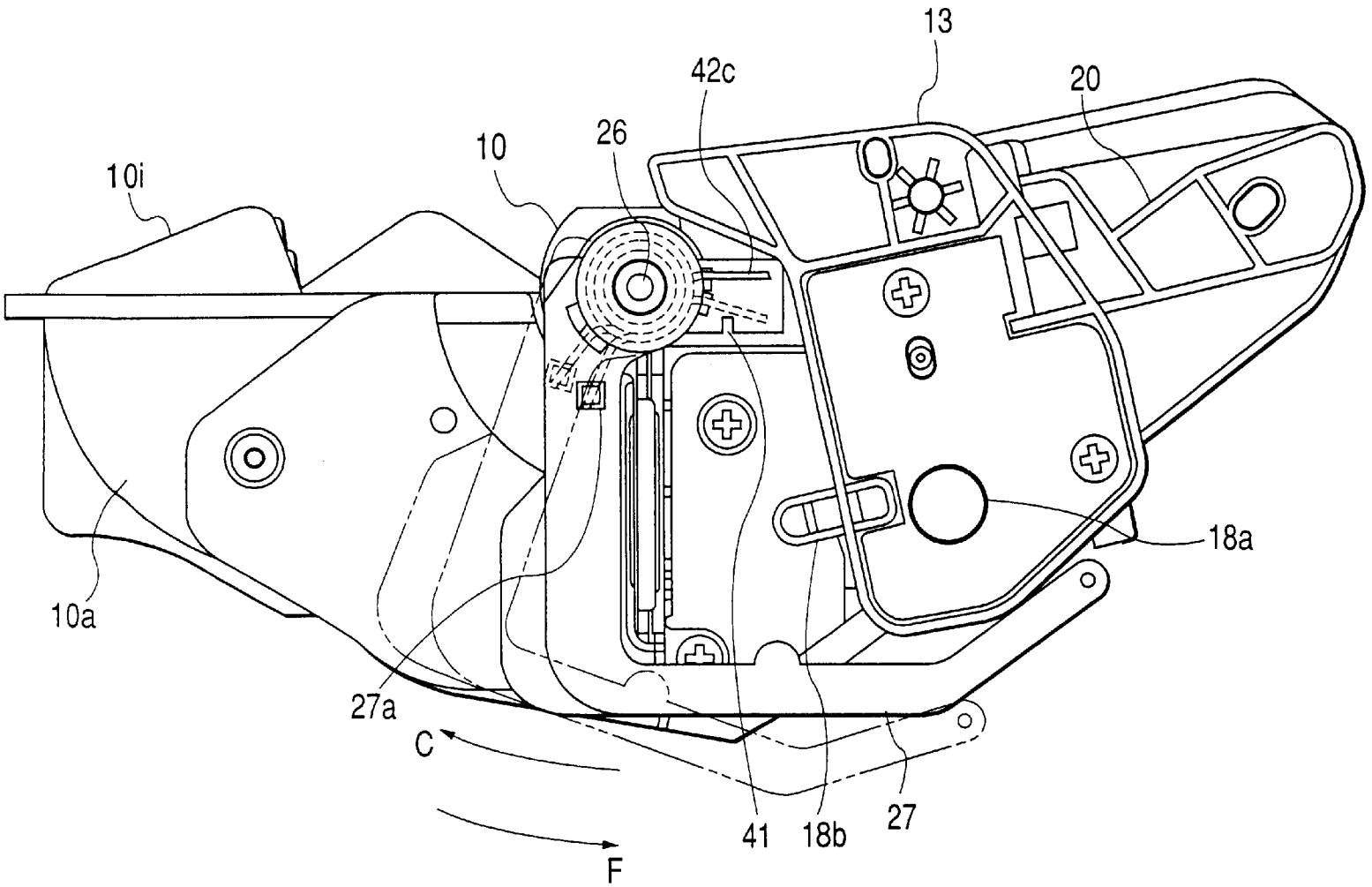
FIG. 16 is a side view showing the condition that the shutter arm according to the present invention is attached.

FIG. 16 shows the condition that the shutter arm 27 is fitted on the shaft 26 of the flange 10*j*. In this condition, when the shutter arm 27 is rotated in the direction shown by the arrow C, one of the straight portions 42*c* of the torsion coil spring 42 abuts against the locking projection 41 of the toner developing frame 10*f* (as shown by the two dot and chain line in FIG. 16). When the shutter arm is further rotated, the straight portion 42*c* of the torsion coil spring 42 is released from the torsion coil spring support portion 27*c* of the shutter arm 27 and then abuts against an inclined surface portion 27*e* shown in FIG. 14. Thus, the straight portion 42*c* of the torsion coil spring 42 is slid in a direction shown by the arrow D by the inclined surface portion 27*e*.

When the shutter arm is rotated in the direction C by a predetermined angle, the straight portion 42*c* of the torsion coil spring 42 is shifted from a line E toward the direction D. At this point, when the shutter arm 27 is returned toward a direction shown by the arrow F, the straight portion 42*c* of the torsion coil spring 42 is not returned to the torsion coil spring support portion 27*c* of the shutter arm 27 shown in FIG. 14, and the shutter arm 27 is biased toward the direction F by the torsional torque of the torsion coil spring 42.

Operation of Torsion Coil Spring As mentioned above, when the process cartridge B is inserted along the guide rails 16, a projection 29*b* of the link member 29 abuts against the first and second inclined surfaces 16*a*, 16*b* of the guide rail 16 to open the drum shutter member 28 in the direction C in FIG. 16 (refer to FIGS. 8 to 12), thereby rotating the shutter arm 27 in the direction C. When the process cartridge B is retracted, the drum shutter member 28, the link member 29 and the shutter arm 27 are automatically closed toward the direction F by the biasing force of the torsion coil spring 42.

Figure 17:
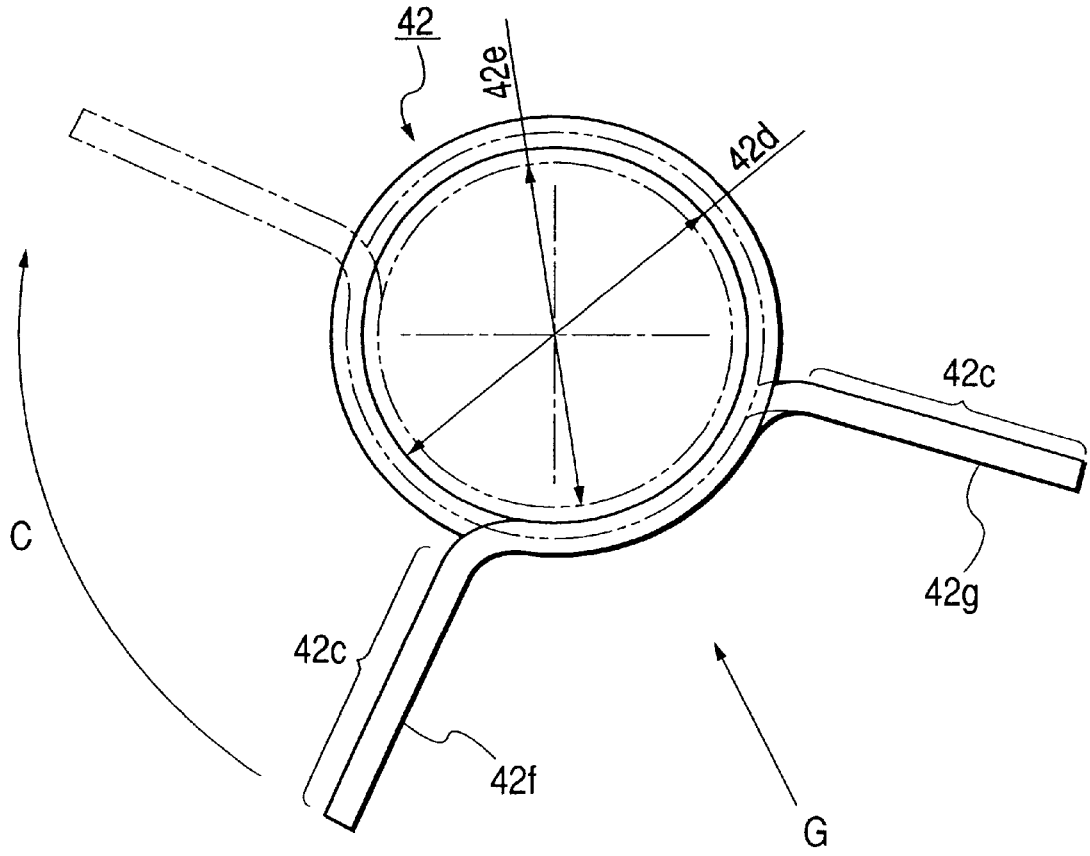
FIG. 17 is a schematic side view showing the condition that the torsion coil spring included in the shutter arm is twisted by rotation of the shutter arm.

FIG. 17 shows the condition that the torsion coil spring 42 contained in the shutter arm 27 is twisted by the rotation of the shutter arm 27 in the direction C. Particularly, the solid line shows the condition when the drum shutter member 28 is closed, and the two dot and chain line shows the condition when the drum shutter member 28 is opened. When it is assumed that an inner diameter of the torsion coil spring 42 in the condition that the drum shutter member 28 is closed is "42*d*" and an inner diameter of the torsion coil spring 42 in the condition that the drum shutter member 28 is opened is "42*e*", since the number of effective windings of the torsion coil spring 42 is increased by the opening movement of the drum shutter member 28, the inner diameter of the torsion coil spring 42 becomes smaller (42*d*>42*e*). Thus, an outer diameter 27*f* (FIGS. 13 and 20) of the rotation bearing portion 27*b* around which the torsion coil spring 42 of the shutter arm 27 is mounted must be selected to be smaller than the inner diameter 42*e* of the torsion coil spring 42 in the condition that the drum shutter member 28 is opened. If the outer diameter is greater than the inner diameter 42*e*, when the shutter arm 27 is rotated, the torsion coil spring 42 firmly abuts against the peripheral surface of the rotation bearing portion 27*b* to be locked thereto, so that rotational movement of the shutter arm 27 is stopped not to permit further insertion of the process cartridge B.

Figure 18:
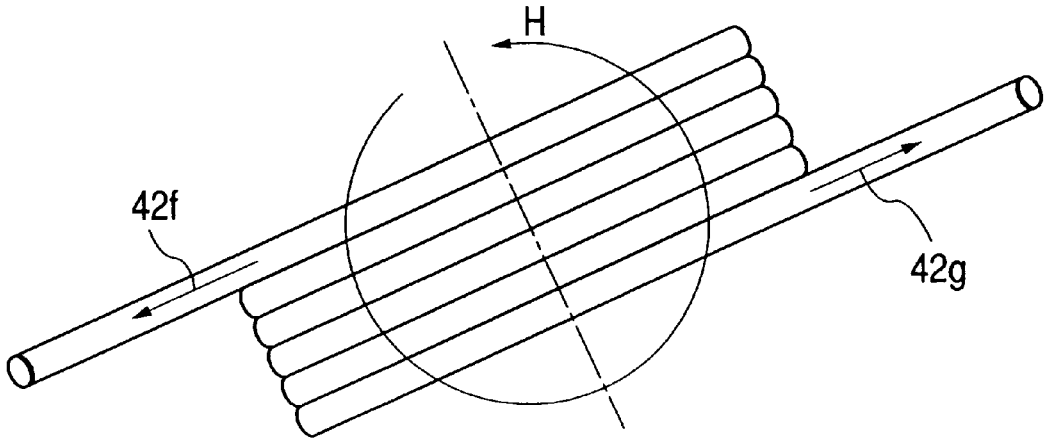
FIG. 18 is a plan view of the torsion coil spring.

The torsion coil spring 42 affords the biasing force to the drum shutter member 28, and at the same time, is subjected to reaction forces 42*f*, 42*g*. FIG. 18 shows the torsion coil spring 42 looked at from a direction G in FIG. 17. Since the reaction forces 42*f*, 42*g* acting on the torsion coil spring 42 do exist in one plane perpendicular to a centerline of the torsion coil spring 42, a rotational moment directing toward a direction H is generated.

Figure 19:
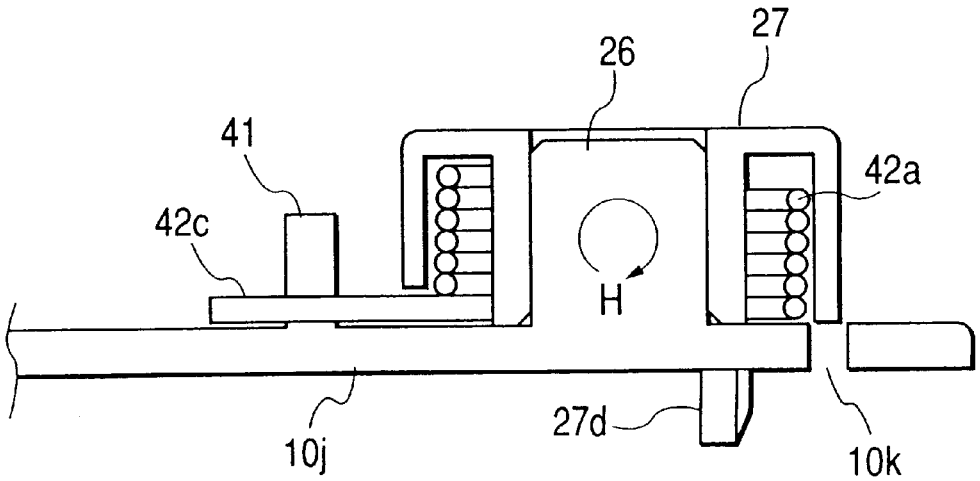
FIG. 19 is a schematic sectional view showing the conditions of the shutter arm, the flange, the torsion coil spring and the locking projection, the condition of a restoring force of the torsion coil spring when a drum shutter member is closed after the shutter arm according to the present invention is attached.

FIG. 19 is a schematic view showing the postures of the shutter arm 27, the flange 10*j*, the torsion coil spring 42 and the locking projection 41 when the drum shutter member 28 is closed in the condition that the shutter arm 27 is assembled to the toner developing frame 10*f*. At this point, the torsion coil spring 42 has been twisted from a free condition so that the rotational moment directing toward the direction H acts on the torsion coil spring 42.

Figure 20:
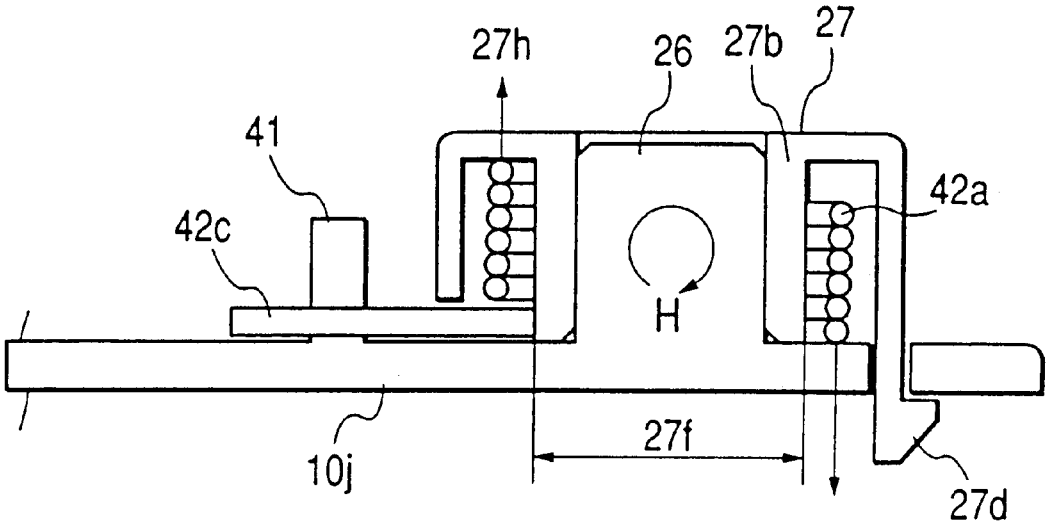
FIG. 20 is a schematic sectional view showing the conditions of the shutter arm, the flange, the torsion coil spring and the locking projection, the condition of a restoring force of the torsion coil spring when a drum shutter member is opened after the shutter arm according to the present invention is attached.

FIG. 20 is a schematic view showing postures of the shutter arm 27, the flange 10*j*, the torsion coil spring 42 and the locking projection 41 when the drum shutter member 28 is being opened toward the direction C. The torsion coil spring 42 is twisted from the closed condition of the drum shutter member 28 to reduce the inner diameter of the torsion coil spring 42 and to increase the torsional moment of the torsion coil spring 42, so that the reaction forces 42*f*, 42*g* acting on the torsion coil spring 42 from the locking projection 41 and the torsion coil spring support portion 27*a* are also increased, thereby increasing the rotational moment directing toward the direction H. For the above-mentioned reason, since the inner diameter of the torsion coil spring 42 is selected to be greater than the outer diameter 27*f* of the rotation bearing portion, due to the rotational moment directing toward the direction H, the torsion coil spring 42 can be rotated in the direction H relatively freely, to be abutted against the flange 10*j* and an inner wall 27*g* of the shutter arm.

Consequently, the shutter arm 27 receives a force 27*h* from the torsion coil spring 42 and the flange 10*j* receives a force 10*m* from the torsion coil spring 42, so that the shutter arm 27 tries to disengage from the flange 10*j*.

Performance of Snap-Fit When Shutter Arm is Attached

Figure 21:
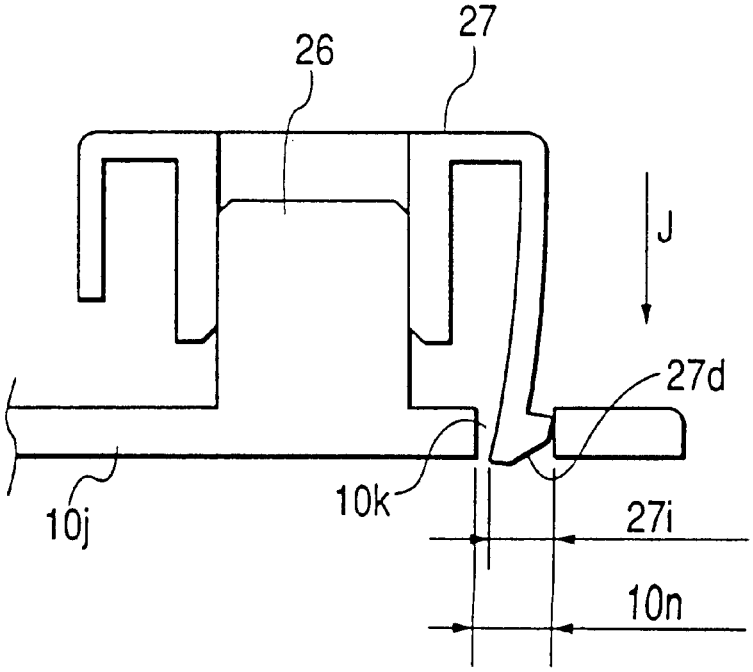
FIG. 21 is a schematic sectional view showing the movement of a snap-fit portion when the shutter arm according to the present invention is assembled to a flange.
Figure 22:
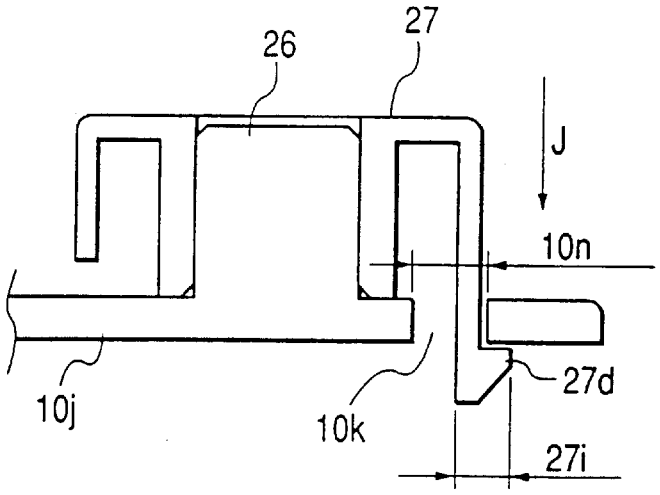
FIG. 22 is a schematic sectional view showing the condition that the snap-fit portion is completely passed through a hole.

FIG. 21 is a schematic sectional view showing the movement of the snap-fit portion 27*d* having a pawl at its tip end when the shutter arm 27 is assembled to the flange 10*j* (the torsion coil spring 42 is not shown). During the assembling while shifting the shutter arm 27 in a direction J, as shown in FIG. 21, the snap-fit portion 27*d* passes through the hole 10*k* of the flange 10*j* while being slightly flexed due to its elasticity. FIG. 22 is a schematic sectional view showing a condition that the snap-fit portion 27*d* has passed through the hole completely. In this condition, the flexed snap-fit portion 27*d* is returned to its initial straight posture.

In order to permit the passage of the snap-fit portion 27*d* through the hole 10*k* of the flange 10*j*, a width 27*i* of the head of the flexed snap-fit portion 27*d* must be selected to be smaller than a width 10*n* of the hole 10*k* of the flange 10*j* and the hole 10*k* must be positioned accurately.

That is to say, the relation (10*n*>27*i*) must be established.

The above relation may be satisfied only when the shutter arm 27 is assembled to the toner developing frame 10*f*. In this case, the width of the hole 10*k* at a position corresponding to the position of the snap-fit portion 27*d* of the shutter arm 27 may be considered. The reason is that, as explained in connection with FIG. 10, when the drum shutter member 28 is opened toward the direction C in FIG. 18, the shutter arm 27 tries to separate from the flange 10*j* as the torsional angle of the torsion coil spring 42 is increased.

Figure 23:
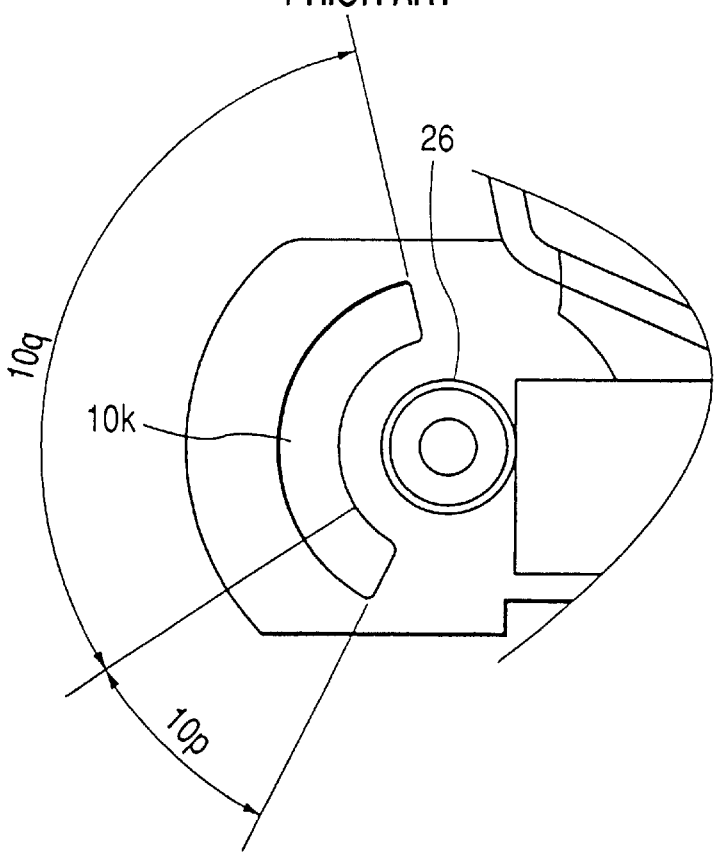
FIG. 23 PRIOR ART
FIG. 23 is a schematic view showing a hole configuration in a conventional flange.
Figure 24:
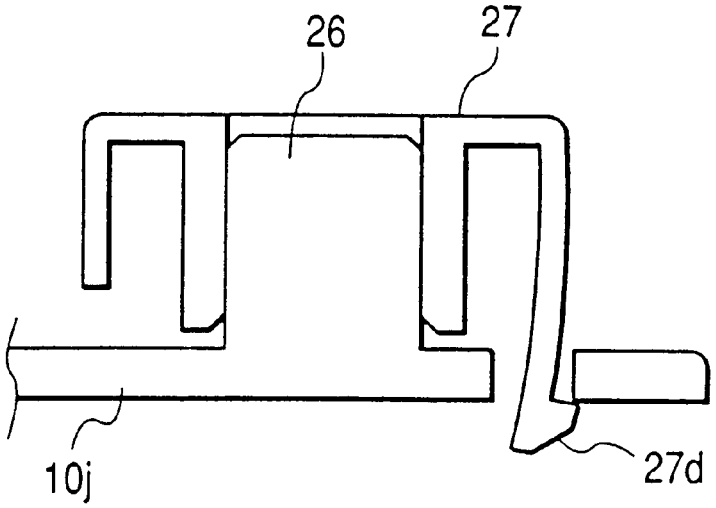
FIG. 24 PRIOR ART
FIG. 24 is a schematic sectional view showing the condition that a snap-fit portion is flexed in a prior art.
Figure 25:
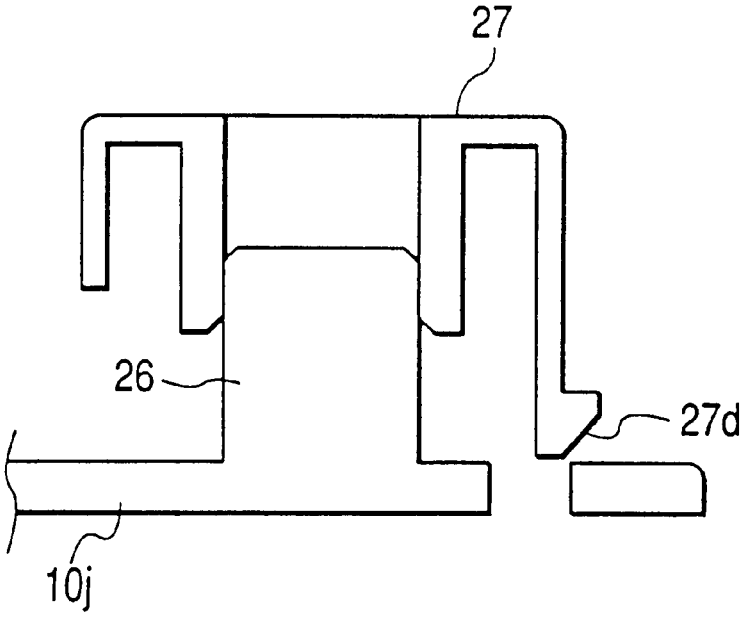
FIG. 25 PRIOR ART
FIG. 25 is a schematic sectional view showing the condition that is snap-fit portion is flexed and is disengaged from a flange in a prior art.

In the condition that the drum shutter member 28 is opened, i.e., when the force 27*h* (from the torsion coil spring 42) acting on the shutter arm 27 and tending to separate the shutter arm 27 from the shaft 26 in the axial direction is increased, if the width of the snap-fit portion 27*d* is the same as the width 10*n* of the hole 10*k* of the flange 10*j* at the position corresponding to the position of the snap-fit portion 27*d* when the shutter arm 27 is attached (for example, as is in the conventional case shown in the FIG. 23, in case of the hole configuration defined by two arcuate shapes having different radii disposed around the shaft 26 in such a manner that the width of a hole position 10*p* corresponding to the position of the snap-fit portion 27*d* when the shutter arm 27 is attached becomes the same as the width of a hole position 10*g* corresponding to the position of the snap-fit portion 27*d* when the drum shutter member 28 is opened), as shown in FIG. 24, the snap-fit portion 27*d* will be flexed by the force 27*h* acting on the shutter arm 27 from the torsion coil spring 42, so that the shutter arm 27 may be separated from the flange 10*j*. Further, as shown in FIG. 25, the snap-fit portion 27*d* may be separated from the flange 10*j*.

Detailed Explanation of First Embodiment

Figure 26:
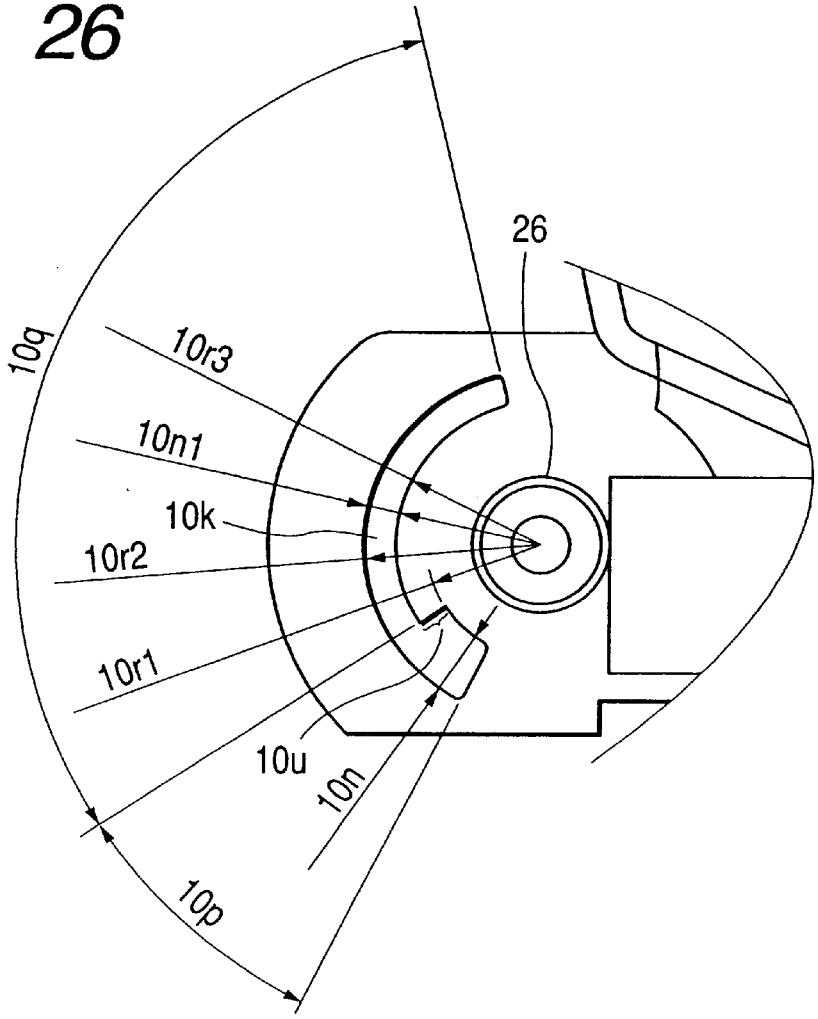
FIG. 26 is a schematic side view showing a hole configuration according to a first embodiment of the present invention.
Figure 27:
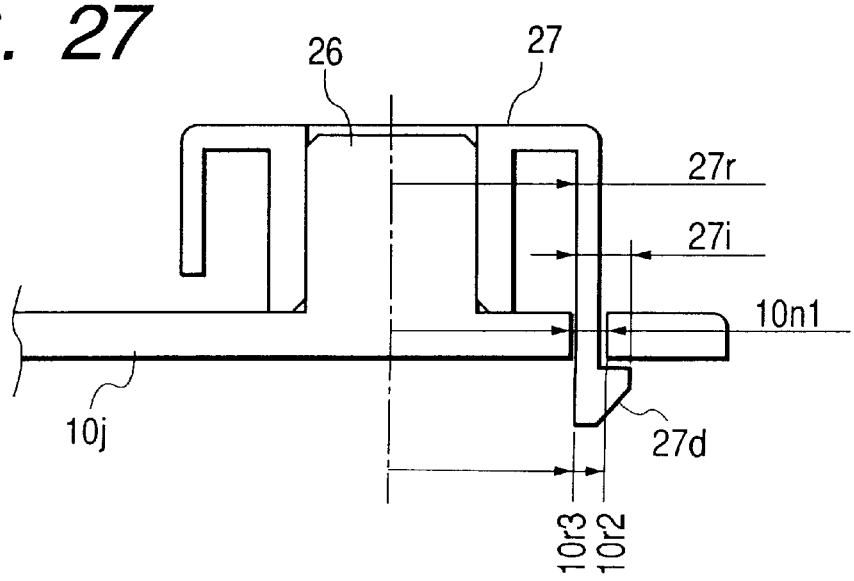
FIG. 27 is a schematic sectional view showing a snap-fit portion and a hole configuration in the condition that a shutter member according to the first embodiment of the present invention is opened.

In FIGS. 26 and 27, the shutter arm 27 is attached at an angle corresponding to the position when the drum shutter member 28 is closed.

The width 10*n* (distance between an inner radius 10*r*1 and an outer radius 10*r*2 defining the hole 10*k*) of the hole within a range of the hole position 10*p* corresponding to the position of the snap-fit portion 27*d* when the shutter arm 27 is attached is selected to be greater than the width of the head of the snap-fit portion 27*d* (including the flexed condition of the snap-fit portion 27*d*) when the snap-fit portion is passed through the hole 10*k* of the flange 10*j* to establish the relation 10*n*>27*i*, thereby making the attachment of the shutter arm 27 the same as that in the conventional case. And, in this condition, within ranges other than the above, as shown in FIGS. 26 and 27, an inner radius 10*r*3 of the hole corresponding to the position of the snap-fit portion when the shutter is opened approaches the inner radius 27*r* of the snap-fit portion 27*d* as can as possible, thereby making the width 10*n*1 (10*r*2–10*r*3) of the hole 10*k* smaller than the width 27*i* of the head of the snap-fit portion 27*d*. That is to say, by establishing a relation 10*n*1<27*i* from a position exceeding a step 10*u*, even when the shutter arm 27 receives the force 27*h* from the torsion coil spring 42, the flexion of the snap-fit portion 27*d* extends only up to the inner radius of the hole 10*k* of the flange 10*j* corresponding to the position of the snap-fit portion when the shutter is opened, and due to the relation 10*n*1<27*i*, the head of the snap-fit portion 27*d* cannot be disengaged from the hole 10*k* physically. With the arrangement as mentioned above, in the condition that the drum shutter member 28 is opened, the shutter arm 27 cannot be disengaged from the flange 10*j*.

In the illustrated embodiment, while an example that the snap-fit portion 27*d* of the shutter arm 27 is convex outwardly relative to center of the shaft 26 was explained, the present invention is not limited to such an example, but, the snap-fit portion may be convex inwardly relative to center of the shaft 26, and at the same time the configuration of the hole 10*k* of the flange 10*j* may be changed in a stepped manner in correspondence to such alteration.

Second Embodiment

The second embodiment will be explained based on FIGS. 28 and 29. The shutter arm 27 is attached at an angle corresponding to the position when the drum shutter member 28 is closed.

The width 10*n* (the distance between an inner radius 10*r*1 and an outer radius 10*r*2 defining the hole 10*k*) of the hole 10*k* within a range of the hole position 10*p* corresponding to the position (corresponding to the angle when the drum shutter member 28 is closed) of the snap-fit portion 27*d* when the shutter arm 27 is attached, is selected to be greater than the width 27*i* of the head of the snap-fit portion 27*d* (including the flexed condition of the snap-fit portion 27*d*) when the snap-fit portion passes through the hole 10*k* of the flange 10*j* to establish the relation 10*n*>27*i*, thereby making the attachment of the shutter arm 27 the same as that in the conventional case. This is the same as the first embodiment. However, in the second embodiment, the relation 10*n*>27*i* is maintained within the whole area of the hole 10*k*.

Figure 28:
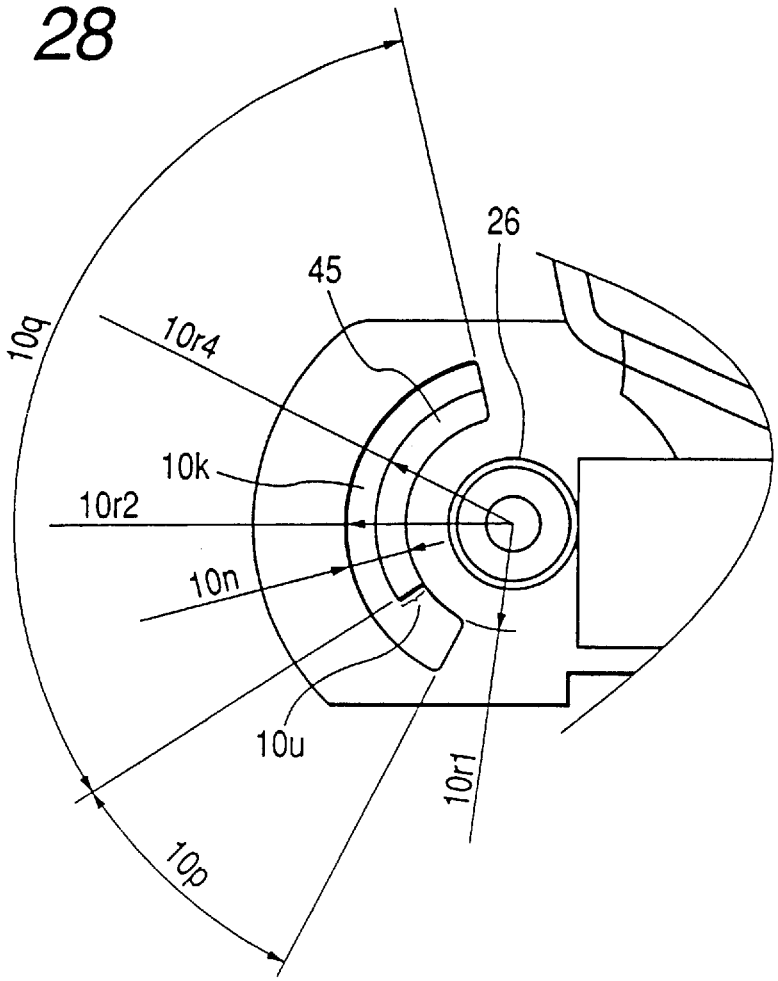
FIG. 28 is a schematic side view showing a hole configuration and a back-up member, according to a second embodiment of the present invention.

Further, in the hole position 10*q* corresponding to the position of the snap-fit portion 27*d* of the shutter arm 27 when the drum shutter member 28 is opened, in order to prevent the shutter arm from being disengaged due to the flexion of the snap-fit portion 27*d*, as shown in FIG. 28, there is provided a back-up member 45 facing the hole 10*k* to prevent the flexion of the snap-fit portion 27*d*.

Figure 29:
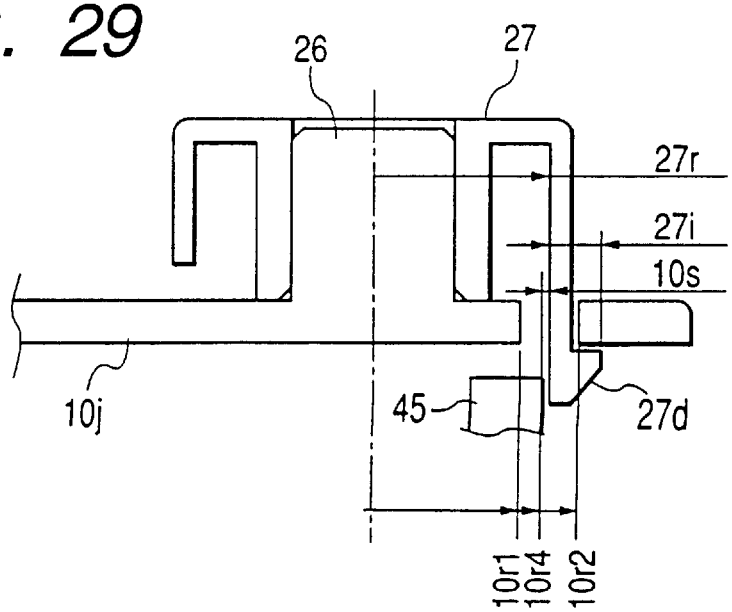
FIG. 29 is a schematic sectional view showing a snap-fit portion, a hole configuration and a back-up member, according to the second embodiment of the present invention.

As shown in FIG. 29, the back-up member 45 is secured to the process cartridge B around the shaft of the frame in an arcuate manner to extend up to the vicinity of the position of the inner radius 27*r* of the snap-fit portion. With this arrangement, even when shutter arm 27 receives the force 27*h* from the torsion coil spring 42, the snap-fit portion 27*d* can be flexed only within a small range 10*s* (27*r*–10*r*4) corresponding to a distance through which the snap-fit portion abuts against the back-up member 45, so that the head of the snap-fit portion 27*d* cannot be disengaged from the hole 10*k* physically. In this way, in the condition that the drum shutter member 28 is opened, the shutter arm 27 cannot be disengaged from the flange 10*j*.

In the illustrated embodiment, while an example that the snap-fit portion 27*d* of the shutter arm 27 is convex outwardly relative to center of the shaft 26 was explained, the present invention is not limited to such an example, but, the snap-fit portion may be convex inwardly relative to center of the shaft 26, and at the same time the back-up member 45 may be disposed outside of the hole 10*k* in correspondence to such alteration.

In FIG. 29, while an example that of a back-up member 45 formed as an independent member was explained, the back-up member may be formed integrally with the flange 10*j*.

Third Embodiment

Figure 30:
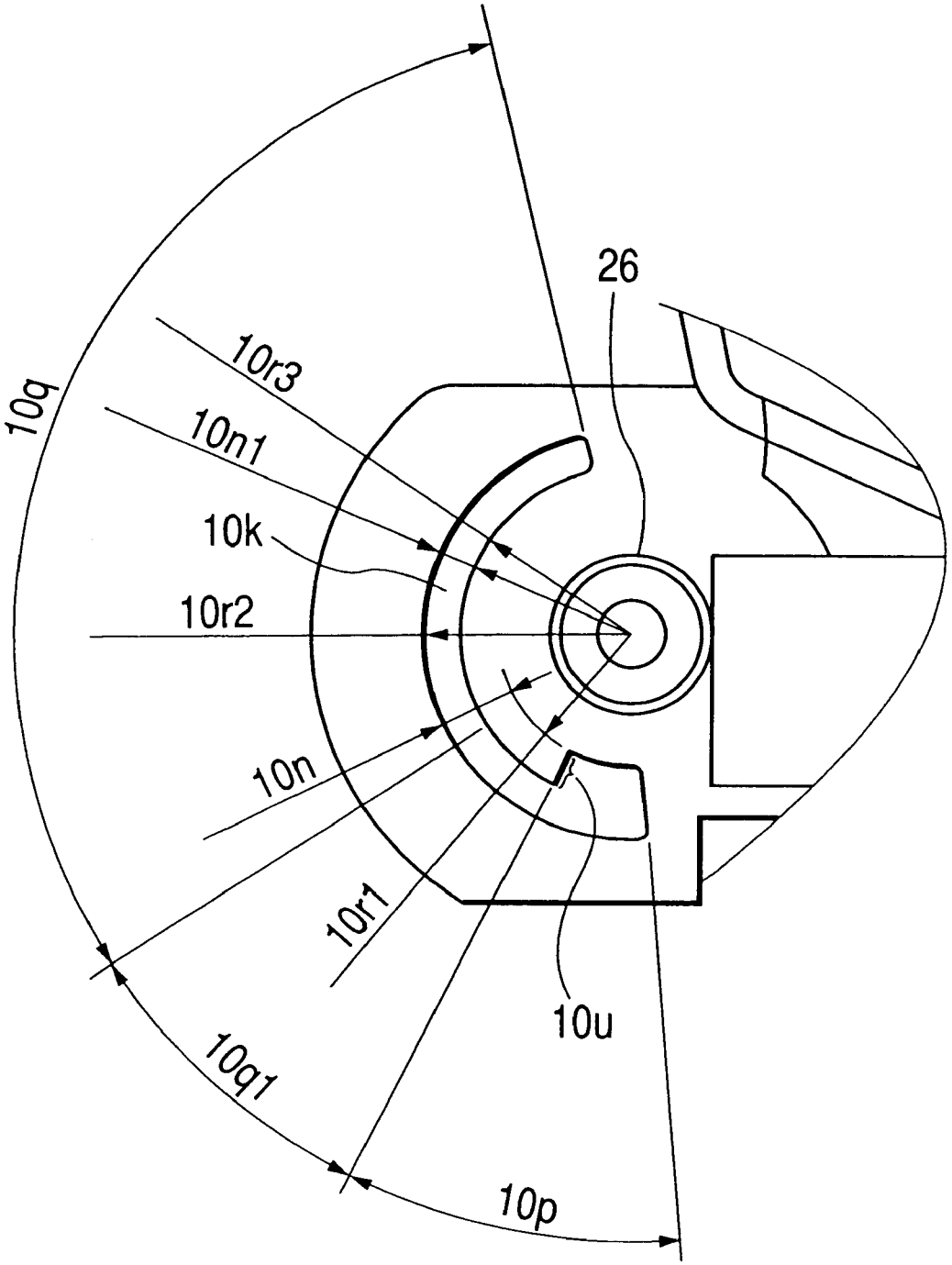
FIG. 30 is a schematic side view showing a hole configuration according to a third embodiment of the present invention.

In the first and second embodiments, while an example that the shutter arm 27 is attached at the angle corresponding to the closed position of the shutter member 28 was explained, so long as a space for the flange 10*j* is available, the range of the hole position for attachment may be differentiated from the hole range corresponding to the position of the snap-fit portion 27*d* of the shutter arm 27 rotated in synchronism with the opening and closing of the shutter member 28. FIG. 30 is a schematic view for explaining a third embodiment of the present invention, for such a deformation. A point different from the first embodiment is that the hole position 10*p* where the shutter arm 27 is attached is completely separated from a hole position 10*q*1 when the drum shutter member 28 is closed.

The width 10*n* and positional relation of the hole at the hole position 10*p* for attaching the shutter arm are the same as the first embodiment to permit the attachment, and the width 10*n*1 and positional relation of the hole at the hole positions 10*q*, 10*q*1 when the drum shutter is opened and closed are the same as the first embodiment. As a result, the shutter arm 27 can be prevented from being disengaged during the opening and closing of the drum shutter member 28.

Figure 31:
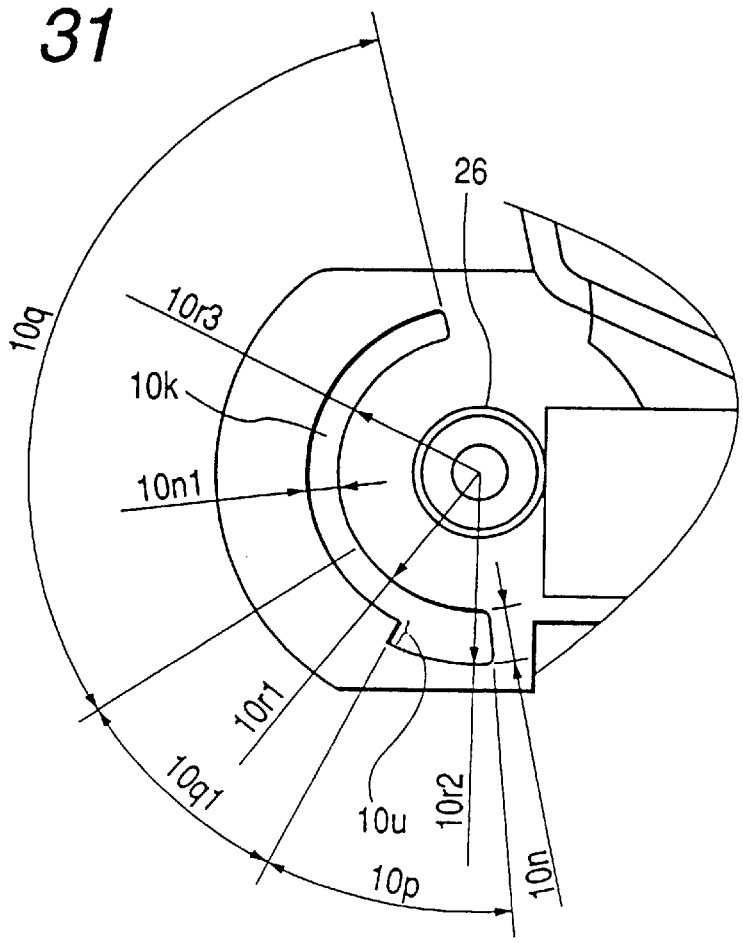
FIG. 31 is a schematic side view showing a hole configuration according to an alteration of the third embodiment of the present invention.

As is in the illustrated embodiment, when the range of the hole position for attachment is differentiated from the hole range corresponding to the position of the snap-fit portion 27*d* of the shutter arm 27 rotated in synchronism with the opening and closing of the shutter member 28, an arrangement shown in FIG. 31 can also be realized. The difference in FIG. 31 is that the hole position 10*p* for attaching the shutter arm 27 is convex outwardly.

Figure 32:
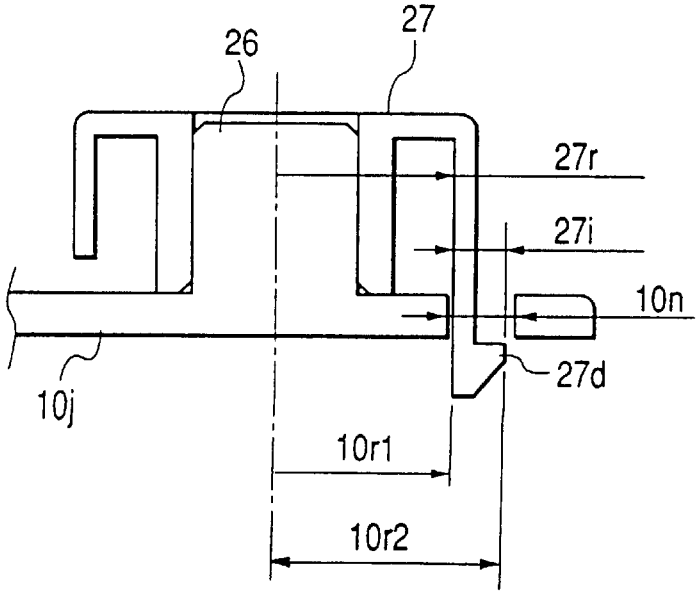
FIG. 32 is a schematic sectional view showing a condition that a shutter arm is attached, according to an alteration of the third embodiment of the present invention.

FIG. 32 is a schematic view for explaining the snap-fit portion 27*d* and the hole 10*k* when the shutter arm 27 is attached.

Since the positional relation between the hole 10*k* and the snap-fit portion 27*d* is selected to be 10*r*1<27*r*<(27*r*+27*i*)<10*r*2, when the shutter arm 27 is attached, the snap-fit portion 27*d* can be inserted without abutting against the hole 10*k*. Consequently, since the snap-fit portion is not flexed during the attachment, the shutter arm can be attached with a smaller force.

Fourth Embodiment

In the first and second embodiments, while an example of the shutter arm 27 being attached at the angle corresponding to the closed position of the shutter member 28 was explained, so long as a space for the flange 10*j* is available, the range of the hole position for attachment may be differentiated from the hole range corresponding to the position of the snap-fit portion 27*d* of the shutter arm 27 rotated in synchronism with the opening and closing of the shutter member 28.

Figure 33:
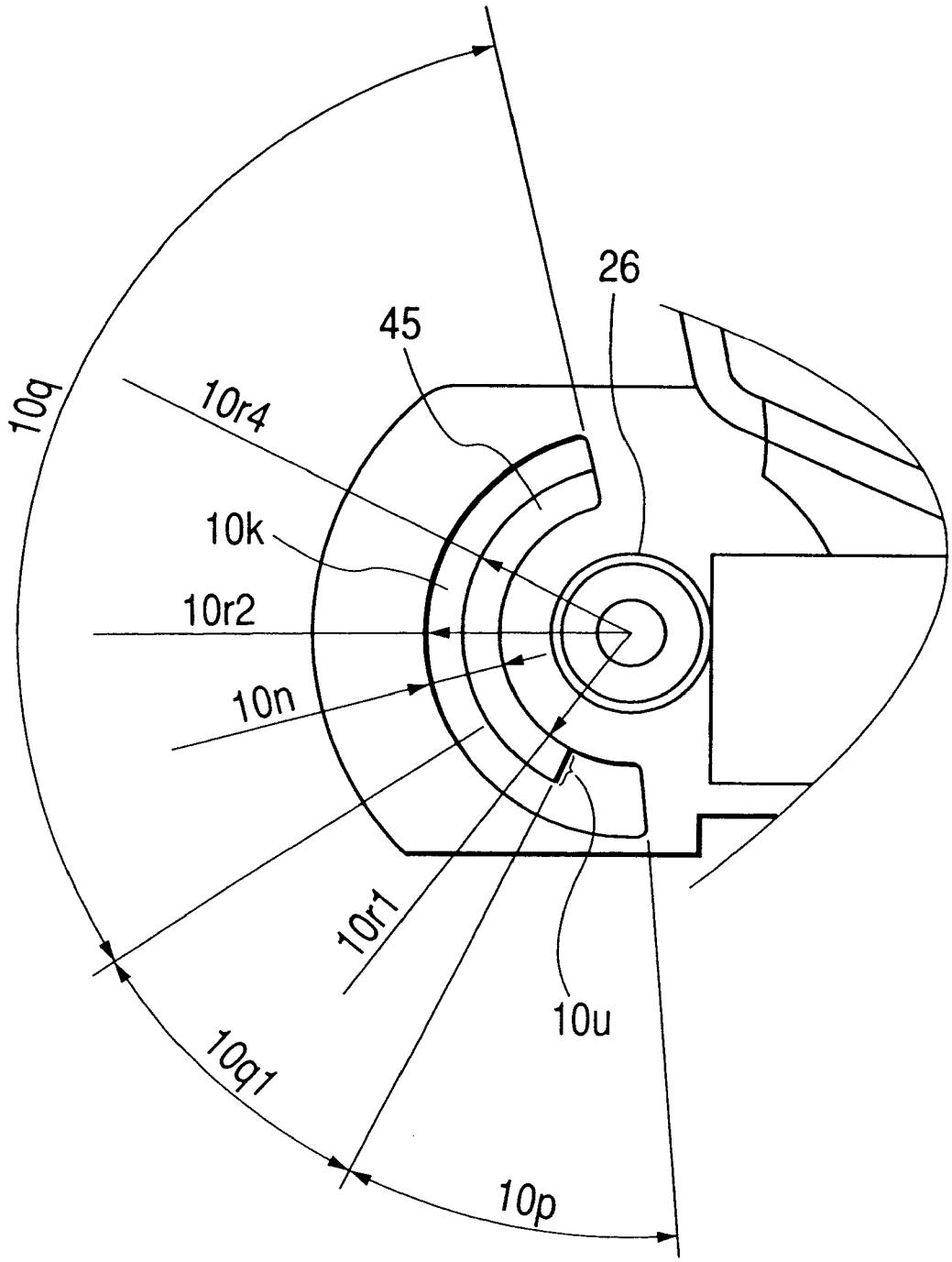
FIG. 33 is a schematic side view showing a hole configuration and a back-up member, according to a fourth embodiment of the present invention.

FIG. 33 is a schematic view for explaining a fourth embodiment of the present invention. A point of difference from the second embodiment is that the hole position 10*p* where the shutter arm 27 is attached is completely separated from a hole position 10*q*1 when the drum shutter member 28 is closed.

The width 10*n* and positional relation of the hole at the hole position 10*p* for attaching the shutter arm are the same as the second embodiment to permit the attachment, and the positional relation of the back-up member 45 for preventing the flexion of the snap-fit portion 27*d* at the hole positions 10*q*, 10*q*1 when the drum shutter is opened and closed are the same as the second embodiment. As the result, the shutter arm 27 can be prevented from being disengaged during the opening and closing of the drum shutter member 28.

Figure 34:
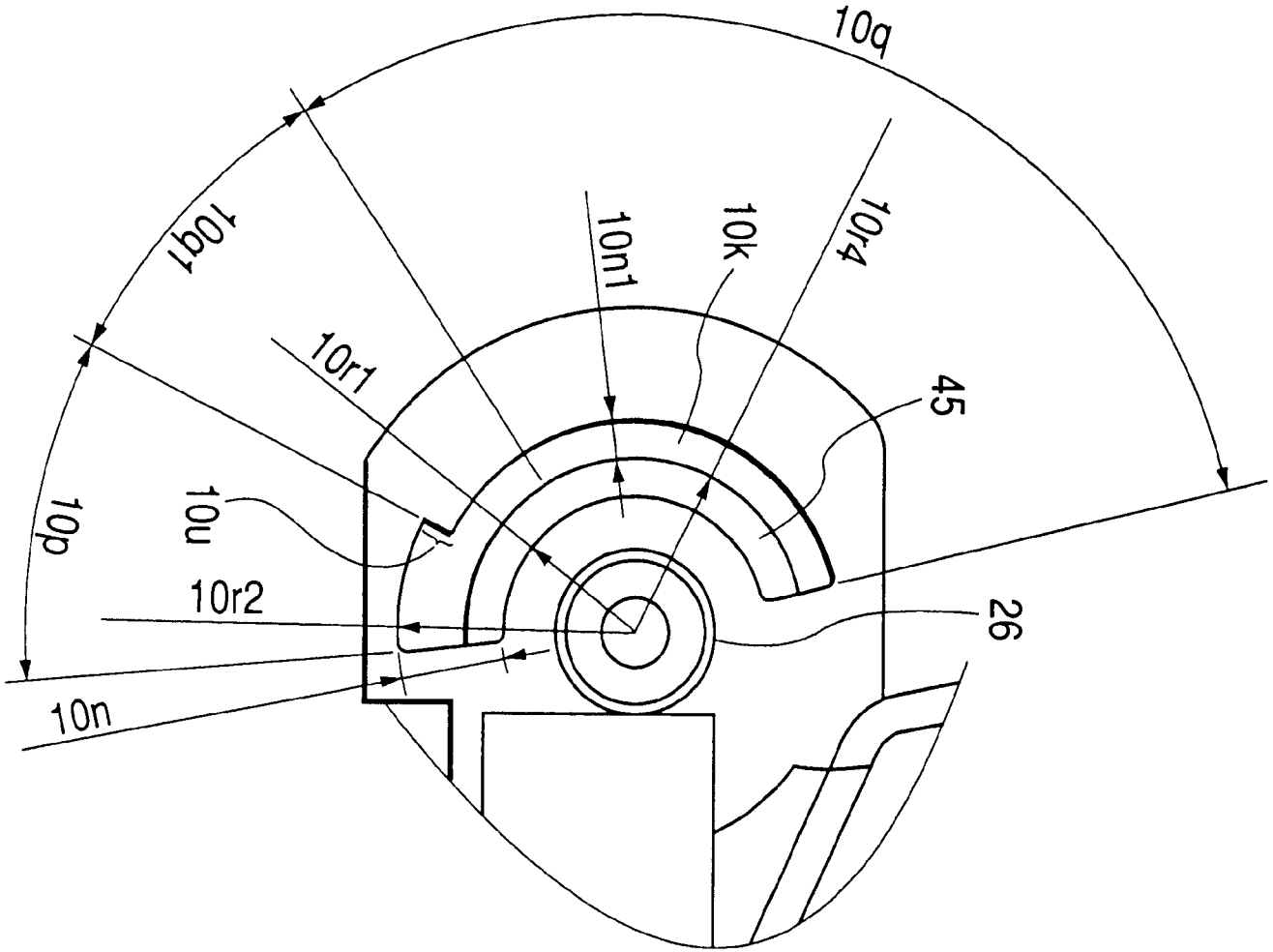
FIG. 34 is a schematic side view showing a hole configuration and a back-up member, according to an alteration of the fourth embodiment of the present invention.

As is in the illustrated embodiment, when the range of the hole position for attachment is differentiated from the hole range corresponding to the position of the snap-fit portion 27*d* of the shutter arm 27 rotated in synchronism with the opening and closing of the shutter member 28, an arrangement shown in FIG. 34 can also be realized. The difference in FIG. 34 is that the hole position 10*p* for attaching the shutter arm 27 convex outwardly.

Figure 35:
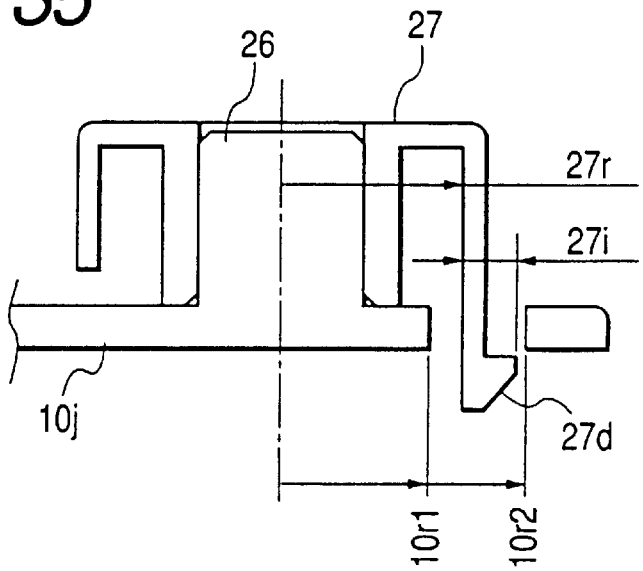
FIG. 35 is a schematic sectional view showing the condition that a shutter arm is attached, according to an alteration of the fourth embodiment of the present invention.

FIG. 35 is a schematic view for explaining the snap-fit portion 27*d* and the hole 10*k* when the shutter arm 27 is attached. Since the positional relation between the hole 10*k* and the snap-fit portion 27*d* is selected to be 10*r*1<27*r*<(27*r*+27*i*)<10*r*2, when the shutter arm 27 is attached, the snap-fit portion 27*d* can be inserted without abutting against the hole 10*k*. Consequently, since the snap-fit portion 27*d* is not flexed during the attachment, the shutter arm 27 can be attached with a smaller force.

Figure 36:
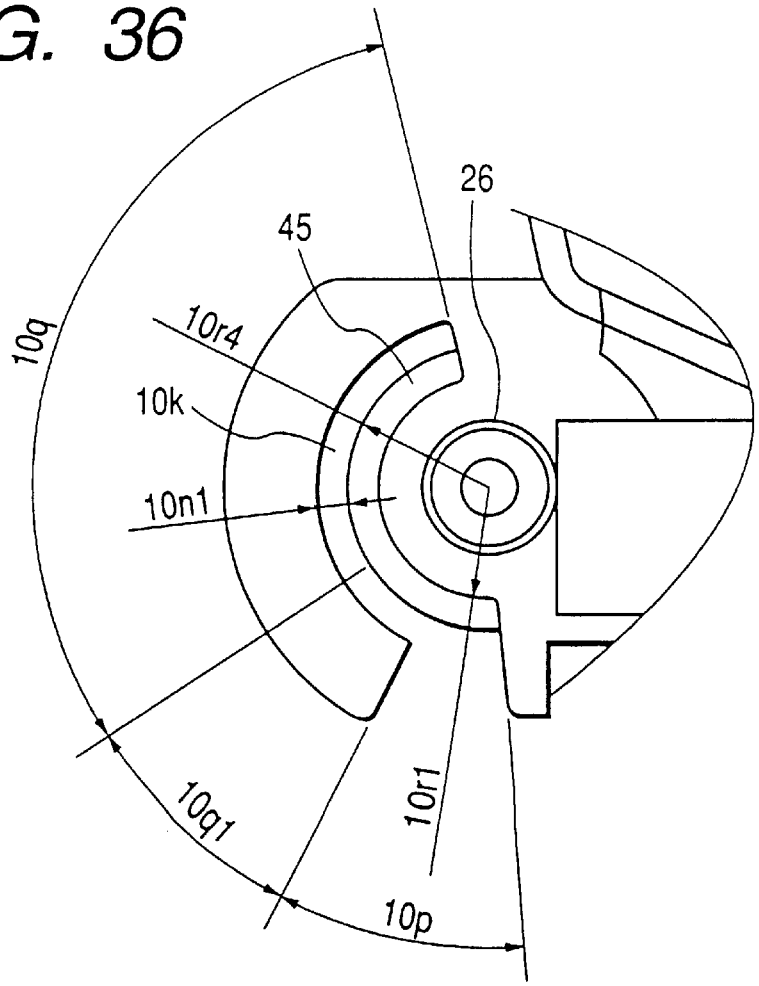
FIG. 36 is a schematic side view showing a hole configuration and a back-up member, according to an alteration of the fourth embodiment of the present invention.

In the illustrated embodiment, while the engagement portion for engaging with the snap-fit portion 27*d* was closed, such engagement portion may be opened as shown in FIG. 36.

Fifth Embodiment

Next, a fifth embodiment of the present invention will be explained based on FIG. 37.

In the first and third embodiments, the step 10*u* (refer to FIGS. 26 and 30) between the inner radius 10*r*1 and the outer radius 10*r*3 defined the hole 10*k*.

If the snap-fit portion 27*d* of the shutter arm 27 is inclined toward the step 10*u* for any reason, after the shutter arm 27 is attached, when the shutter arm 27 is rotated in the direction C in FIG. 16 (opening direction of the drum shutter member 28), the snap-fit portion 27*d* may be caught by the step 10*u*.

Figure 37:
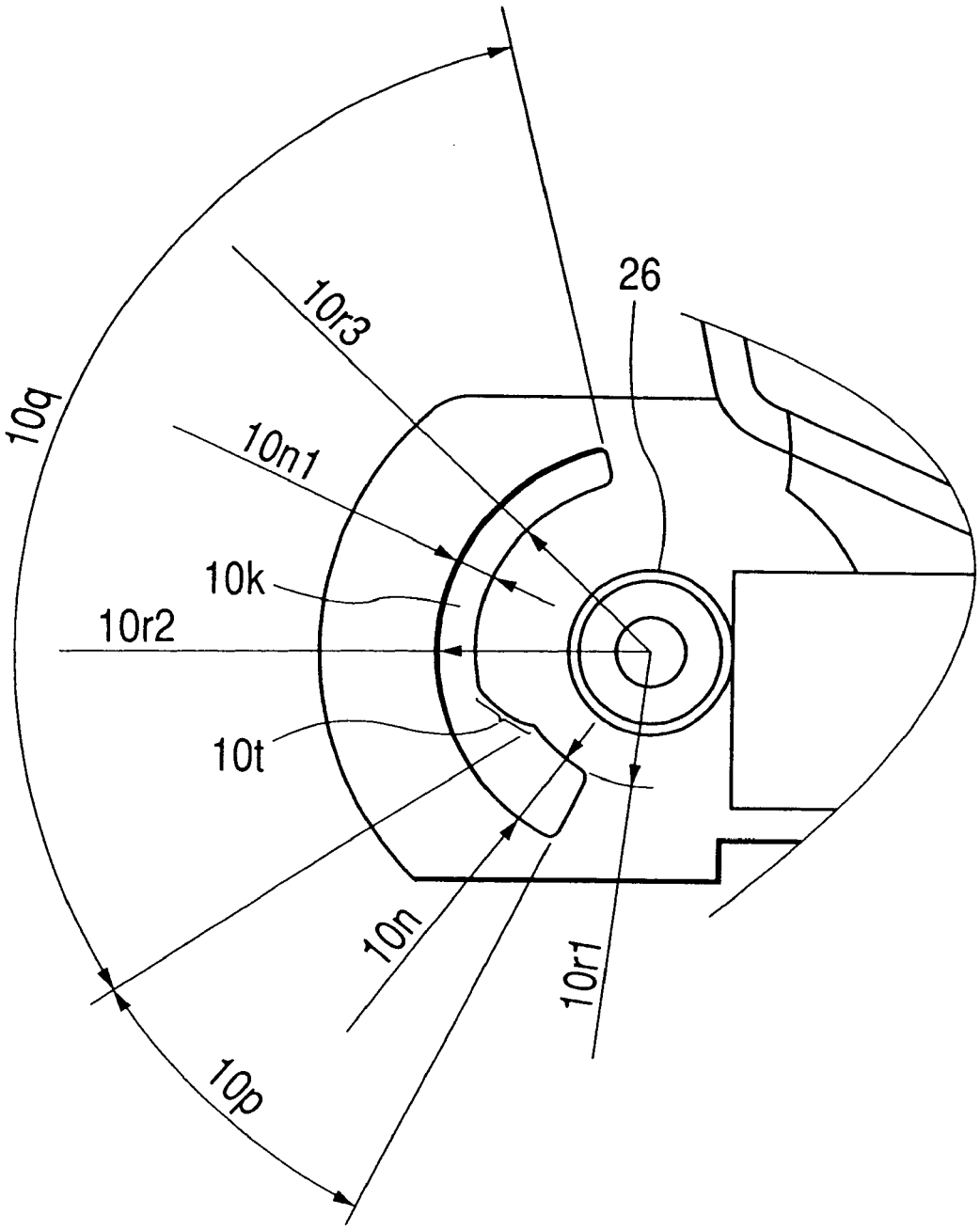
FIG. 37 is a schematic side view showing a hole configuration according to a fifth embodiment of the present invention.

To avoid this, as shown in FIG. 37, a transition zone lot is provided in place of the step 10*u* between the inner radius 10*r*1 and the outer radius 10*r*3 defining the hole 10*k* to smoothly connect between the radii so that, even when the snap-fit portion 27*d* passes through the hole, the shutter arm 27 can smoothly be rotated.

Sixth Embodiment

Now, a sixth embodiment of the present invention will be explained based on FIG. 38.

In the second embodiment, there was the step between the inner radius 10*r*1 defining the hole 10*k* and the back-up member 45, when looked at from the shaft 26 side of the shutter arm 27. So, if the snap-fit portion 27*d* of the shutter arm 27 is inclined toward the step 10*u* for any reason, after the shutter arm 27 is attached, when the shutter arm 27 is rotated in the direction C in FIG. 16 (opening direction of the drum shutter member 28), the snap-fit portion 27*d* may be caught by the step 10*u* (FIG. 28).

Figure 38:
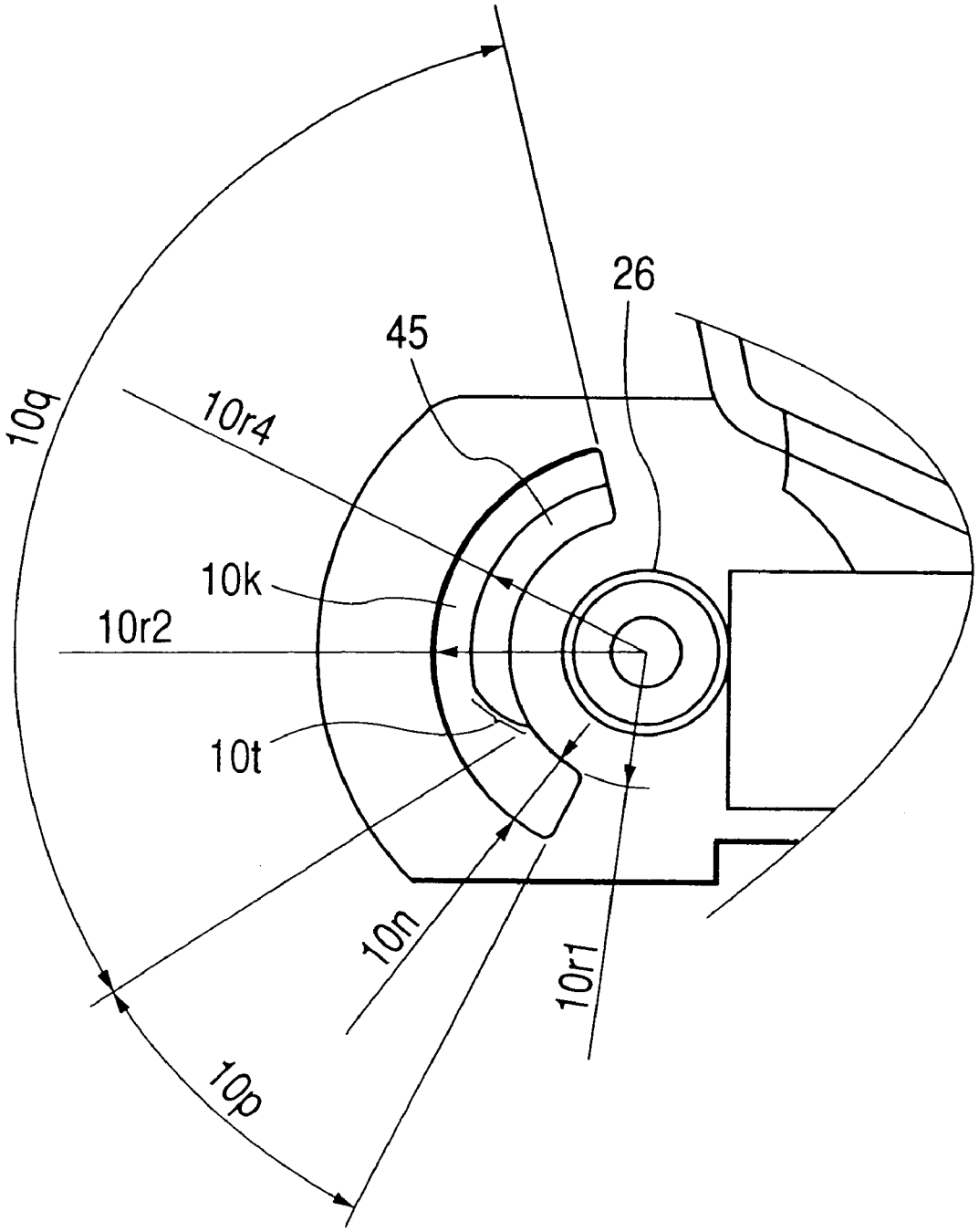
FIG. 38 is a schematic side view showing a hole configuration and a back-up member, according to a sixth embodiment of the present invention.

To avoid this, as shown in FIG. 38, a transition zone 10*t* is provided in place of the step 10*u* between back-up member 45 and the inner radius 10*r*1 defining the hole 10*k* to smoothly connect between them so that, even when the snap-fit portion 27*d* passes through the hole, the shutter arm 27 can smoothly be rotated.

Seventh Embodiment

Now, a seventh embodiment of the present invention will be explained based on FIGS. 39 and 40.

In the above-mentioned first to sixth embodiments, while an combination in which the rotation bearing portion 27*b* is provided on the shutter arm 27 and the shaft 26 is provided on the shutter arm attaching flange 10*j* of the toner developing frame 10*f* in order to pivotally connect the shutter arm 27 to the flange 10*j* was explained, the present invention is not limited to such a combination. That is, as is in an alteration of the first, third and fifth embodiments shown in FIG. 39 or as is in an alteration of the second, fourth and sixth embodiments shown in FIG. 40, the shaft 26 may be formed on the shutter arm 27 and the rotation bearing portion 27*b* may be provided on the shutter arm attaching flange 10*j* of the toner developing frame 10*f*.

In the first to sixth embodiments, the shutter arm 27 and the drum shutter member 28 may be made of synthetic resin, and the link member 29 and the torsion coil spring 42 may be formed from elastic wire such as a steel wire (for example, piano wire).

As mentioned above, according to the present invention, the advantage that the support member for supporting the shutter is hard to be disengaged from the cartridge can be realized.

What is claimed is:

1. A process cartridge detachably mountable to a main body of an electrophotographic image forming apparatus, comprising:

a cartridge frame;

an electrophotographic photosensitive member;

process means acting on said electrophotographic photosensitive member;

a shutter for covering a portion of said electrophotographic photosensitive member exposed from said cartridge frame;

a support member for supporting one longitudinal end of said shutter to said cartridge frame to shift said shutter between an operation position where said electrophotographic photosensitive member is covered by said shutter and a retract position retracted from the operation position;

a support member engagement portion provided on said support member to attach said support member to said cartridge frame; and a frame engagement portion provided on said cartridge frame to attach said support member engagement portion to said cartridge frame, said frame engagement portion including an attachment portion for engaging said support member engagement portion with said frame engagement portion, and a shift path communicating with said attachment portion, said shift path being a path through which said shutter is shifted between the operation position where said electrophotographic photosensitive member is covered by said shutter and the retract position retracted from the operation position, a space of said attachment portion being greater than a space of said shift path in a direction substantially perpendicular to a shifting direction of said shutter;

wherein said support member engagement portion can be shifted along said shift path to permit said shutter to shift between the operation position where said electrophotographic photosensitive member is covered by said shutter and the retract position retracted from the operation position.

2. A process cartridge according to claim 1, wherein said frame engagement portion comprises a hole formed in said cartridge frame, and said support member engagement portion is engaged with said hole.

3. A process cartridge according to claim 2, wherein said attachment portion comprises by a portion in which one end of said hole is opened.

4. A process cartridge according to claim 2, wherein said attachment portion is a portion provided at one end of said hole and having a greater width than said shift path.

5. A process cartridge according to claim 2, wherein said frame engagement portion comprises said hole, and a regulation member positioned along a portion of said hole corresponding to said shift path to prevent said support member engagement portion from being disengaged from said frame engagement portion, and wherein said attachment portion comprises a portion of said hole along which said regulation member is not positioned.

6. A process cartridge according to claim 2, wherein said attachment portion and said shift path are interconnected via an inclined surface.

7. A process cartridge according to claim 1, further comprising an other end support member for supporting the other longitudinal end of said shutter to said cartridge frame.

8. A process cartridge according to claim 1, further comprising an elastic member for producing an elastic force directing toward said operation position on said support member in order to bias said shutter toward said operation position.

9. A process cartridge according to claim 1, wherein said process means comprises at least one of a developing member for developing a latent image formed on said electrophotographic photosensitive member, a charging member for charging said electrophotographic photosensitive member and a cleaning member for removing developing agent adhered to said electrophotographic photosensitive member.

10. A process cartridge according to claim 1, wherein the process cartridge integrally incorporates therein said electrophotographic photosensitive member, and at least one of a developing member, a charging member and a cleaning member as said process means, as a cartridge unit which is detachably mountable to the main body of said electrophotographic image forming apparatus, and wherein said developing member develops a latent image formed on said electrophotographic photosensitive member, said charging member charges said electrophotographic photosensitive member and said cleaning member removes developing agent adhered to said electrophotographic photosensitive member.

11. A process cartridge detachably mountable to a main body of an electrophotographic image forming apparatus, comprising:

an electrophotographic photosensitive member;

a charging member for charging said electrophotographic photosensitive member;

a developing member for developing a latent image formed on said electrophotographic photosensitive member;

a cartridge frame;

a shutter for covering a portion of said electrophotographic photosensitive member exposed from said cartridge frame;

a one end support member for supporting one longitudinal end of said shutter to said cartridge frame to shift said shutter between an operation position where said electrophotographic photosensitive member is covered by said shutter and a retract position retracted from the operation position;

an other end support member for supporting the other longitudinal end of said shutter to said cartridge frame;

an elastic member for producing an elastic force directed toward said operation position on said one end support member to bias said shutter toward said operation position;

a snap-fit portion provided on said one end support member to attach said one end support member to said cartridge frame; and a hole formed in said cartridge frame to attach said snap-fit portion to said cartridge frame, said hole including a wider portion for attaching said snap-fit portion to said hole and a narrower portion which is narrower than said wider portion and through which said shutter is shifted between the operation position where said electrophotographic photosensitive member is covered by said shutter and the retract position retracted from the operation position, said narrower portion having an attachment portion and a shift path, wherein a space of said attachment portion is greater than a space of said shift path;

wherein said snap-fit portion can be shifted along said shift path to permit said shutter to shift between the operation position where said electrophotographic photosensitive member is covered by said shutter and the retract position retracted from said operation position.

12. A process cartridge according to claim 11, wherein said hole has an arc shape.

13. A process cartridge according to claim 11, wherein said wider portion and said narrower portion are interconnected by an inclined surface.

14. A process cartridge according to claim 11, 12, or 13, wherein said elastic member is a coil spring.

15. An electrophotographic image forming apparatus to which a process cartridge is detachably mountable for forming an image on a recording medium, said electrophotographic image forming apparatus comprising:

(a) a mounting member to which is detachably mountable the process cartridge including a cartridge frame, and electrophotographic photosensitive member, process means acting on said electrophotographic photosensitive member, a shutter for covering a portion of said electrophotographic photosensitive member exposed from said cartridge frame, a support member for supporting one longitudinal end of said shutter to said cartridge frame to shift said shutter between an operation position where said electrophotographic photosensitive member is covered by said shutter and a retract position retracted from the operation position, a shutter member engagement portion provided on said support member to attach said support member to said cartridge frame, and a frame engagement portion provided on said cartridge frame to attach said support member engagement portion to said cartridge frame, said frame engagement portion including an attachment portion for engaging said support member engagement portion with said frame engagement portion, and a shift path communicating with said attachment portion, said shift path providing a path through which said shutter is shifted between the operation position where said electrophotographic photosensitive member is covered by said shutter and the retract position retracted from the operation position, a space of said attachment portion being greater than a space of said shift path in a direction substantially perpendicular to a shifting direction of said shutter, and wherein said support member engagement portion can be shifted along said shift path to permit said shutter to shift between the operation position where said electrophotographic photosensitive member is covered by said shutter and the retract position retracted from the operation position;

(b) an abutment portion capable of abutting against a portion of said support member to shift said shutter from the operation position to the retract position when said process cartridge is mounted to said mounting member; and (c) a convey member for conveying the recording medium.

16. An electrophotographic image forming apparatus to which a process cartridge is detachably mounted and which forms an image on a recording medium, comprising:

(a) a mounting member capable of detachably mounting a process cartridge including an electrophotographic photosensitive member, a charging member for charging said electrophotographic photosensitive member, a developing member for developing a latent image formed on said electrophotographic photosensitive member, a cartridge frame, a shutter for covering a portion of said electrophotographic photosensitive exposed from said cartridge frame, a one end support member for supporting one longitudinal end of said shutter to said cartridge frame to shift said shutter between an operation position where said electrophotographic photosensitive member is covered by said shutter and a retract position retracted from the operation position, an other end support member for supporting the other longitudinal end of said shutter to said cartridge frame, an elastic member for producing an elastic force directed toward said operation position on said one end support member to bias said shutter toward said operation position, a snap-fit portion provided on said one end support member to attach said one end support member to said cartridge frame, and a hole formed in said cartridge frame to attach said snap-fit portion to said cartridge frame, said hole including a wider portion for attaching said snap-fit portion to said hole and a narrower portion which is narrower than said wider portion and through which said shutter is shifted between the operation position where said electrophotographic photosensitive member is covered by said shutter and the retract position retracted from the operation position, said narrower portion having an attachment portion and a shift path, wherein a space of said attachment portion is greater than a space of said shift path, and wherein said snap-fit portion can be shifted along said shift path to permit said shutter to shift between the operation position where said electrophotographic photosensitive member is covered by said shutter and the retract position retracted from said operation position;

(b) an abutment portion capable of abutting against a portion of said one end support member to shift said shutter from the operation position to the retract position when said process cartridge is mounted to said mounting member; and (c) a convey member for conveying the recording medium.

17. A process cartridge detachably mountable to a main body of an electrophotographic image forming apparatus, comprising:

a cartridge frame;

an electrophotographic photosensitive member;

process means acting on said electrophotographic photosensitive member;

a shutter for covering a portion of said electrophotographic photosensitive member exposed from said cartridge frame;

a support member for supporting one longitudinal end of said shutter to said cartridge frame to shift said shutter between an operation position where said electrophotographic photosensitive member is covered by said shutter and a retract position retracted from the operation position;

a support member engagement portion provided on said support member to attach said support member to said cartridge frame; and a frame engagement portion provided on said cartridge frame to attach said support member engagement portion to said cartridge frame, said frame engagement portion including an attachment portion for engaging said support member engagement portion with said frame engagement portion, and a shift path through which said shutter is shifted between the operation position where said electrophotographic photosensitive member is covered by said shutter and the retract position retracted from the operation position, a space of said attachment portion being greater than a space of said shift path in a direction substantially perpendicular to a shifting direction of said shutter, wherein said support member engagement portion can be shifted along said shift path to permit said shutter to shift between the operation position where said electrophotographic photosensitive member is covered by said shutter and the retract position retracted from the operation position, wherein said frame engagement portion comprises a hole formed in said cartridge frame, and said support member engagement portion is engaged with said hole, and wherein said attachment portion comprises a portion in which one end of said hole is opened.

18. A process cartridge detachably mountable to a main body of an electrophotographic image forming apparatus, comprising:

a cartridge frame;

an electrophotographic photosensitive member;

process means acting on said electrophotographic photosensitive member;

a shutter for covering a portion of said electrophotographic photosensitive member exposed from said cartridge frame;

a support member for supporting one longitudinal end of said shutter to said cartridge frame to shift said shutter between an operation position where said electrophotographic photosensitive member is covered by said shutter and a retract position retracted from the operation position;

a support member engagement portion provided on said support member to attach said support member to said cartridge frame; and a frame engagement portion provided on said cartridge frame to attach said support member engagement portion to said cartridge frame, said frame engagement portion including an attachment portion for engaging said support member engagement portion with said frame engagement portion, and a shift path through which said shutter is shifted between the operation position where said electrophotographic photosensitive member is covered by said shutter and the retract position retracted from the operation position, a space of said attachment portion being greater than a space of said shift path in a direction substantially perpendicular to a shifting direction of said shutter, wherein said support member engagement portion can be shifted along said shift path to permit said shutter to shift between the operation position where said electrophotographic photosensitive member is covered by said shutter and the retract position retracted from the operation position, wherein said frame engagement portion comprises a hole formed in said cartridge frame, and said support member engagement portion is engaged with said hole, and wherein said attachment portion is a portion provided at one end of said hole and having a greater width than said shift path.

19. A process cartridge detachably mountable to a main body of an electrophotographic image forming apparatus, comprising:

a cartridge frame;

an electrophotographic photosensitive member;

process means acting on said electrophotographic photosensitive member;

a shutter for covering a portion of said electrophotographic photosensitive member exposed from said cartridge frame;

a support member for supporting one longitudinal end of said shutter to said cartridge frame to shift said shutter between an operation position where said electrophotographic photosensitive member is covered by said shutter and a retract position retracted from the operation position;

a support member engagement portion provided on said support member to attach said support member to said cartridge frame; and a frame engagement portion provided on said cartridge frame to attach said support member engagement portion to said cartridge frame, said frame engagement portion including an attachment portion for engaging said support member engagement portion with said frame engagement portion, and a shift path through which said shutter is shifted between the operation position where said electrophotographic photosensitive member is covered by said shutter and the retract position retracted from the operation position, a space of said attachment portion being greater than a space of said shift path in a direction substantially perpendicular to a shifting direction of said shutter, wherein said support member engagement portion can be shifted along said shift path to permit said shutter to shift between the operation position where said electrophotographic photosensitive member is covered by said shutter and the retract position retracted from the operation position, wherein said frame engagement portion comprises a hole formed in said cartridge frame, and said support member engagement portion is engaged with said hole, and wherein said frame engagement portion comprises said hole, and a regulation member positioned along a portion of said hole corresponding to said shift path to prevent said support member engagement portion from being disengaged from said frame engagement portion, and wherein said attachment portion comprises a portion of said hole along which said regulation member is not positioned.

20. A process cartridge according to claim 5 or 19, wherein said support member engagement portion is a snap-fitted portion, and said regulation member is a back-up member for regulating flexion of said snap-fitted portion.

21. A process cartridge detachably mountable to a main body of an electrophotographic image forming apparatus, comprising:

a cartridge frame;

an electrophotographic photosensitive member;

process means acting on said electrophotographic photosensitive member;

a shutter for covering a portion of said electrophotographic photosensitive member exposed from said cartridge frame;

a support member for supporting one longitudinal end of said shutter to said cartridge frame to shift said shutter between an operation position where said electrophotographic photosensitive member is covered by said shutter and a retract position retracted from the operation position;

a support member engagement portion provided on said support member to attach said support member to said cartridge frame; and a frame engagement portion provided on said cartridge frame to attach said support member engagement portion to said cartridge frame, said frame engagement portion including an attachment portion for engaging said support member engagement portion with said frame engagement portion, and a shift path through which said shutter is shifted between the operation position where said electrophotographic photosensitive member is covered by said shutter and the retract position retracted from the operation position, a space of said attachment portion being greater than a space of said shift path in a direction substantially perpendicular to a shifting direction of said shutter, wherein said support member engagement portion can be shifted along said shift path to permit said shutter to shift between the operation position where said electrophotographic photosensitive member is covered by said shutter and the retract position retracted from the operation position, wherein said frame engagement portion comprises a hole formed in said cartridge frame, and said support member engagement portion is engaged with said hole, and wherein said attachment portion and said shift path are interconnected via an inclined surface.

22. A process cartridge according to claim 2, 3, 4, 5, 6, 17, 18, 19, or 21 wherein said hole has an arc shape.

23. A process cartridge according to claim 22, wherein said support member engagement portion is a snap-fitted portion.

24. A process cartridge detachably mountable to a main body of an electrophotographic image forming apparatus, comprising:

a cartridge frame;

an electrophotographic photosensitive member;

process means acting on said electrophotographic photosensitive member;

a shutter for covering a portion of said electrophotographic photosensitive member exposed from said cartridge frame;

a support member for supporting one longitudinal end of said shutter to said cartridge frame to shift said shutter between an operation position where said electrophotographic photosensitive member is covered by said shutter and a retract position retracted from the operation position;

a support member engagement portion provided on said support member to attach said support member to said cartridge frame;

a frame engagement portion provided on said cartridge frame to attach said support member engagement portion to said cartridge frame, said frame engagement portion including an attachment portion for engaging said support member engagement portion with said frame engagement portion, and a shift path through which said shutter is shifted between the operation position where said electrophotographic photosensitive member is covered by said shutter and the retract position retracted from the operation position, a space of said attachment portion being greater than a space of said shift path in a direction substantially perpendicular to a shifting direction of said shutter; and an elastic member for producing an elastic force directed toward said operation position on said support member in order to bias said shutter toward said operation position, wherein said support member engagement portion can be shifted along said shift path to permit said shutter to shift between the operation position where said electrophotographic photosensitive member is covered by said shutter and the retract position retracted from the operation position, and wherein said frame engagement portion comprises a hole formed in said cartridge frame, and said support member engagement portion is engaged with said hole.

25. A process cartridge according to claim 17, 18, 19, 21, or 24, wherein said shift path communicates with said attachment portion.

* * * * *

UNITED STATES PATENT AND TRADEMARK OFFICE

CERTIFICATE OF CORRECTION

PATENT NO. : 6,075,957
DATED : June 13, 2000
INVENTOR(S) : Batori et al.

It is certified that error appears in the above-identified patent and that said Letters Patent is hereby corrected as shown below:

Replace entire Patent as shown on attached pages.

Signed and Sealed this

Thirtieth Day of May, 2006

JON W. DUDAS
*Director of the United States Patent and Trademark Office*

US006075957A

United States Patent [19]

Batori et al.

[11] Patent Number: 6,075,957
[45] Date of Patent: *Jun. 13, 2000

[54] PROCESS CARTRIDGE AND ELECTROPHOTOGRAPHIC IMAGE FORMING APPARATUS

[75] Inventors: Yoshiyuki Batori, Toride; Isao Ikemoto, Kashiwa; Minoru Sato, Toride, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/193,863

[22] Filed: Nov. 18, 1998

[30] Foreign Application Priority Data

Nov. 20, 1997 [JP] Japan ..... 9-336446

[51] Int. Cl.[7] ..... G03G 15/00; G03G 21/18

[52] U.S. Cl. ..... 399/114; 399/111

[58] Field of Search ..... 399/114, 111, 399/110, 116; 347/138, 152

[56] References Cited

U.S. PATENT DOCUMENTS

| | | | |
|---|---|---|---|
| 5,113,220 | 5/1992 | Kwak | 399/114 |
| 5,331,372 | 7/1994 | Tsuda et al. | 399/114 |
| 5,331,373 | 7/1994 | Nomura et al. | 399/111 |
| 5,404,198 | 4/1995 | Noda et al. | 399/107 |
| 5,452,056 | 9/1995 | Nomura et al. | 399/111 |
| 5,470,635 | 11/1995 | Shirai et al. | 428/131 |
| 5,475,470 | 12/1995 | Sasago et al. | 399/111 |
| 5,488,459 | 1/1996 | Tsuda et al. | 399/167 |
| 5,500,714 | 3/1996 | Yashiro et al. | 399/111 |
| 5,510,878 | 4/1996 | Noda et al. | 399/111 |
| 5,581,325 | 12/1996 | Tsuda et al. | 399/116 |
| 5,583,613 | 12/1996 | Kobayashi et al. | 399/111 |
| 5,585,889 | 12/1996 | Shishido et al. | 399/113 |
| 5,602,623 | 2/1997 | Nishibata et al. | 399/111 |
| 5,608,509 | 3/1997 | Shirai et al. | 399/351 |
| 5,617,579 | 4/1997 | Yashiro et al. | 399/114 |
| 5,623,328 | 4/1997 | Tsuda et al. | 399/111 |
| 5,642,187 | 6/1997 | Nomura et al. | 399/111 |
| 5,659,847 | 8/1997 | Tsuda et al. | 399/113 |
| 5,669,042 | 9/1997 | Kobayashi et al. | 399/111 |
| 5,749,027 | 5/1998 | Ikemoto et al. | 399/111 X |
| 5,828,928 | 10/1998 | Sasago et al. | 399/111 |
| 5,873,012 | 2/1999 | Miyabe et al. | 399/111 X |
| 5,890,036 | 3/1999 | Karakama et al. | 399/119 |

FOREIGN PATENT DOCUMENTS 9-026739 1/1997 Japan .

*Primary Examiner*—Sophia S. Chen
*Attorney, Agent, or Firm*—Fitzpatrick, Cella, Harper & Scinto

[57] ABSTRACT

A process cartridge which can detachably be mounted to an electrophotographic image forming apparatus, and which includes a cartridge frame, an electrophotographic photosensitive member, a process device acting on the photosensitive member, a shutter for covering a portion of the photosensitive member exposed from the cartridge frame, a support member for supporting one longitudinal end of the shutter to the cartridge frame for shifting movement between an operation position where the photosensitive member is covered by the shutter and a retract position retracted from the operation position, a support member engagement portion provided on the support member to attach the support member to the cartridge frame, and a frame engagement portion provided on the cartridge frame to attach the support member engagement portion to the cartridge frame.

37 Claims, 30 Drawing Sheets

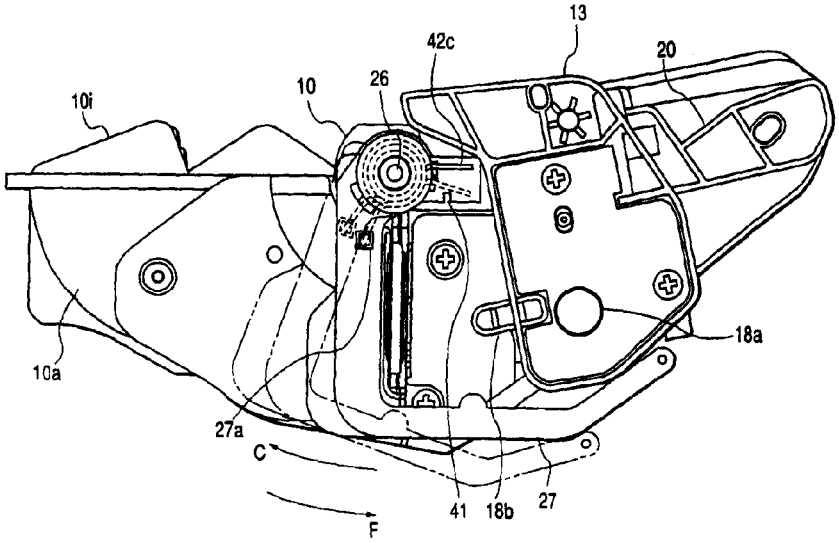

PROCESS CARTRIDGE AND ELECTROPHOTOGRAPHIC IMAGE FORMING APPARATUS

This is a request for a continuation (continued prosecution application (CPA)) of prior application Ser. No. 09/193,863 filed on Nov. 18, 1998 entitled PROCESS CARTRIDGE AND ELECTROPHOTOGRAPHIC IMAGE FORMING APPARATUS.

BACKGROUND OF THE INVENTION

1. Field of the Invention

The present invention relates to a process cartridge and an electrophotographic image forming apparatus to which such a process cartridge can detachably be mounted.

The electrophotographic image forming apparatus serves to form an image on a recording medium by using an electrophotographic image forming process, and may be, for example, an electrophotographic copying machine, an electrophotographic printer (for example, LED printer, laser beam printer or the like), an electrophotographic facsimile apparatus or an electrophotographic word processor.

The process cartridge may incorporate an electrophotographic photosensitive member, and a charge means, a developing means or a cleaning means as a cartridge unit, may incorporate an electrophotographic photosensitive member, and at least one of a charge means, a developing means and a cleaning means as a cartridge unit, or may incorporate an electrophotographic photosensitive member and at least a developing means as a cartridge unit, which can detachably be mounted to an electrophotographic image forming apparatus, respectively.

2. Related Background Art

In the above-mentioned process cartridge, when the process cartridge is mounted to the image forming apparatus, a transfer opening through which the electrophotographic photosensitive member is exposed outside is opened, and, when the process cartridge is dismounted from the image forming apparatus, the electrophotographic photosensitive member is covered by a drum shutter to protect the former.

A shutter arm is one of links for opening and closing the drum shutter for light-shielding the photosensitive drum (when the process cartridge is dismounted from the image forming apparatus) and is biased by an elastic body such as a torsion coil spring toward a direction along which the drum shutter is closed. A snap-fit is used to assemble the shutter arm to a frame of the process cartridge.

SUMMARY OF THE INVENTION

The present invention relates to an improvement in conventional techniques.

An object of the present invention is to provide a process cartridge and an electrophotographic image forming apparatus, in which a support member for supporting a shutter is hard to be disengage from a cartridge frame.

Another object of the present invention is to provide a process cartridge and an electrophotographic image forming apparatus, in which, when a shutter is positioned at a retract position (opened position), a support member for supporting a shutter is hard to disengage from a cartridge frame.

A further object of the present invention is to provide a process cartridge and an electrophotographic image forming apparatus, in which a support member for supporting a shutter is attached to a cartridge frame by a snap-fit.

The other object of the present invention is to provide a process cartridge and an electrophotographic image forming apparatus, which include a frame engagement portion provided on a cartridge frame to attach a support member engagement portion to the cartridge frame, and in which the frame engagement portion is provided with an attachment portion for engaging the support member engagement portion with the frame engagement portion, and a shift path through which a shutter is shifted between an operation position where an electrophotographic photosensitive member is covered by the shutter and a retract position retracted from the operation position, and a space of the attachment portion is greater than a space of the shift path.

BRIEF DESCRIPTION OF THE DRAWINGS

Figure 39:
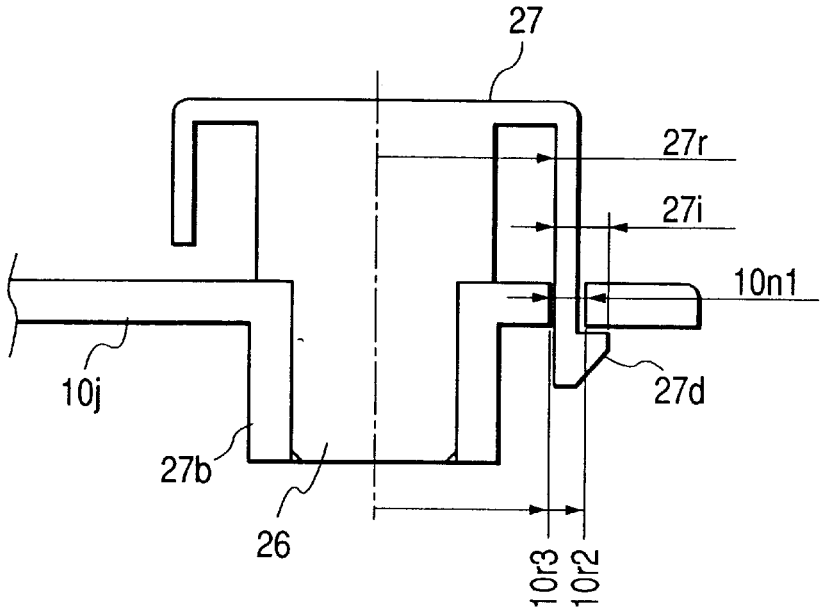
FIG. 39 is a view showing a seventh embodiment of the present invention, for explaining an alteration of the first, third and fifth embodiments.
Figure 40:
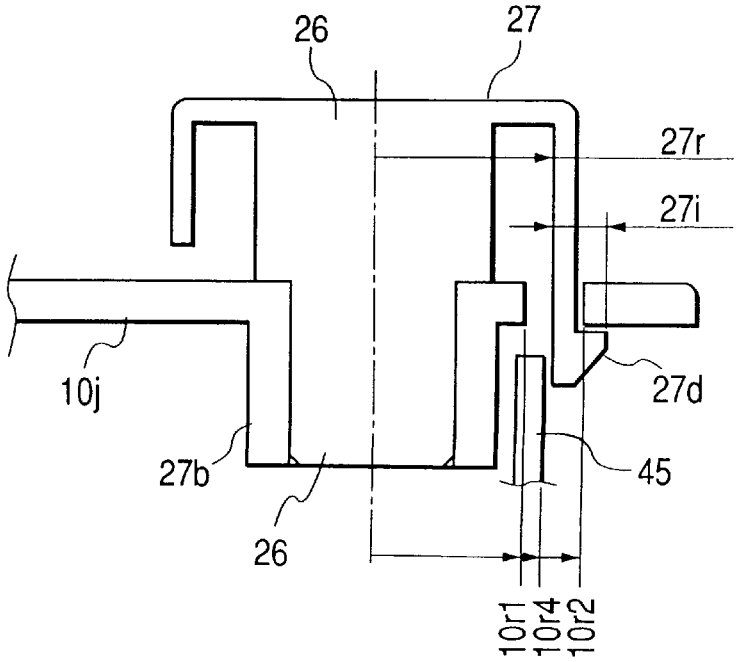
FIG. 40 is a view showing the seventh embodiment of the present invention, for explaining an alteration of the second, fourth and sixth embodiments.
Figure 1:
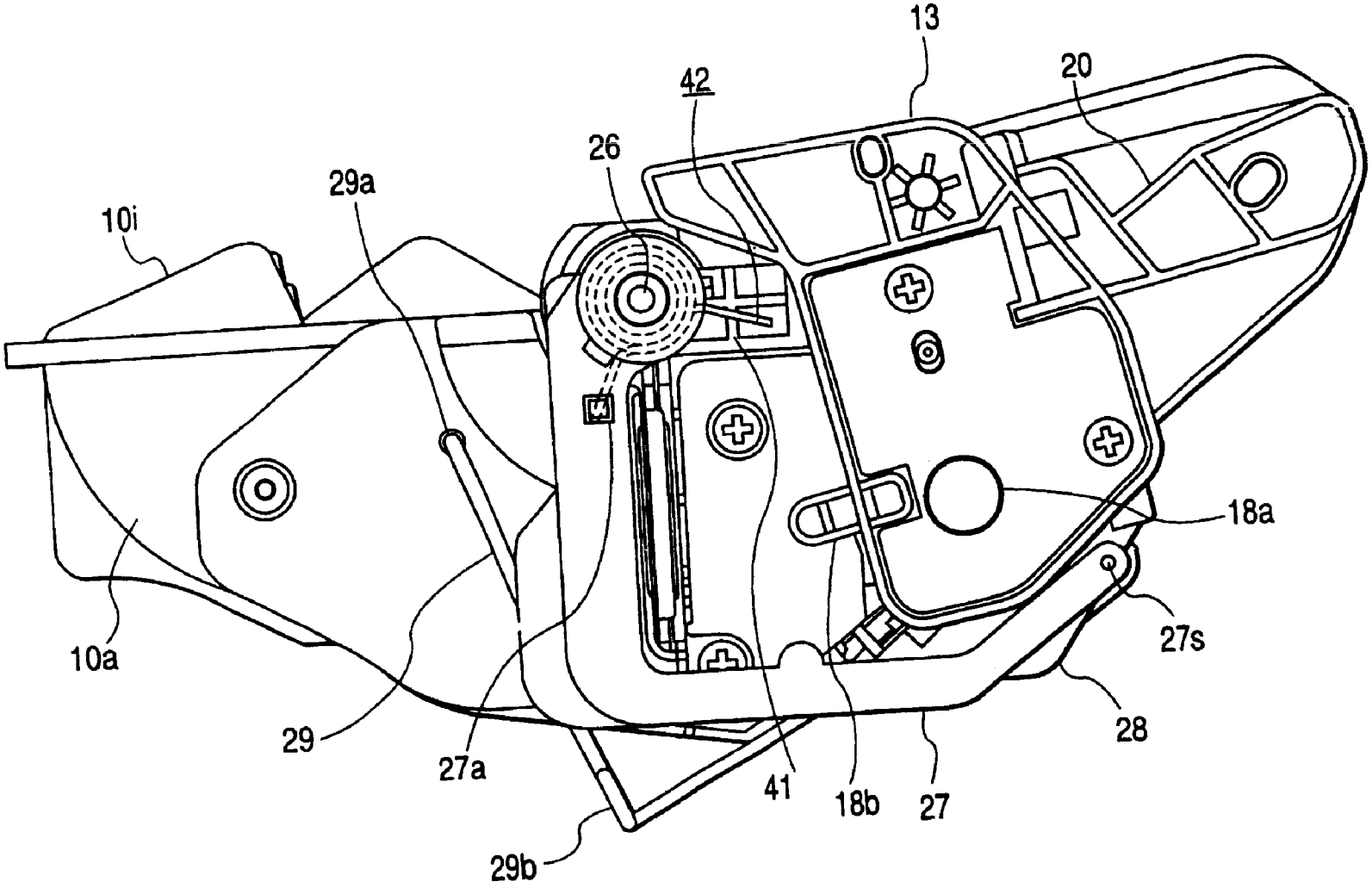
Figure 2:
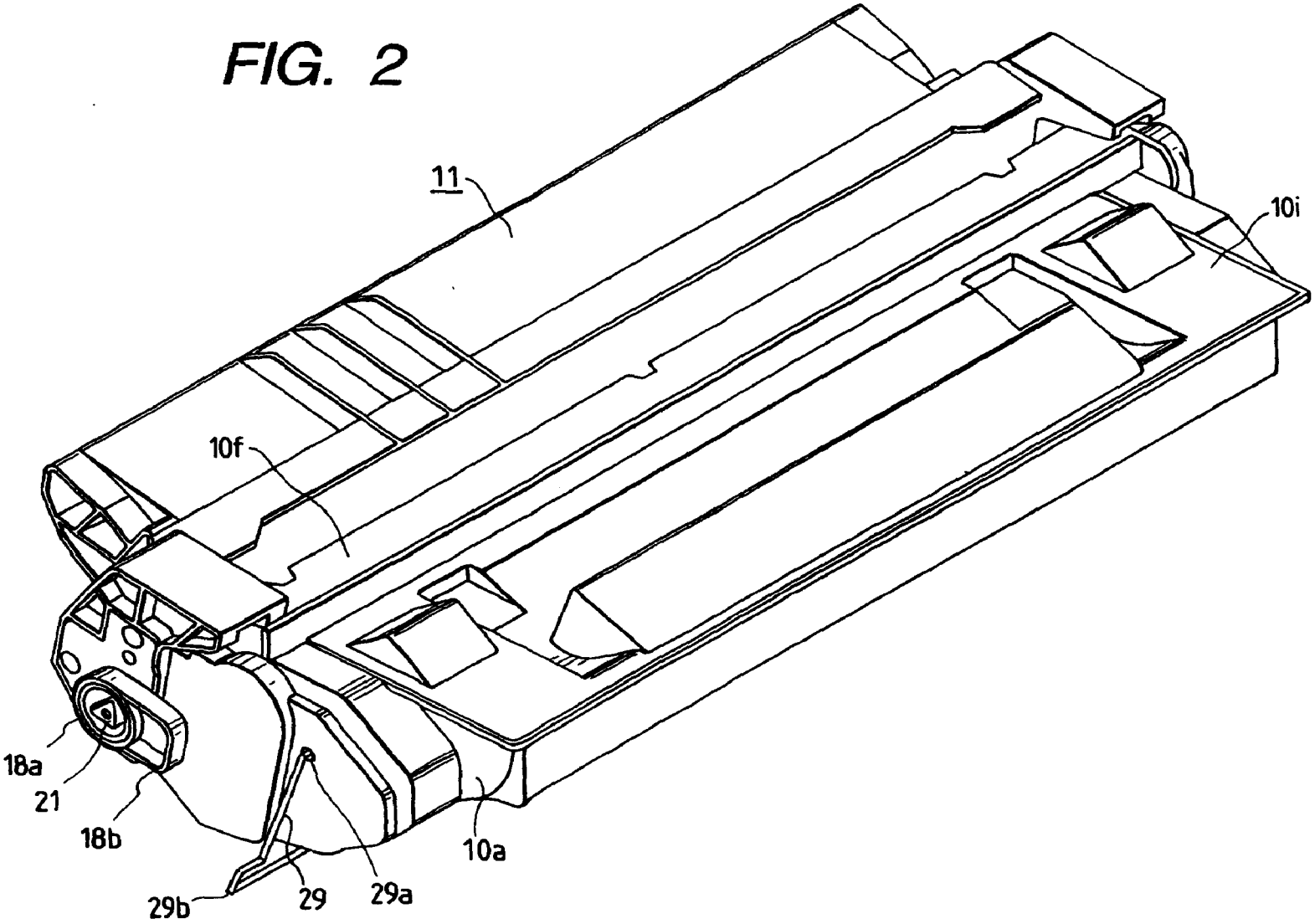
Figure 3:
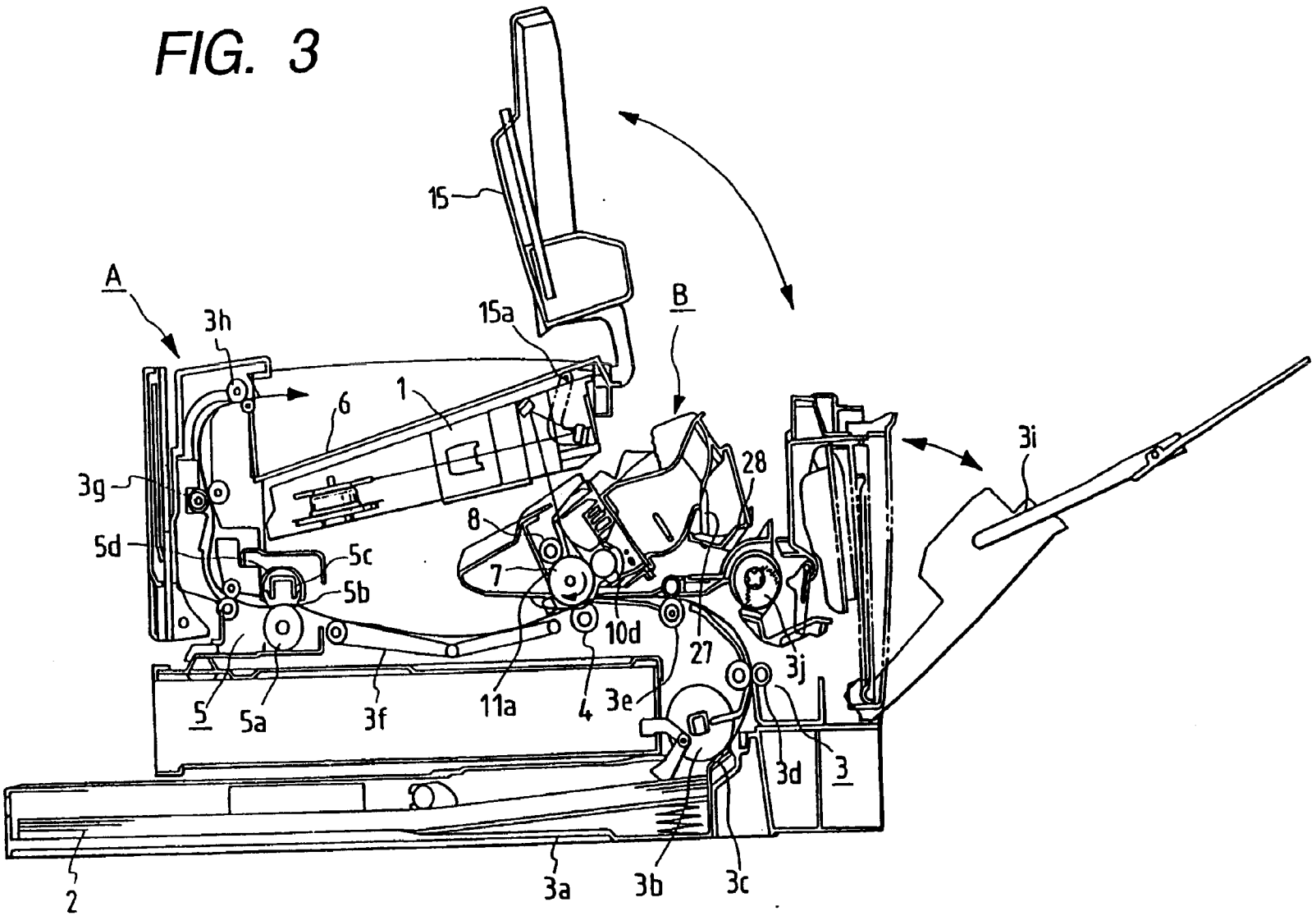
Figure 4:
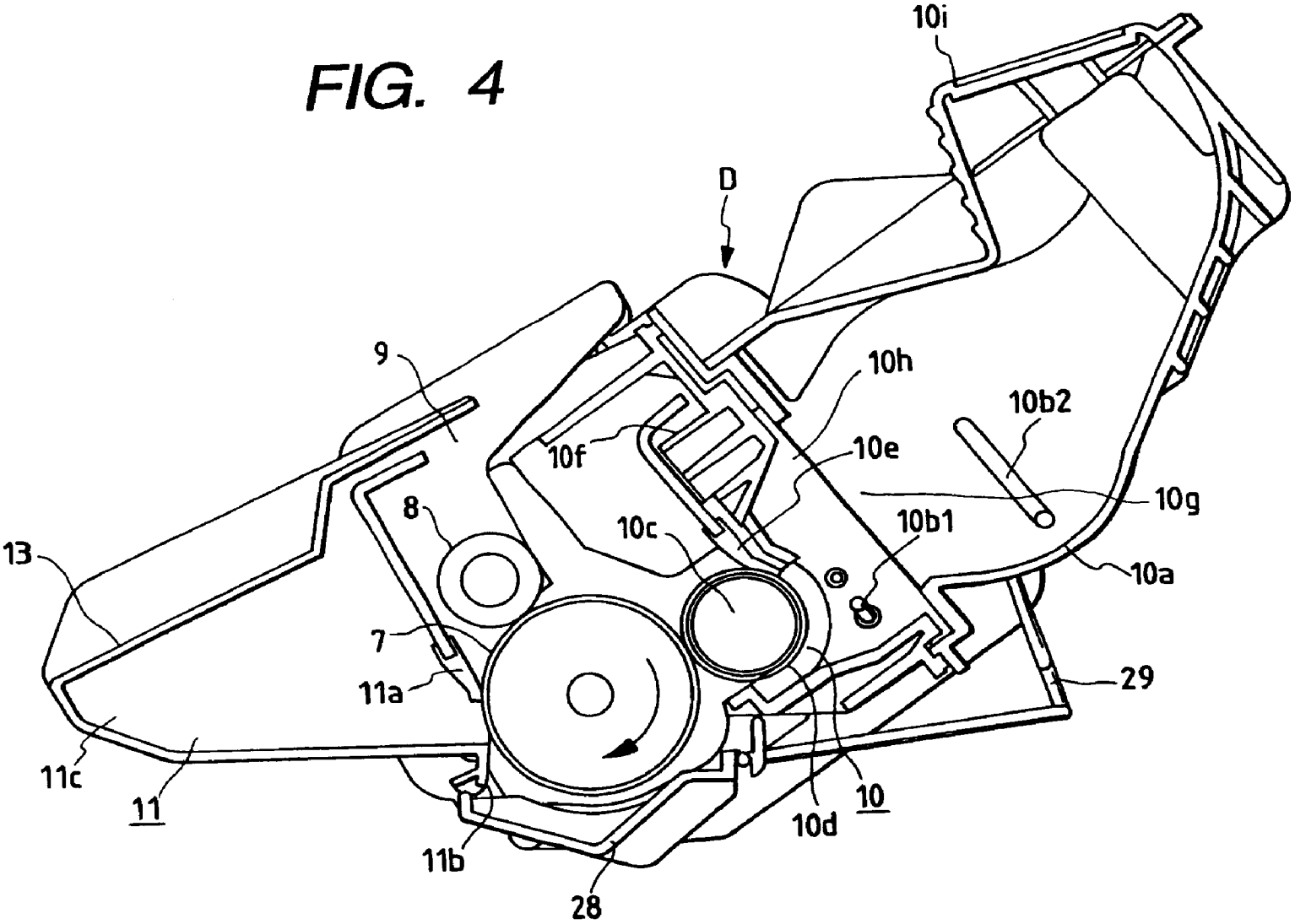
Figure 5:
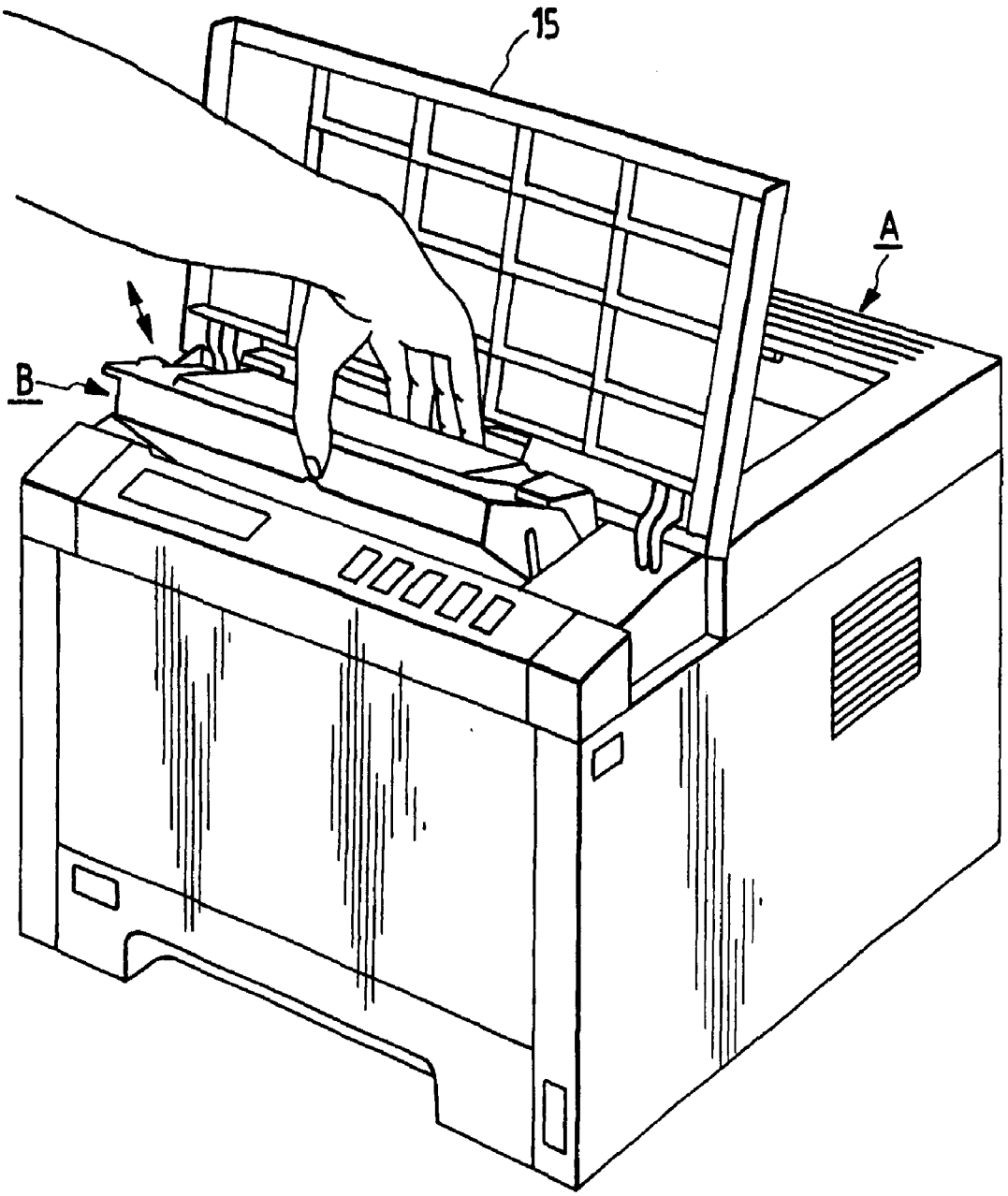
Figure 6:
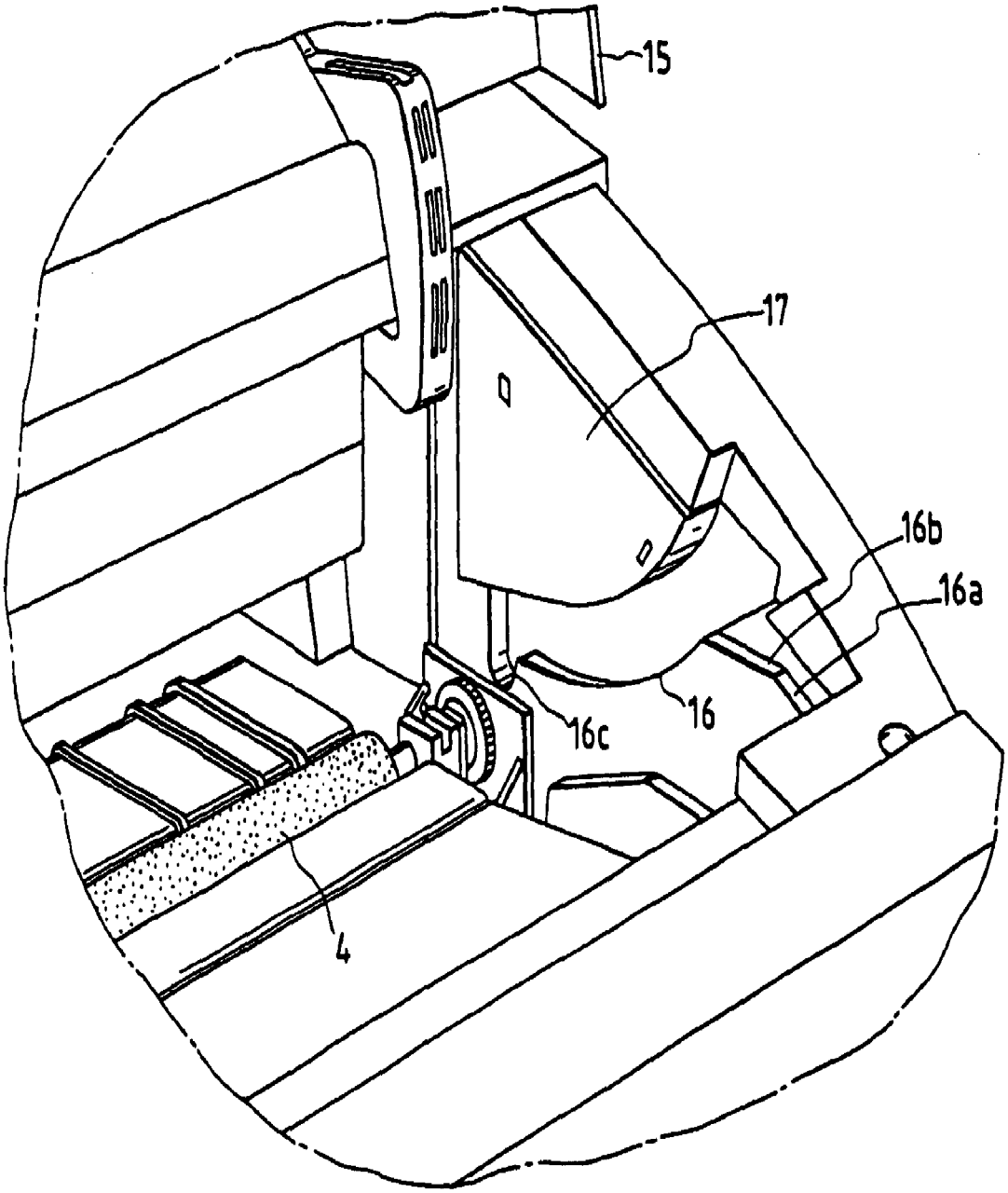
Figure 7:
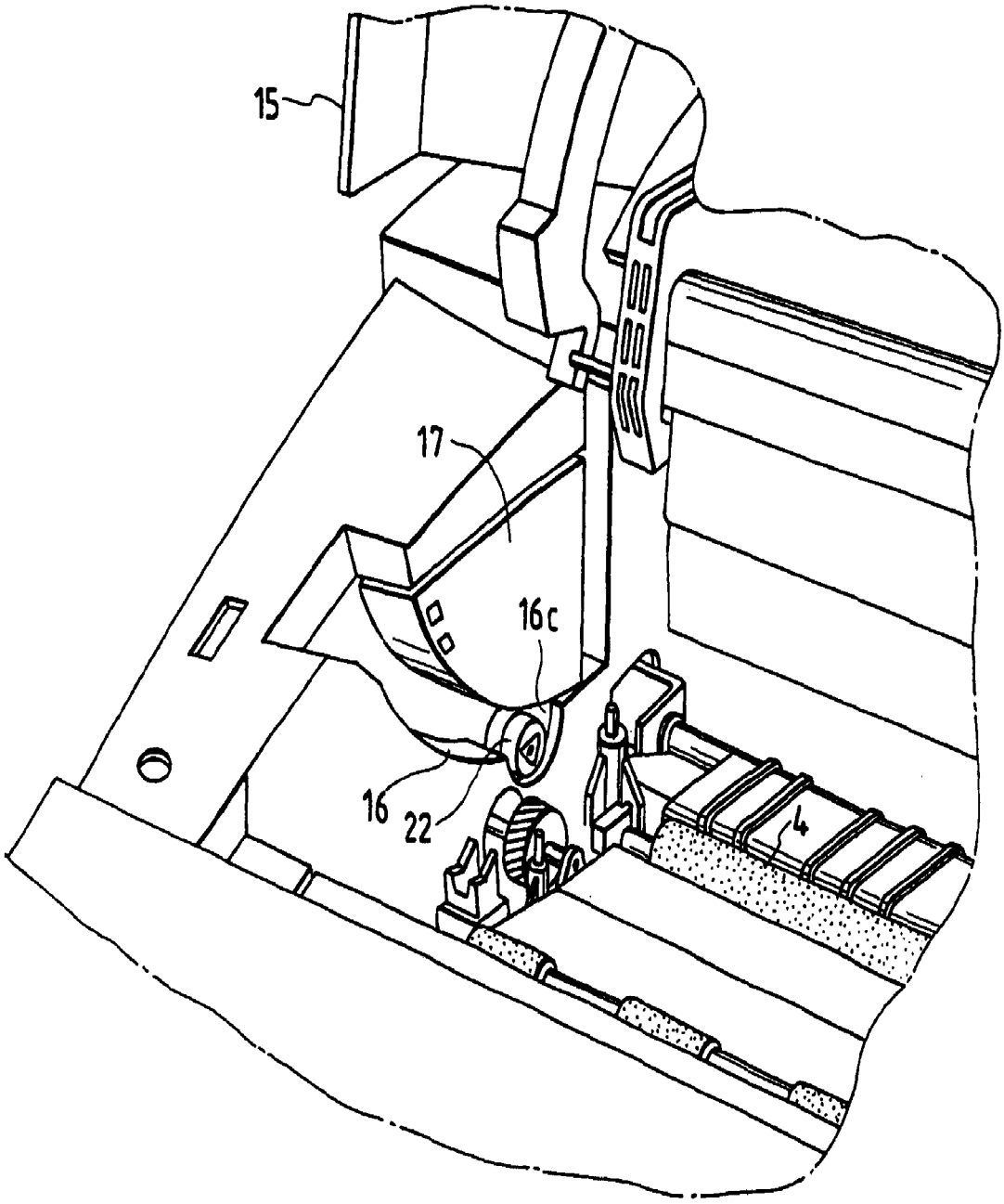
Figure 8:
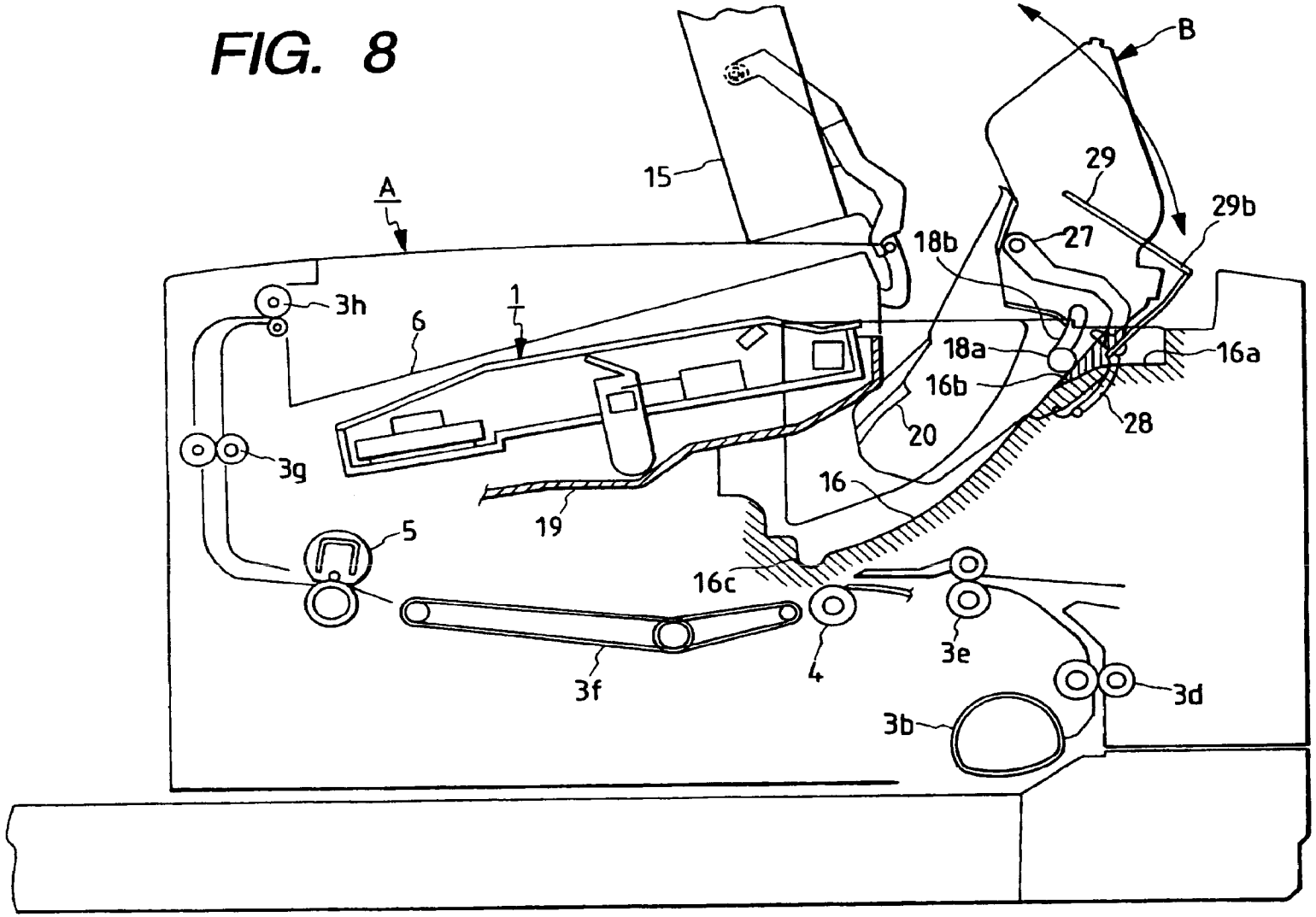
Figure 9:
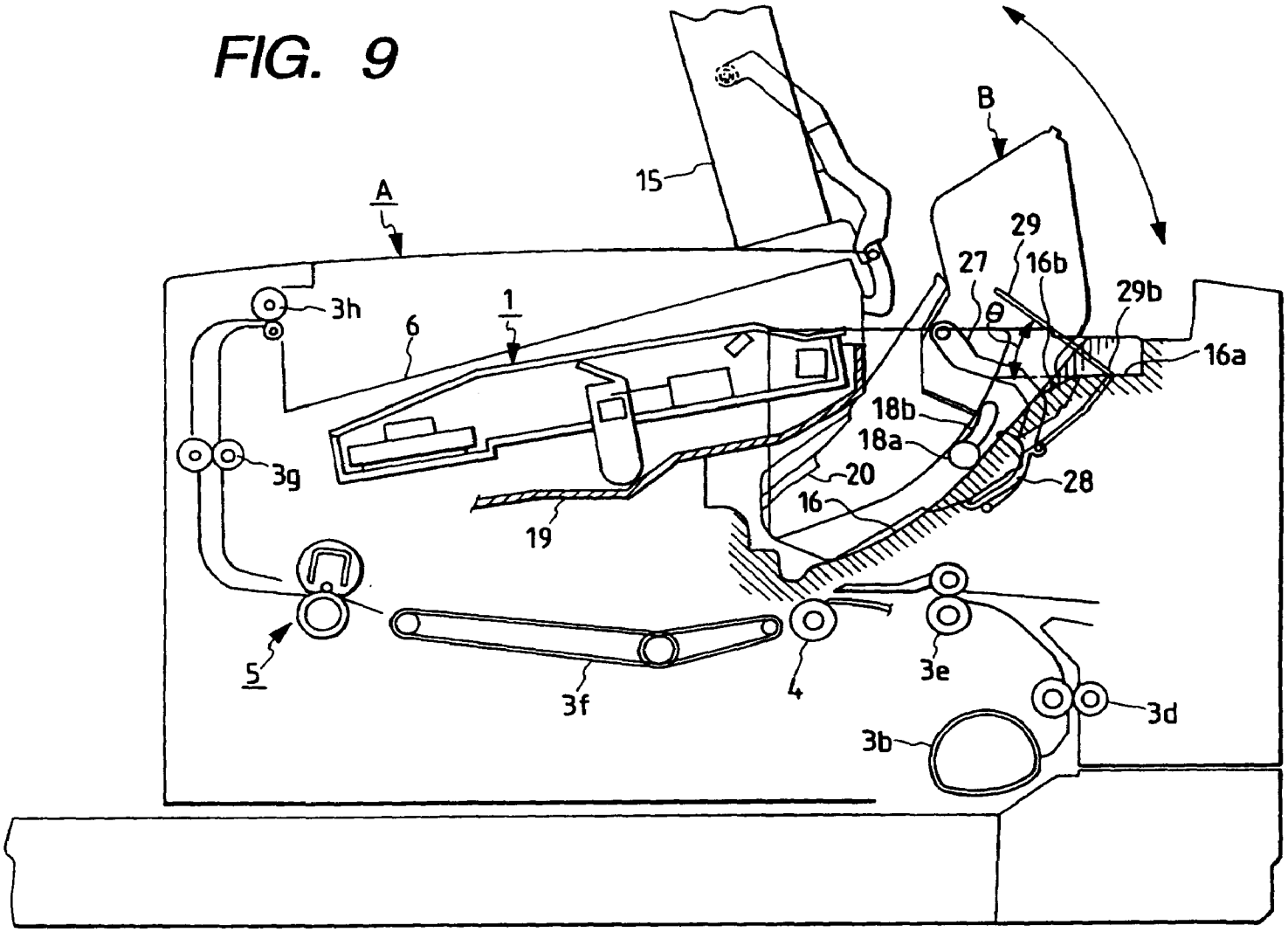
Figure 10:
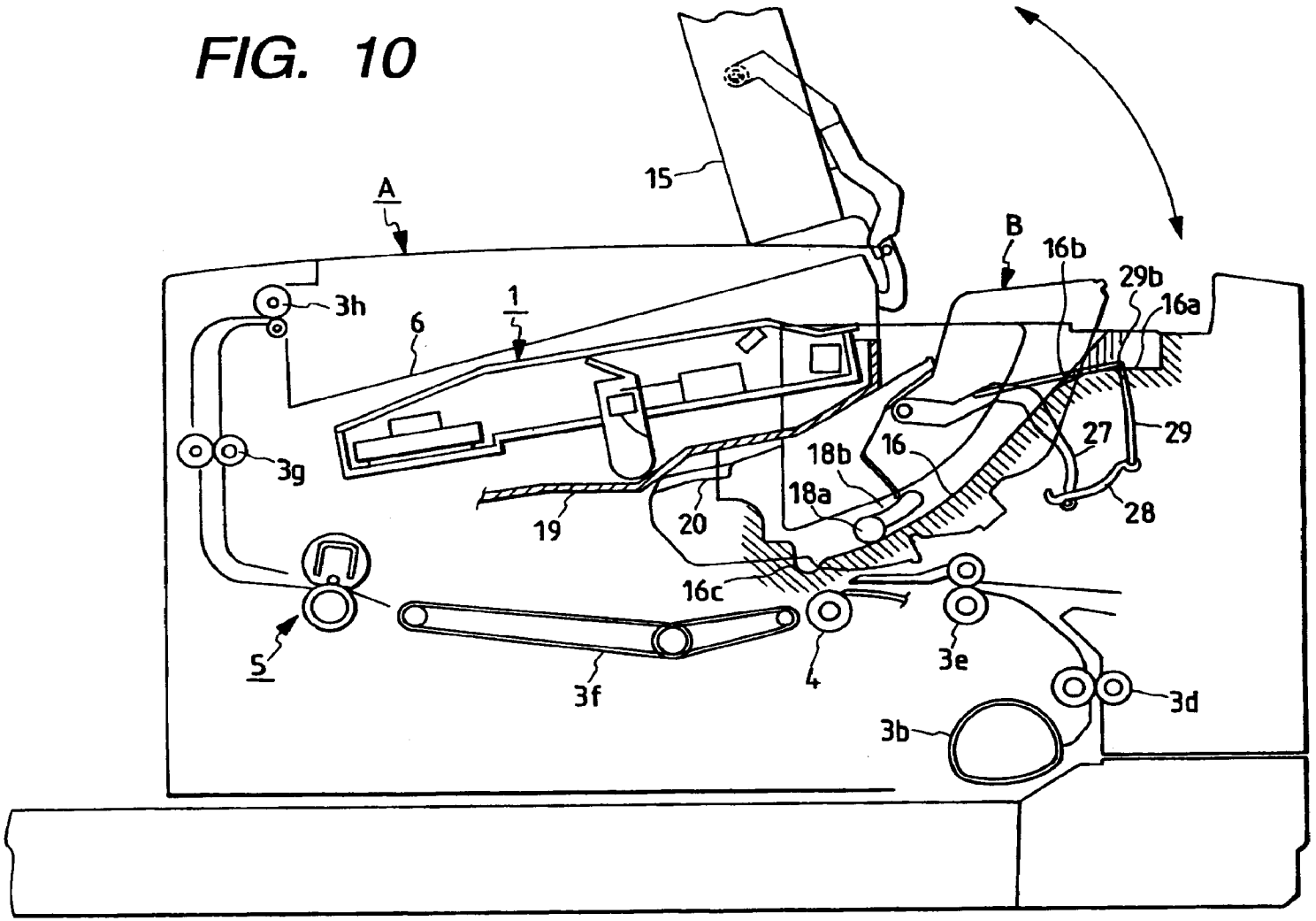
Figure 11:
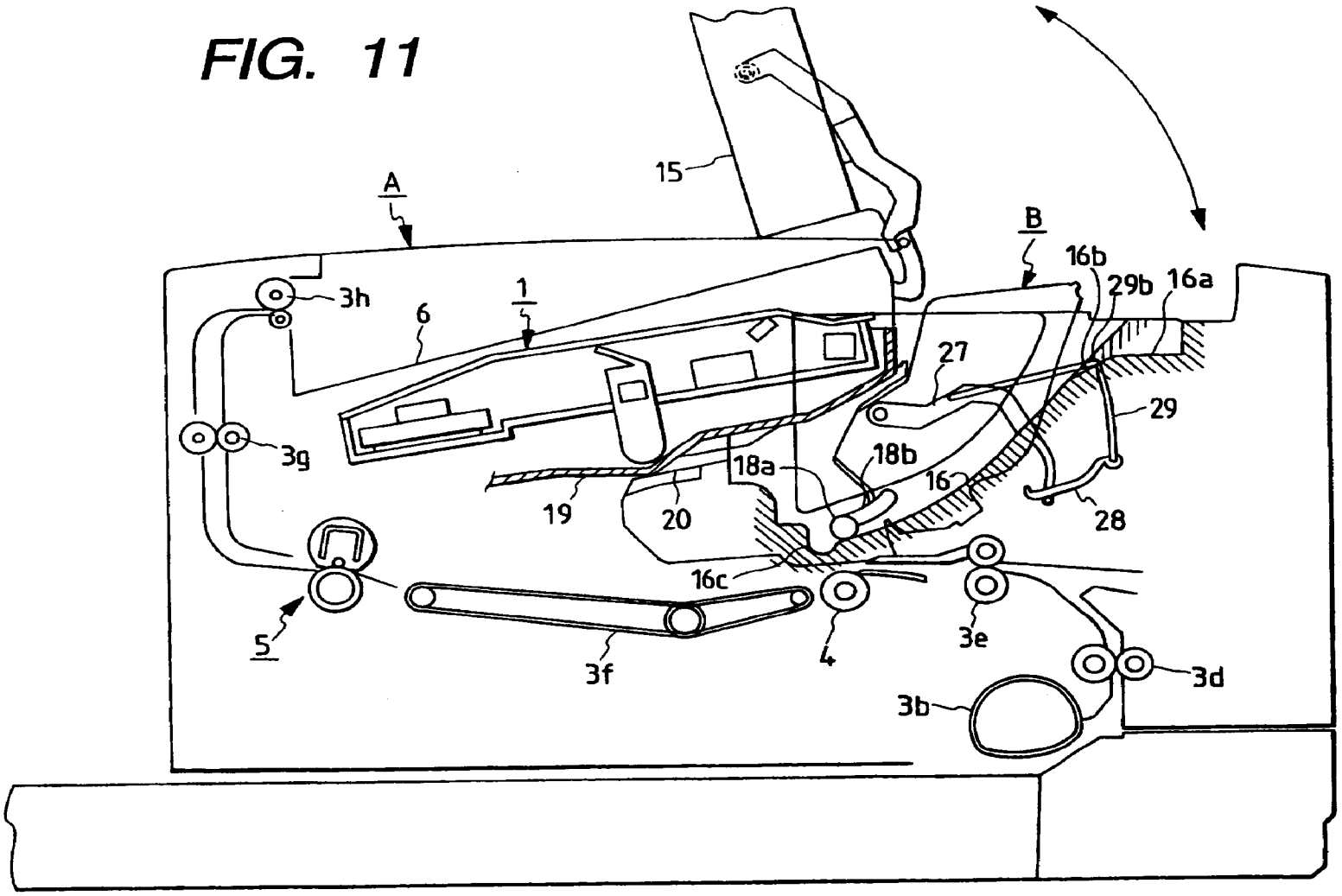
Figure 12:
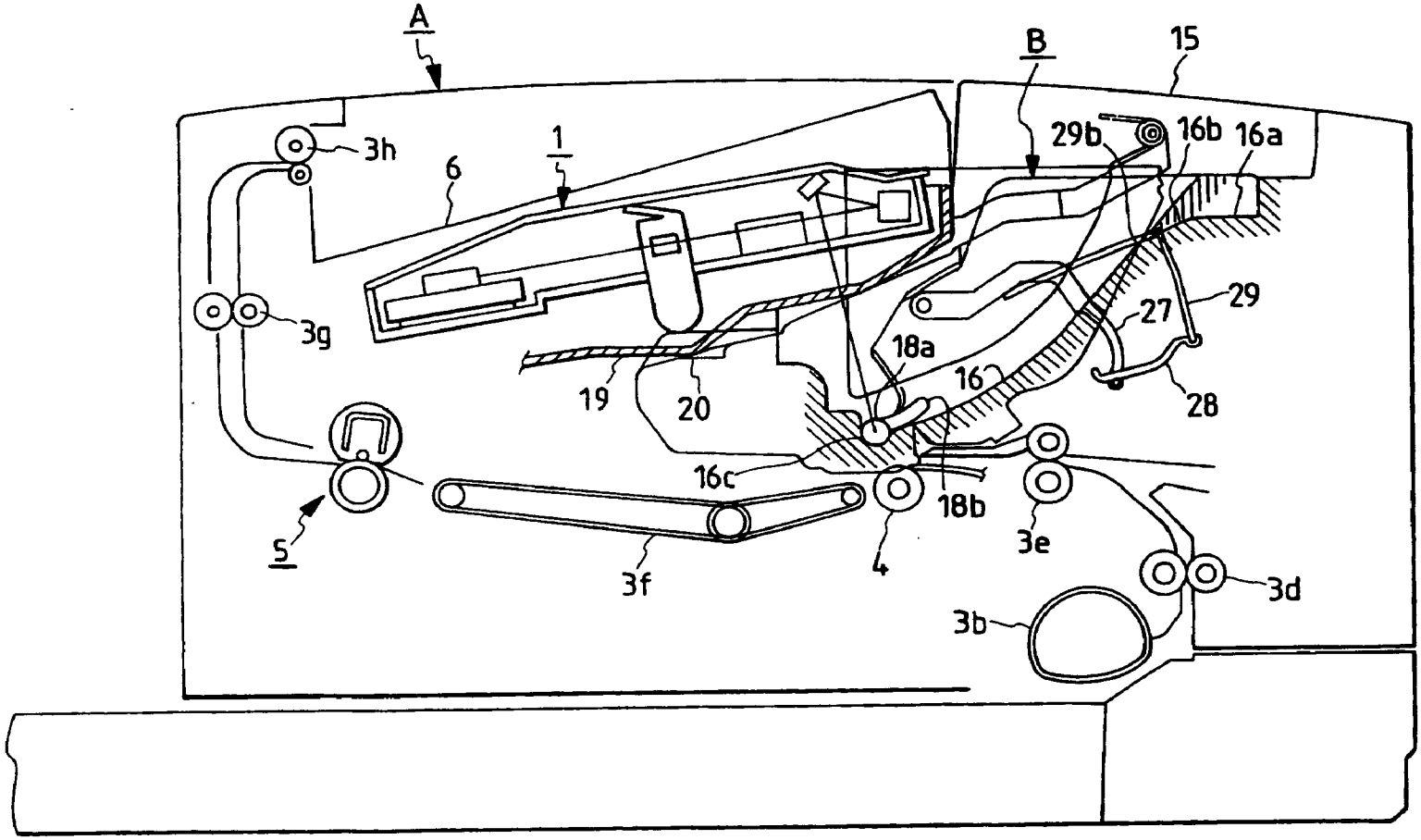
Figure 14:
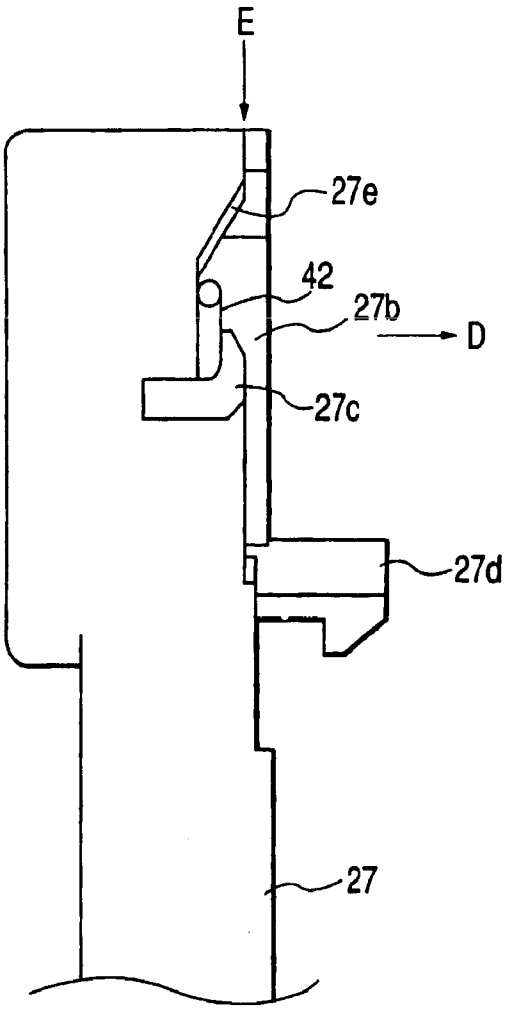
Figure 13:
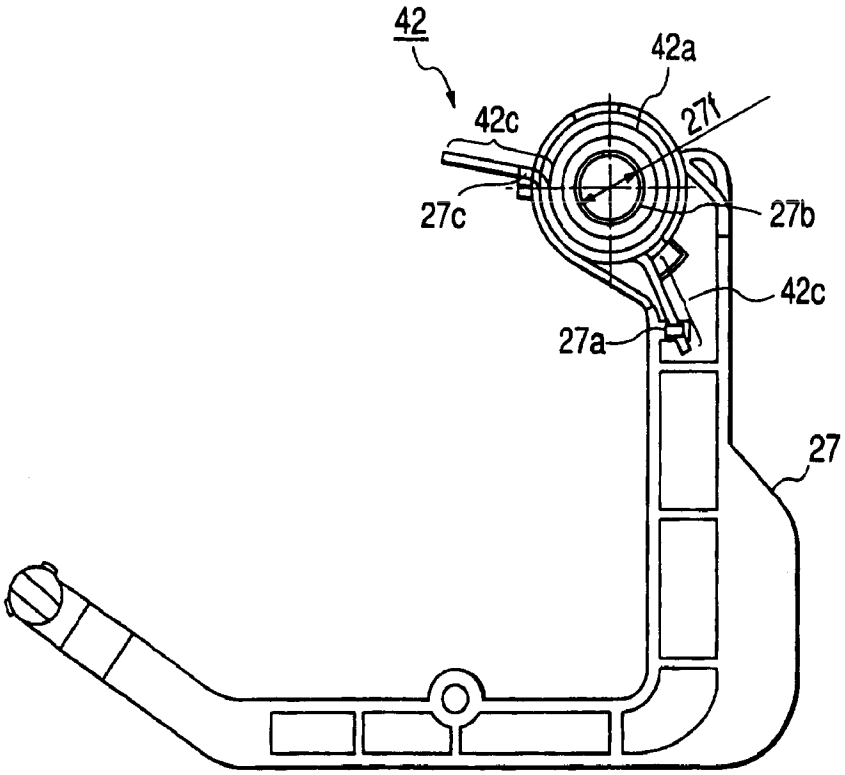
Figure 15:
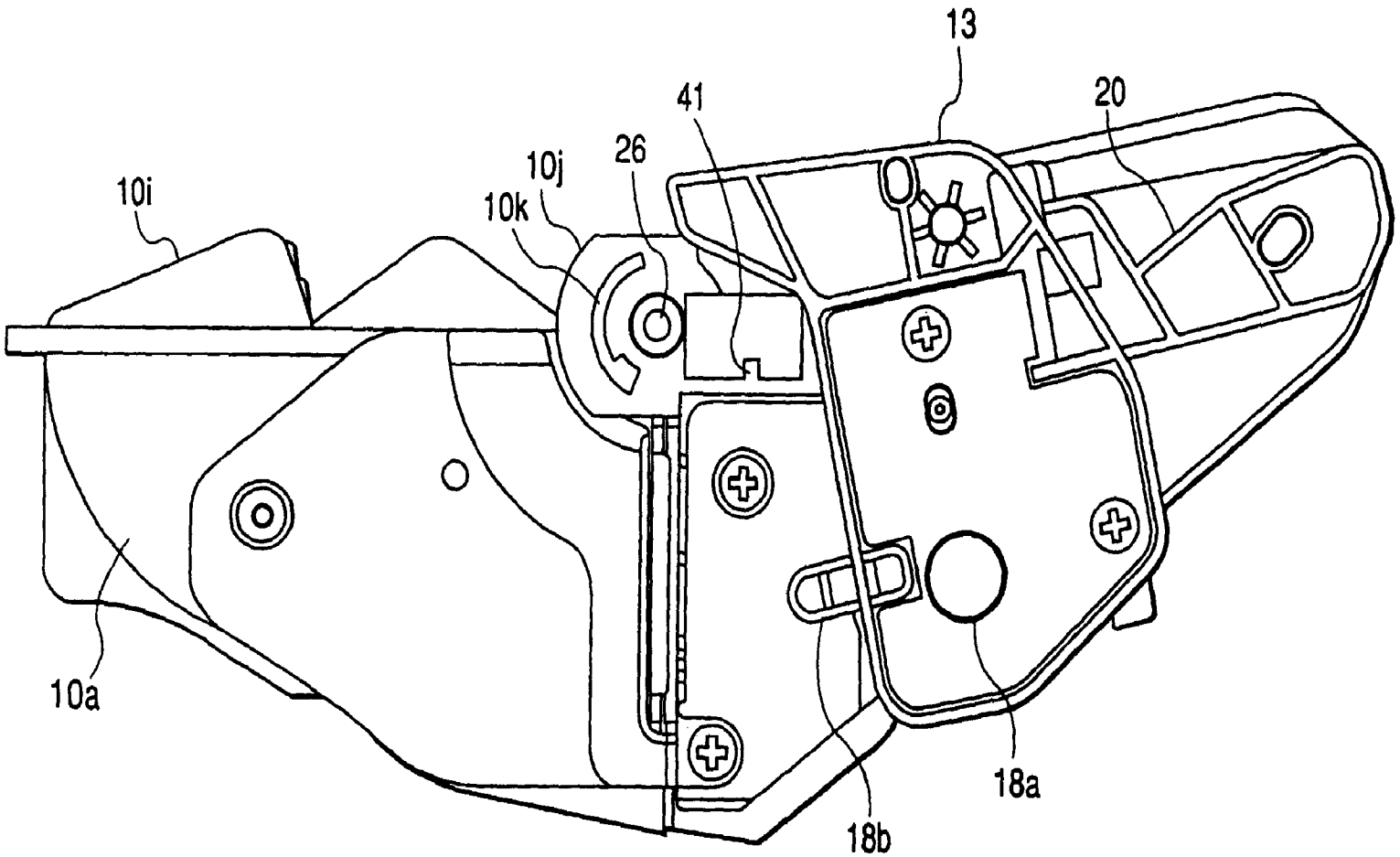
Figure 16:
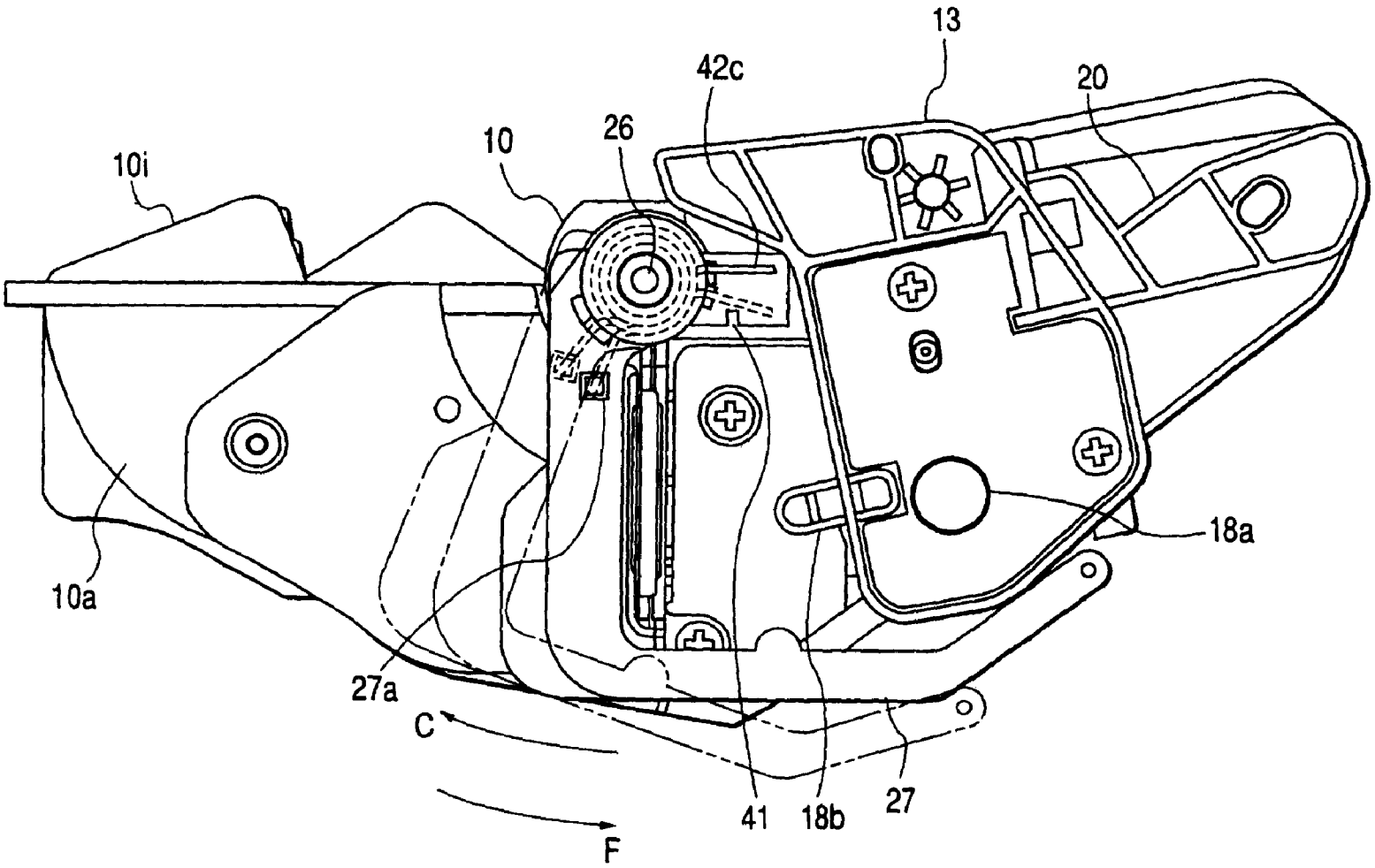
Figure 17:
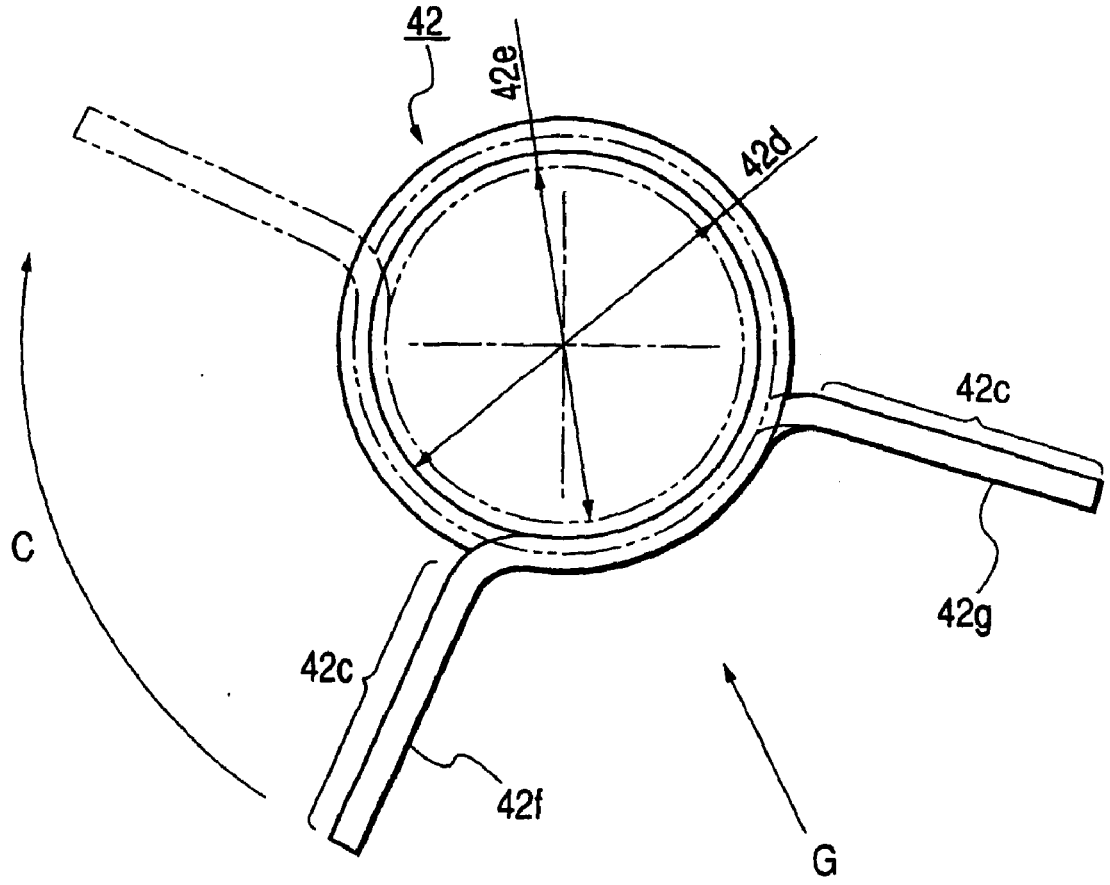
Figure 18:
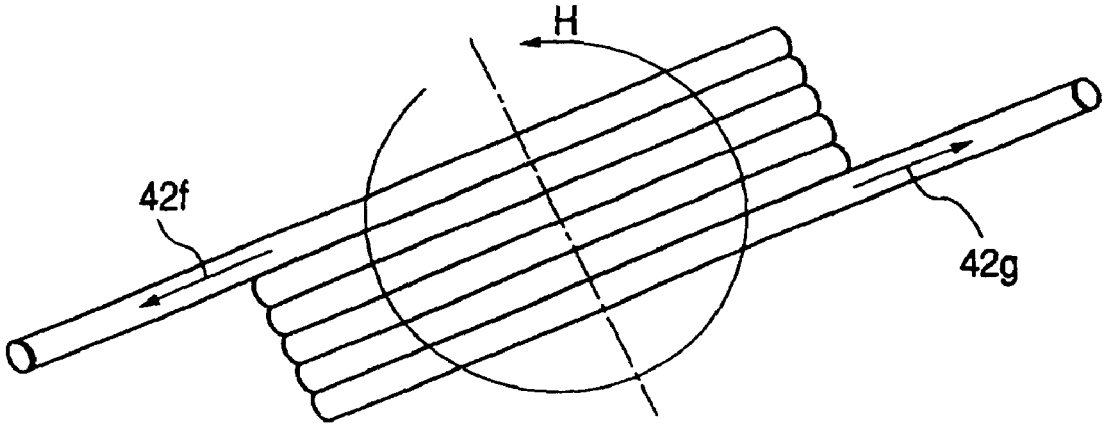
Figure 19:
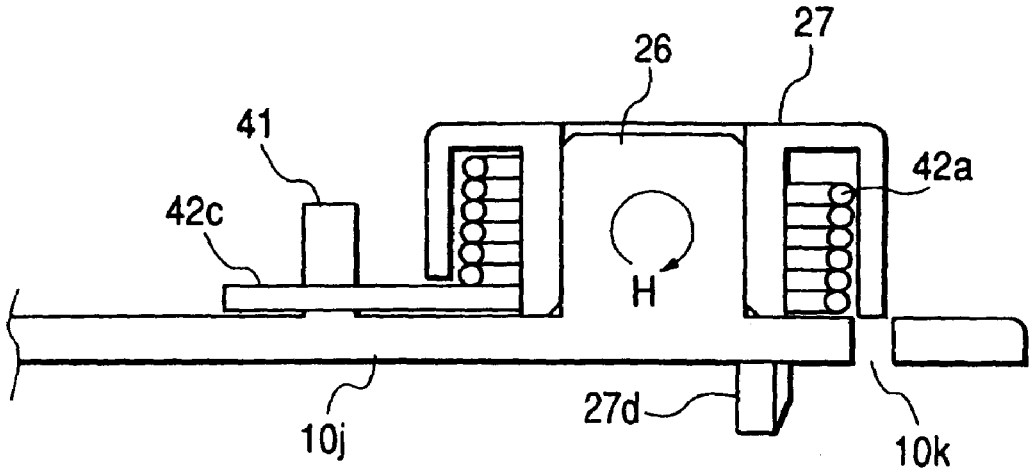
Figure 20:
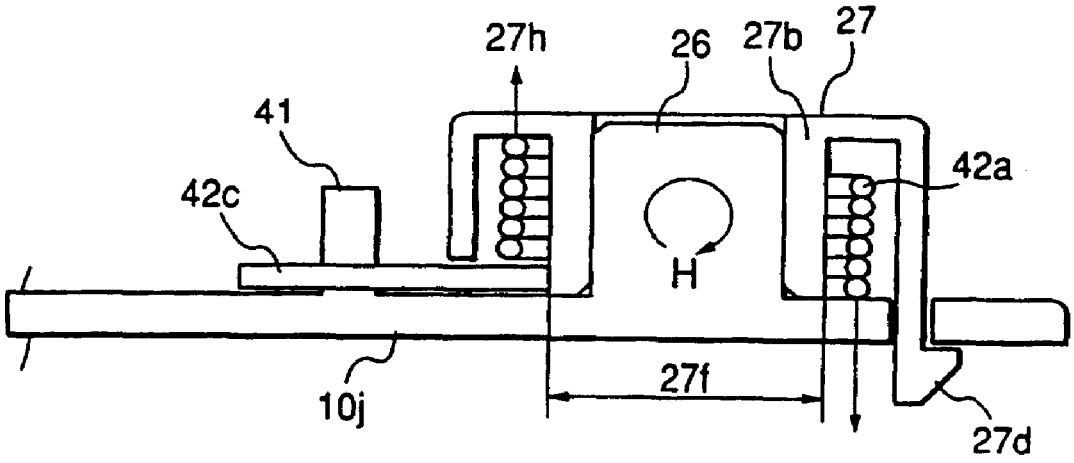
Figure 21:
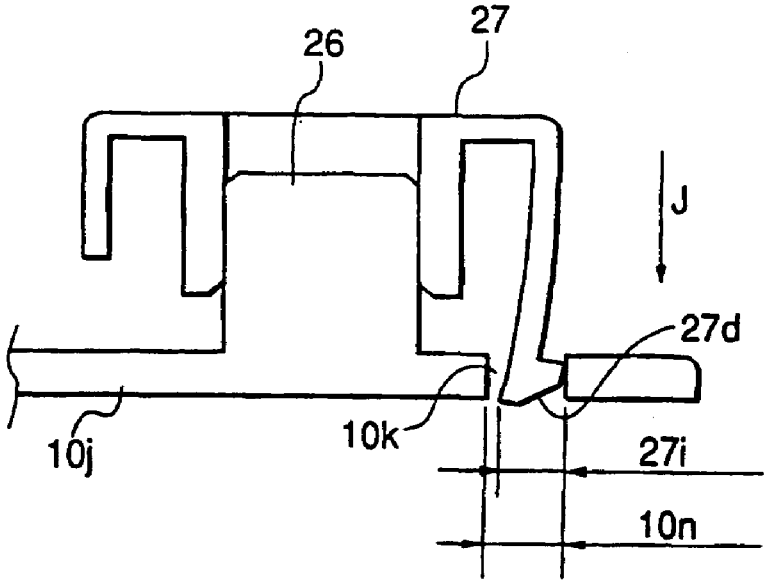
Figure 22:
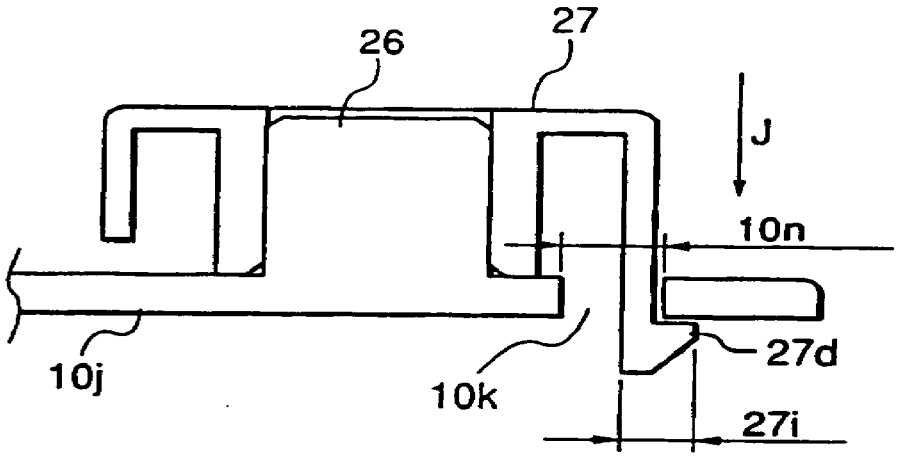
Figure 23:
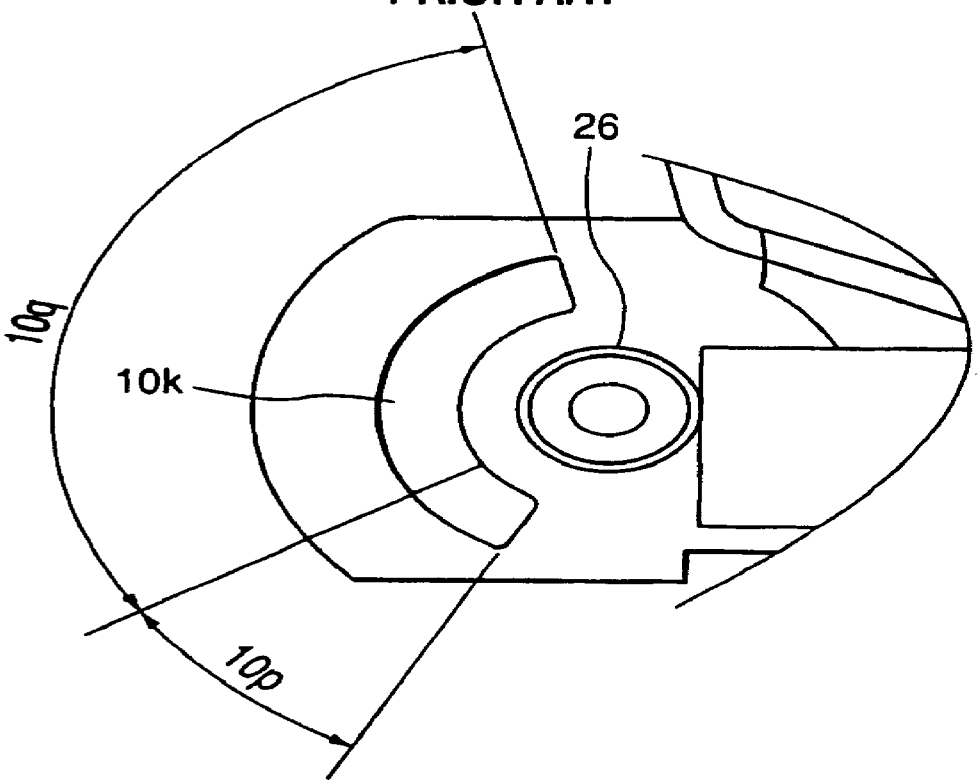
FIG. 23 PRIOR ART
Figure 24:
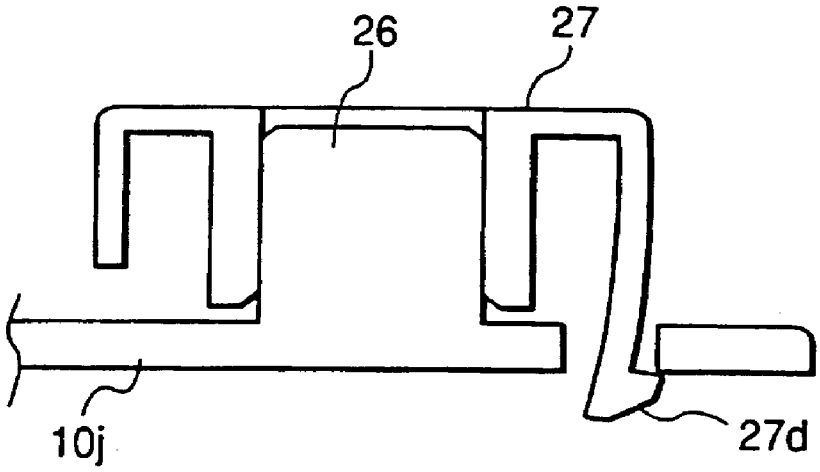
FIG. 24 PRIOR ART
Figure 25:
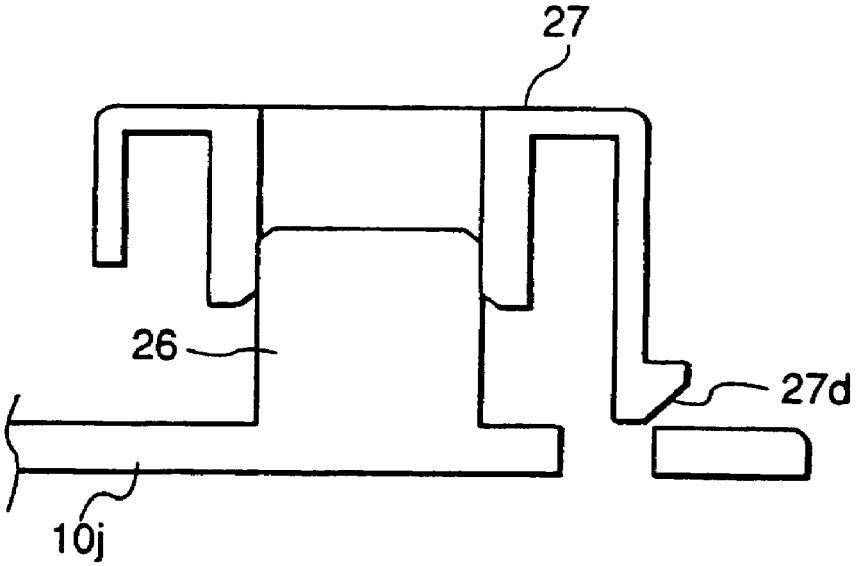
FIG. 25 PRIOR ART
Figure 26:
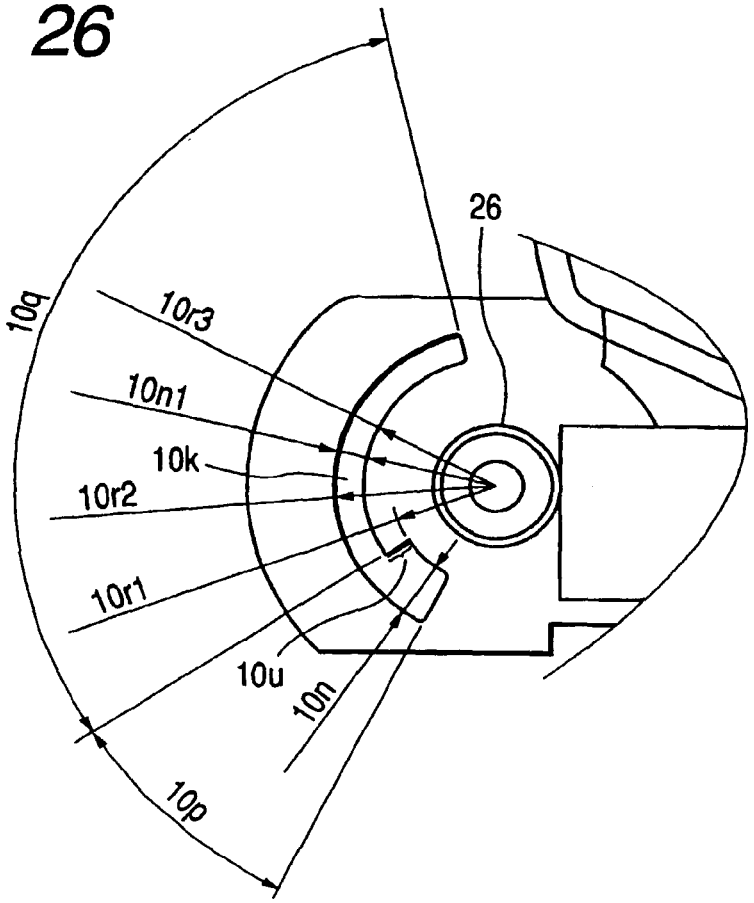
Figure 27:
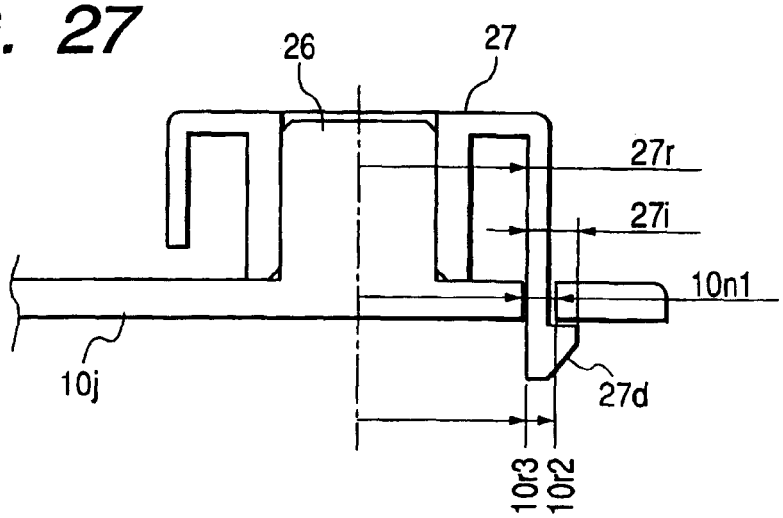
Figure 28:
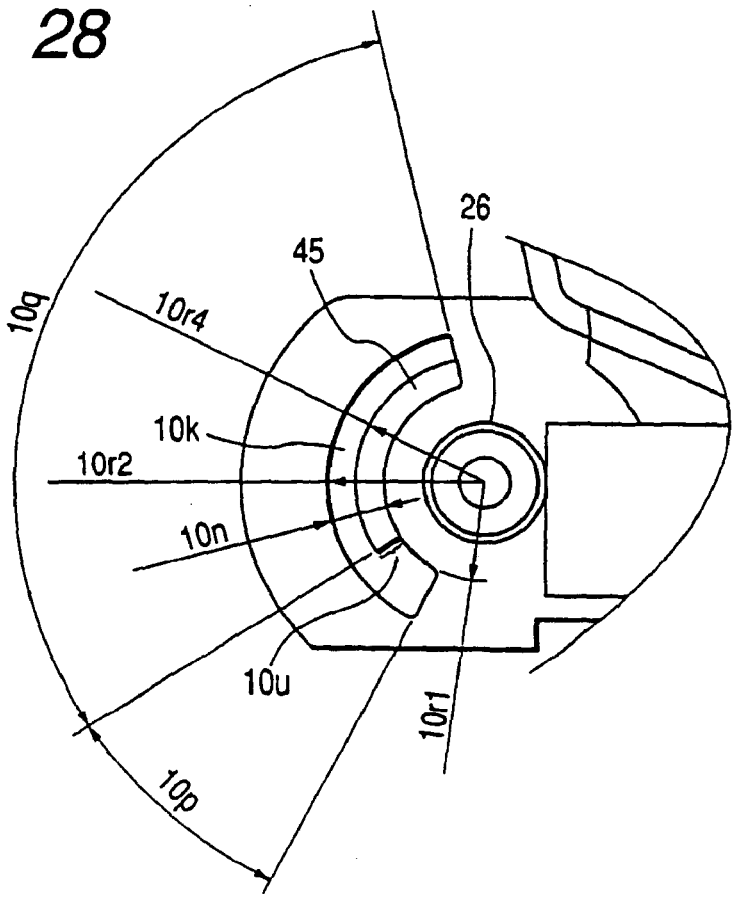
Figure 29:
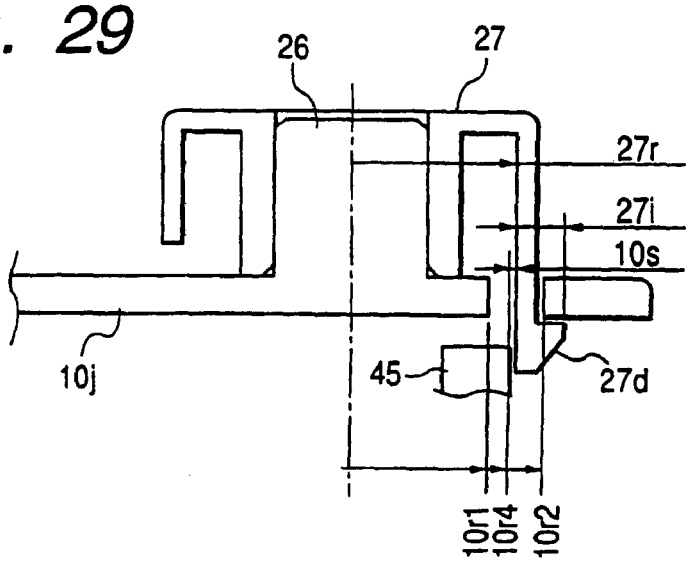
Figure 30:
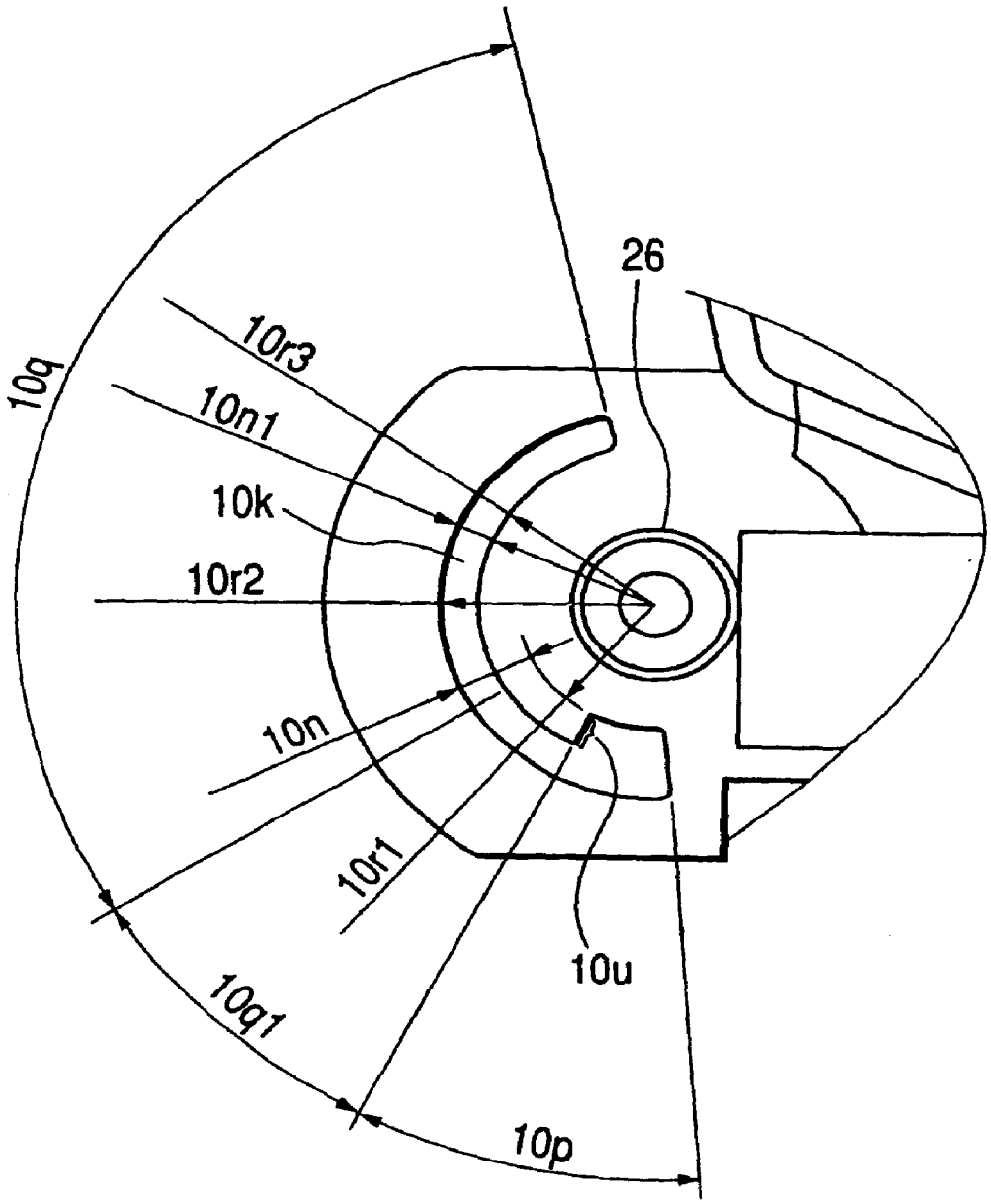
Figure 31:
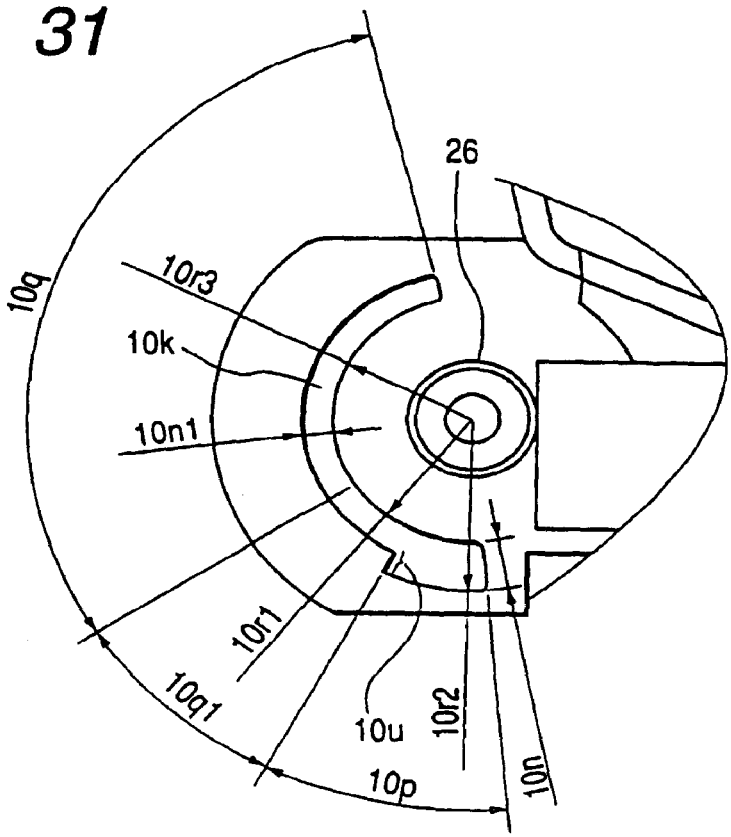
Figure 32:
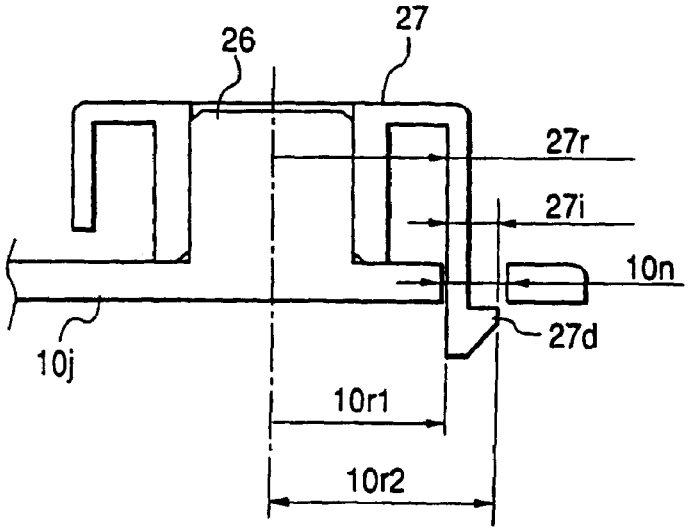
Figure 33:
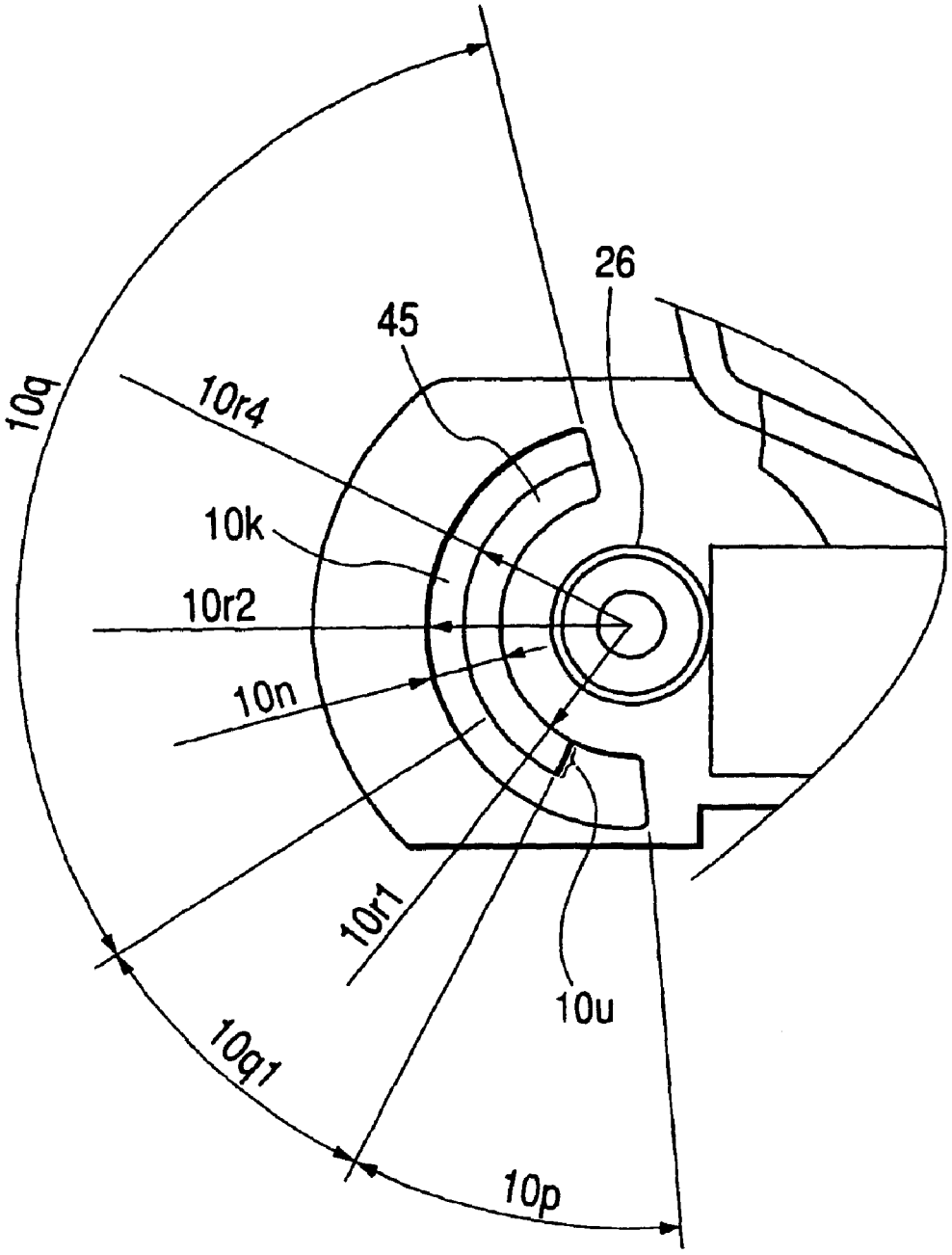
Figure 34:
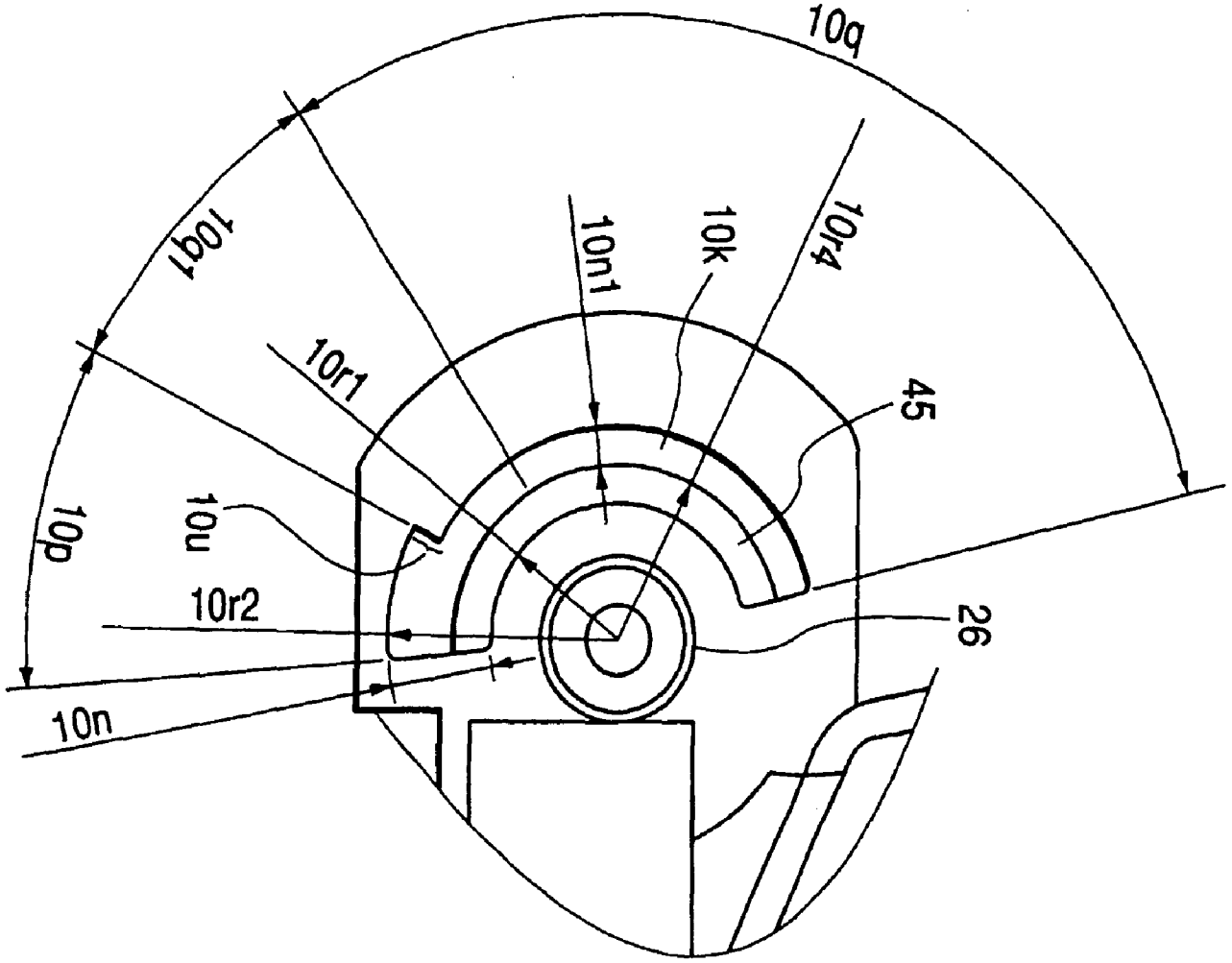
Figure 35:
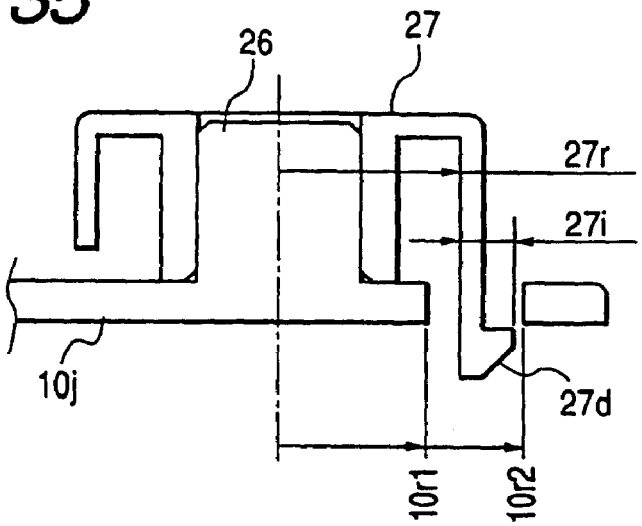
Figure 36:
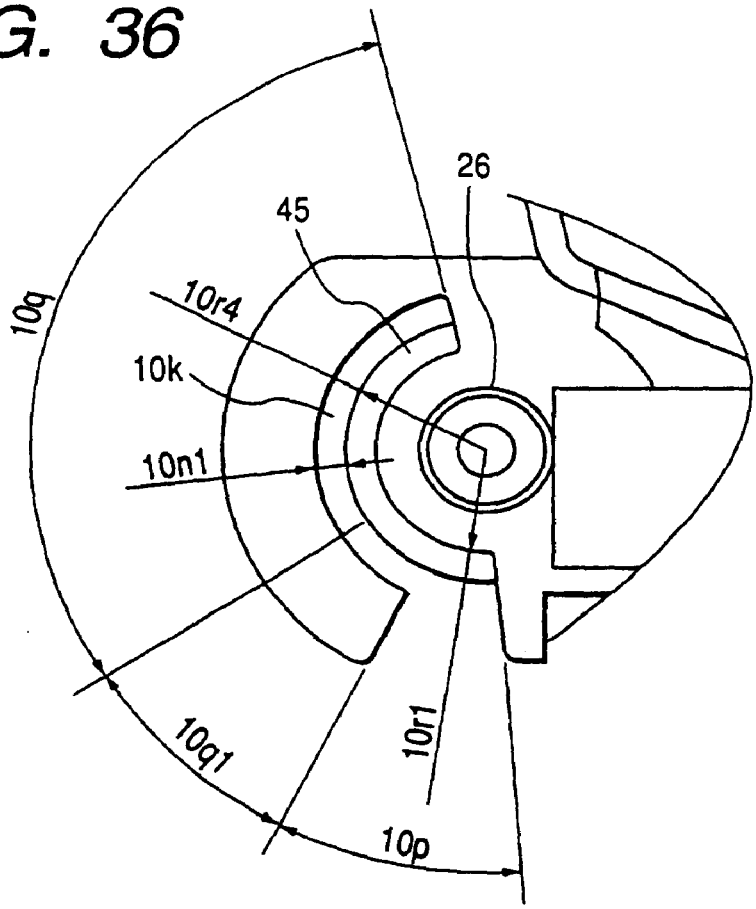
Figure 37:
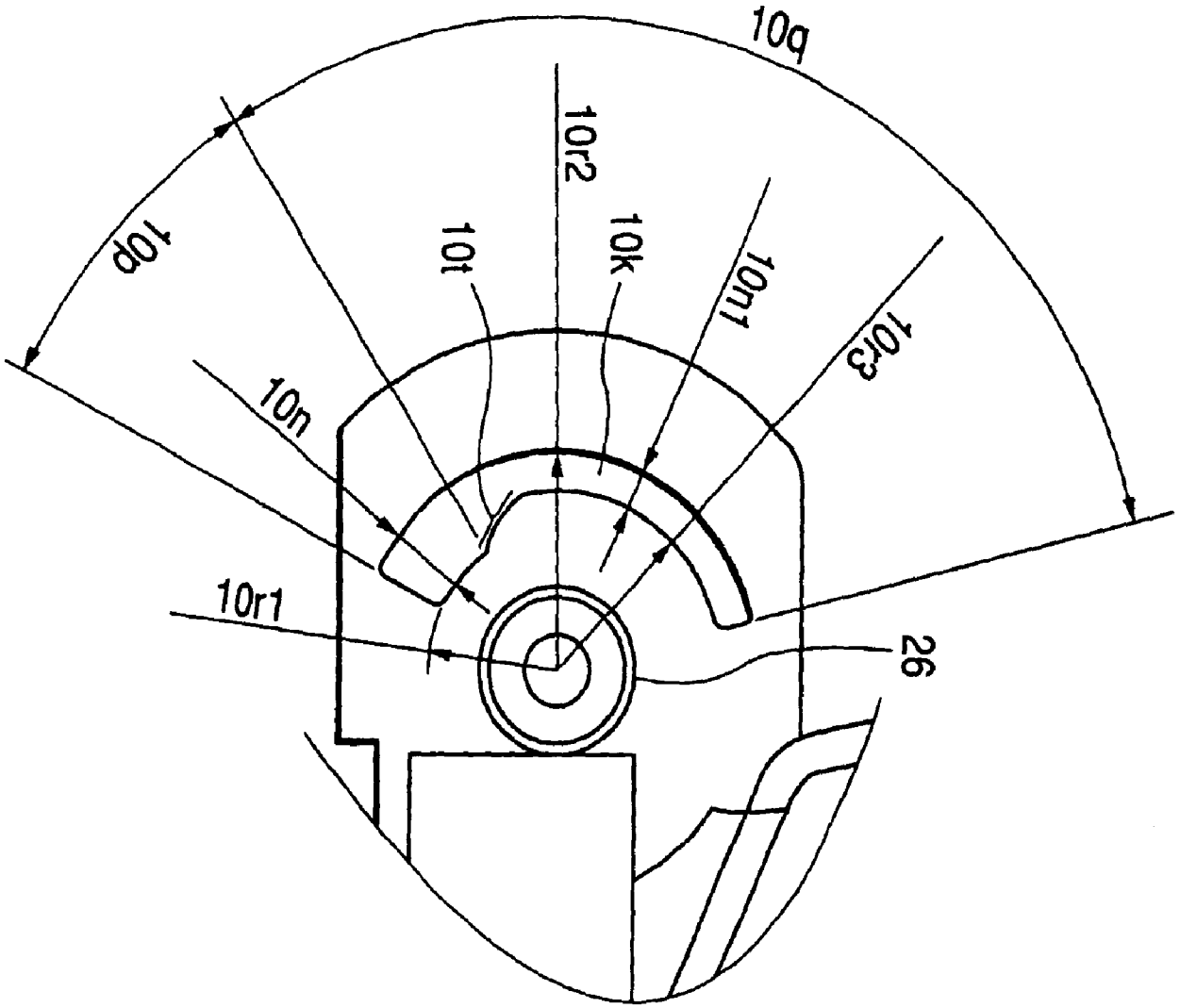
Figure 38:
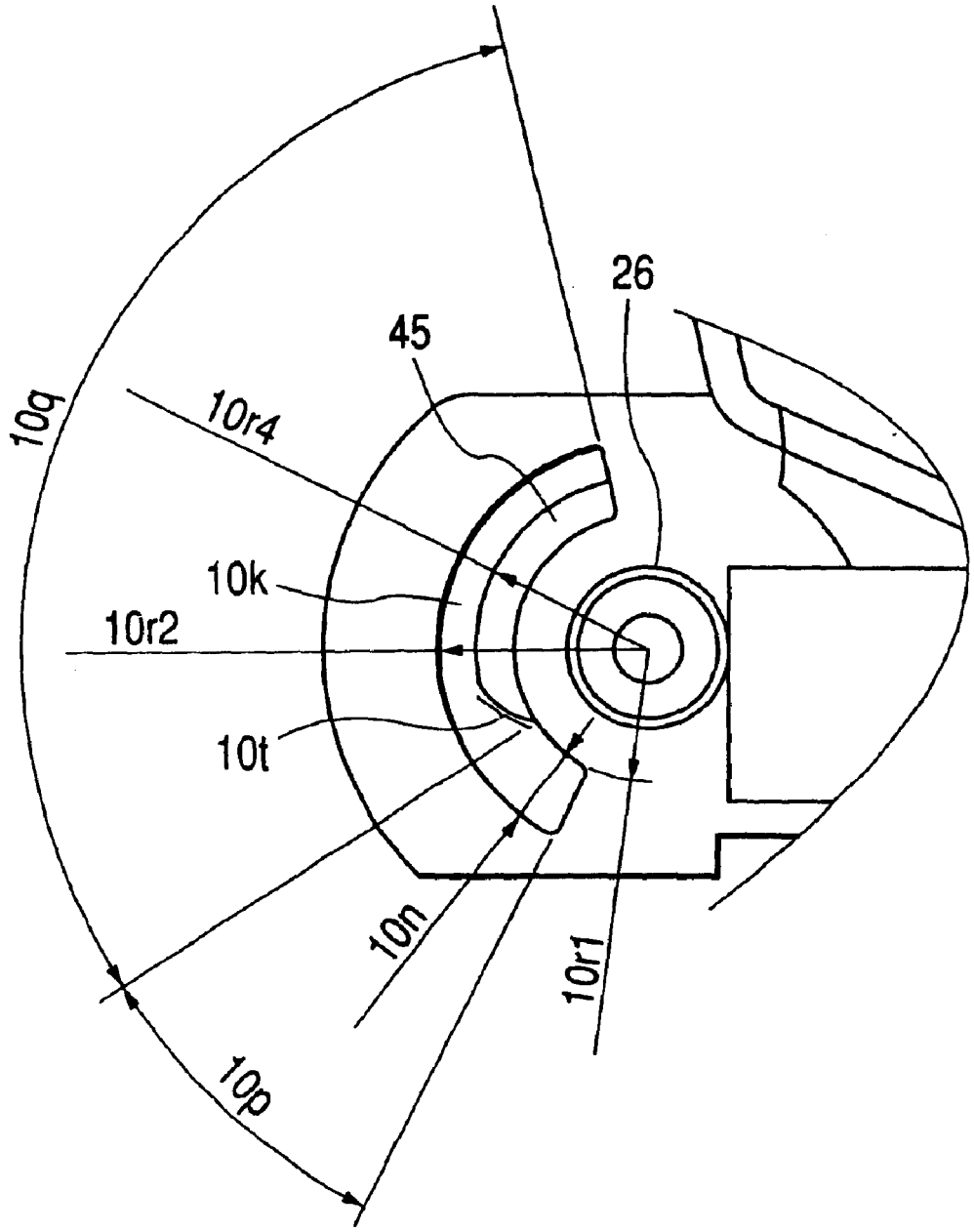
Figure 39:
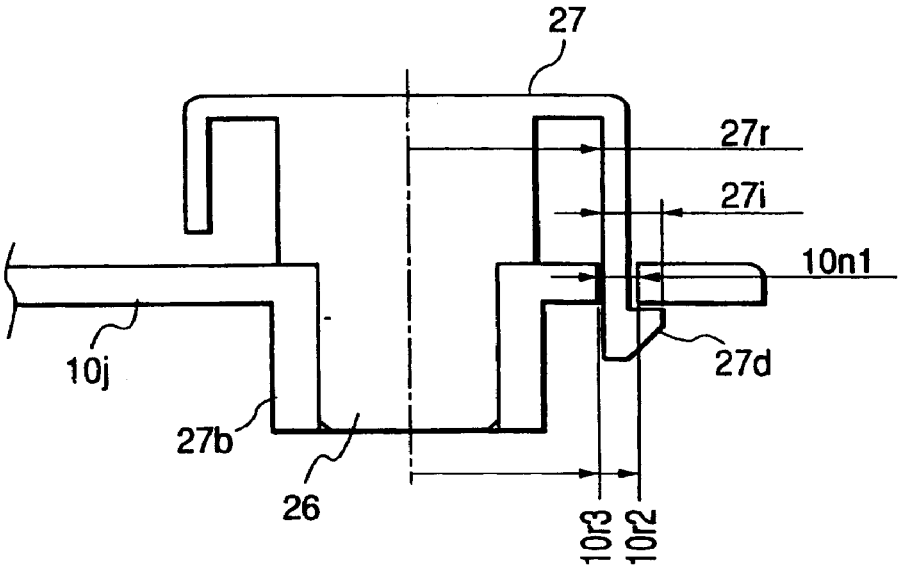
Figure 40:
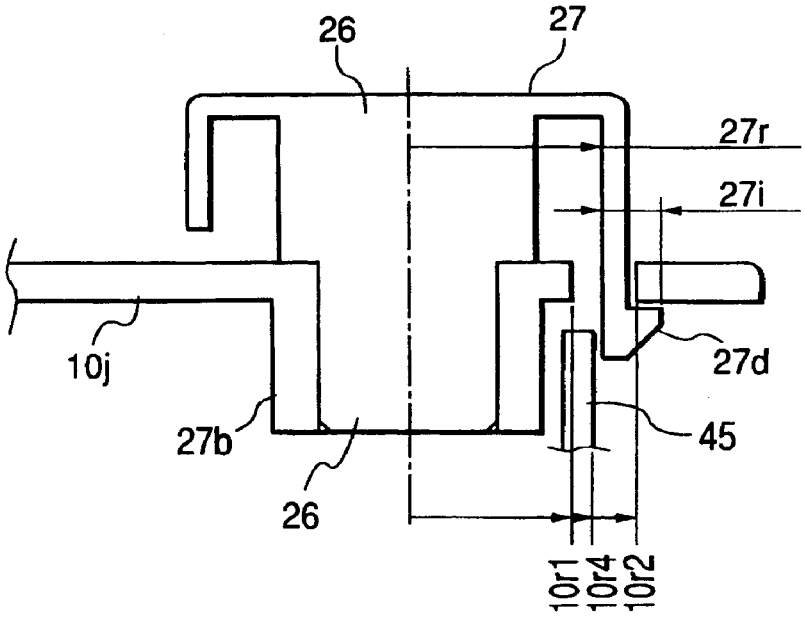

FIG. 1 is a side view for explaining a process cartridge according to the present invention;

FIG. 2 is a perspective view of the process cartridge according to the present invention;

FIG. 3 is a schematic sectional view of an image forming apparatus to which the process cartridge according to the present invention is mounted;

FIG. 4 is a schematic sectional view of the process cartridge according to the present invention;

FIGS. 5, 6, and 7 are perspective views showing a process cartridge mounting portion of the image forming apparatus;

FIGS. 8, 9, 10, 11 and 12 are schematic sectional views for explaining the mounting operation of the process cartridge to the image forming apparatus;

FIG. 13 is a side view showing the condition that a torsion coil spring is included in a shutter arm of the process cartridge according to the present invention is mounted;

FIG. 14 is a front view of an attachment portion of the shutter arm;

FIG. 15 is a side view of the process cartridge immediately before the shutter arm according to the present invention is attached;

FIG. 16 is a side view showing the condition that the shutter arm according to the present invention is attached;

FIG. 17 is a schematic side view showing the condition that the torsion coil spring included in the shutter arm is twisted by rotation of the shutter arm;

FIG. 18 is a plan view of the torsion coil spring;

FIG. 19 is a schematic sectional view showing the conditions of the shutter arm, the flange, the torsion coil spring and the locking projection, the condition of a restoring force of the torsion coil spring when a drum shutter member is closed after the shutter arm according to the present invention is attached;

FIG. 20 is a schematic sectional view showing the conditions of the shutter arm, the flange, the torsion coil spring and the locking projection, the condition of a restoring force of the torsion coil spring when a drum shutter member is opened after the shutter arm according to the present invention is attached;

FIG. 21 is a schematic sectional view showing the movement of a snap-fit portion when the shutter arm according to the present invention is assembled to a flange;

FIG. 22 is a schematic sectional view showing the condition that the snap-fit portion is completely passed through a hole;

FIG. 23 is a schematic view showing a hole configuration in a conventional flange;

FIG. 24 is a schematic sectional view showing the condition that a snap-fit portion is flexed in a prior art;

FIG. 25 is a schematic sectional view showing the condition that is snap-fit portion is flexed and is disengaged from a flange in a prior art;

FIG. 26 is a schematic side view showing a hole configuration according to a first embodiment of the present invention;

FIG. 27 is a schematic sectional view showing a snap-fit portion and a hole configuration in the condition that a shutter member according to the first embodiment of the present invention is opened;

FIG. 28 is a schematic side view showing a hole configuration and a back-up member, according to a second embodiment of the present invention;

FIG. 29 is a schematic sectional view showing a snap-fit portion, a hole configuration and a back-up member, according to the second embodiment of the present invention;

FIG. 30 is a schematic side view showing a hole configuration according to a third embodiment of the present invention;

FIG. 31 is a schematic side view showing a hole configuration according to an alteration of the third embodiment of the present invention;

FIG. 32 is a schematic sectional view showing a condition that a shutter arm is attached, according to an alteration of the third embodiment of the present invention;

FIG. 33 is a schematic side view showing a hole configuration and a back-up member, according to a fourth embodiment of the present invention;

FIG. 34 is a schematic side view showing a hole configuration and a back-up member, according to an alteration of the fourth embodiment of the present invention;

FIG. 35 is a schematic sectional view showing the condition that a shutter arm is attached, according to an alteration of the fourth embodiment of the present invention;

FIG. 36 is a schematic side view showing a hole configuration and a back-up member, according to an alteration of the fourth embodiment of the present invention;

FIG. 37 is a schematic side view showing a hole configuration according to a fifth embodiment of the present invention;

FIG. 38 is a schematic side view showing a hole configuration and a back-up member, according to a sixth embodiment of the present invention;

FIG. 39 is a view showing a seventh embodiment of the present invention, for explaining an alteration of the first, third and fifth embodiments; and FIG. 40 is a view showing the seventh embodiment of the present invention, for explaining an alteration of the second, fourth and sixth embodiments.

DESCRIPTION OF THE PREFERRED EMBODIMENTS

The present invention will now be explained in connection embodiments thereof with reference to the accompanying drawings. As an embodiment of an electrophotographic image forming apparatus, a laser beam printer will be described.

First Embodiment

A process cartridge and an image forming apparatus to which the process cartridge is detachably mounted will be fully explained with reference to FIGS. 1 to 4. FIGS. 5 to 12 are explanatory views showing a mounting means for the process cartridge B, and FIGS. 13 to 27 are detailed views showing the first embodiment.

First of all, the entire constructions of the process cartridge and of the image forming apparatus using such a process cartridge will be explained.

[Entire Construction]

As shown in FIG. 3, in the electrophotographic image forming apparatus (laser beam printer) A, information light corresponding to image information and emitted from an optical system 1 illuminates a drum-shaped electrophotographic photosensitive member (photosensitive drum) 7 to form a latent image on the photosensitive drum 7, and the latent image is developed by developing agent (referred to as "toner" hereinafter) to form a toner image. In synchronism with formation of the toner image, a recording medium 2 is supplied, one by one, from a sheet supply cassette 3*a* by means of a pick-up roller 3*b* and a member 3*c* urged against the pick-up roller, and the supplied recording medium is conveyed by a convey means 3, comprised of a pair of convey rollers 3*d* and a pair of regist rollers 3*e*. The toner image formed on the electrophotographic photosensitive member 7 in the process cartridge B is transferred onto the recording medium 2 by applying voltage to a transfer roller (transfer means) 4, and then the recording medium 2 is conveyed to a fixing means 5 via a convey belt 3*f*. The fixing means 5 comprises a drive roller 5*a*, and a fixing rotary member 5*d*, formed from a cylindrical sheet rotatably supported by a support 5*c* and including a heater 5*b* therein. While the recording medium 2 is passing through the fixing means, heat and pressure are applied to the recording medium, thereby fixing the transferred toner image. Thereafter, the recording medium 2 is conveyed by pairs of discharge rollers 3*g*, 3*h* and is discharged onto a discharge portion 6 through a reverse convey path. Incidentally, in the image forming apparatus A, a recording medium can be supplied manually through a manual insertion tray 3*i* and a roller 3*j*.

[Process Cartridge]

On the other hand, the process cartridge B includes the electrophotographic photosensitive member, and at least one process means. The process means may include, for example, a charge means for charging the electrophotographic photosensitive member, a developing means for developing the latent image formed on the electrophotographic photosensitive member or/and a cleaning means for cleaning residual toner remaining on a surface of the electrophotographic photosensitive member. As shown in FIG. 4, in the process cartridge B according to the illustrated embodiment, the photosensitive drum (electrophotographic photosensitive member) 7 having a photosensitive layer is rotated, the surface of the photosensitive drum 7 is uniformly charged by applying voltage to the charge roller (charge means) 8, the light image from the optical system 1 illuminates the photosensitive drum 7 through an exposure opening 9 to form the latent image, and the latent image is developed by a developing means 10.

In the developing means 10, toner contained in a toner containing frame 10*a* is sent to an opening portion 10*g* of the toner containing frame 10*a* by means of a rotatable toner feed member (toner feed means) 10*b*2 and is fed out within a toner developing frame 10*f* through an opening portion 10*h* of the toner developing frame 10*f*. The toner is agitated by a toner agitating member 10*b*1. A developing roller (developing rotary member) 10*d* including a fixed magnet 10*c* therein is rotated. A toner layer is formed on a surface of the developing roller 10*d* while applying frictional charges to the toner by means of a developing blade 10*e*. The toner in the toner layer is transferred to the latent image on the photosensitive drum 7 to visualize the latent image as the toner image.

After the toner image is transferred to the recording medium 2 by applying voltage having a polarity opposite to that of the toner image to the transfer roller 4, the residual toner remaining on the photosensitive drum 7 is removed by a cleaning means 11, which scrapes the residual toner by a cleaning blade 11*a* a dip sheet 11*b* and collects it into a waste toner containing portion 11*c*.

Incidentally, various elements such as the photosensitive drum 7 are contained in a cartridge frame obtained by joining a cleaning frame 13 (constituting the waste toner containing portion 11*c* and having the photosensitive drum 7, cleaning blade 11*a*, dip sheet 11*b* and charge roller 8) to a developing unit D formed by welding the toner containing frame 10*a* (rotatingly supporting the toner feed member 10*b*2) and the toner developing frame 10*f* (including the developing members such as the toner agitating member 10*b*1, the developing roller 10*d*, and the developing blade 10*e*) and a lid member 10*i* together, thereby forming the process cartridge which can be detachably mounted to a cartridge mounting means of the image forming apparatus A.

[Mounting and Dismounting Construction of Process Cartridge]

Next, the construction for mounting and dismounting of the process cartridge B with respect to the image forming apparatus A will be described.

The mounting or dismounting of the process cartridge B is effected after an open/close member 15 is opened as shown in FIG. 5. When the open/close member 15 is opened around a shaft 15*a* (FIG. 3), the cartridge mounting means is exposed. As shown in FIGS. 6 and 7, regarding the cartridge mounting means, guide rails 16 extending forwardly and downwardly and curved downwardly (substantially arc in the illustrated embodiment) are provided on left and side walls of a cartridge mounting space in a substantially symmetrical manner, and guide members 17 are attached above the guide rails. Further, at an inlet side of each guide rail 16, there are provided a first inclined surface 16*a* (hook portion) by which a corresponding projection 29*b* (FIGS. 1 and 2) of the process cartridge B is engaged, and a second inclined surface 16*b* contiguous with the first inclined surface 16*a* and having inclination greater than that of the first inclined surface.

On the other hand, the process cartridge B is provided at both its longitudinal sides with guide portions to be guided along the guide rails 16. The guide portions protruding from both longitudinal side surfaces of the cartridge frame in a substantially symmetrical manner, and, as shown in FIGS. 1 and 2, each guide portion includes a boss (first guide portion) 18*a* and a rib (second guide portion) 18*b*. The bosses 18*a* are located on an extension line of the rotation axis of the photosensitive drum 7, and the ribs 18*b* extend from the bosses 18*a* toward an inserting direction of the process cartridge and are curved (substantially arc in the illustrated embodiment) in correspondence to the guide rails 16.

With the arrangement as mentioned above, when the process cartridge B is mounted, as shown in FIGS. 8 to 12, the tip end of the process cartridge B is inserted below the optical system 1 of the image forming apparatus A while guiding the bosses 18*a* and the ribs 18*b* along the guide rails 16. Since the guide rails 16 are curved and the guide members 17 are similarly curved and further the ribs 18*b* are similarly curved, as the process cartridge B is inserted, the posture of the process cartridge becomes substantially horizontal. When the process cartridge is further inserted, as shown in FIG. 12, abutment surfaces 20 provided on both sides of the tip end of the cleaning frame 13 abut against abutment members 19 of the image forming apparatus A, and then, the bosses 18*a* of the process cartridge B enter into recesses 16*c* at the ends of the guide rails 16. As a result, a drum gear 21 (FIG. 2) secured to one side of the photosensitive drum 7 and having a coupling portion is engaged by a drive gear 22 (FIG. 7) of the image forming apparatus A to permit transmission of a driving force to the process cartridge B.

[Drum Shutter]

The cartridge frame is provided at its lower part with an opening portion through which the photosensitive drum 7 can contact the recording medium 2. When the process cartridge is not used, the opening portion is closed by a drum shutter member 28 to protect the photosensitive drum 7. As shown in FIG. 1, the drum shutter member 28 is rotatably supported by pivotally connecting one end of a shutter arm 27 to a shaft 26 provided on one longitudinal end of the toner developing frame 10*f* and by pivotally inserting a shaft 27*s* provided at the other end of the shutter arm 27 into a hole of the shutter member 28 and by pivotally connecting the other end of the shutter member to a link member 29 rotatable around a shaft 29*a* inserted into a rotation center hole provided in the longitudinal end of the toner developing frame 10*f*. That is to say, at one side shown in FIG. 1, the drum shutter member 28 constitutes one link of a quadric crank link mechanism, and the shutter arm 27 and the link member 29 act as shutter support members for supporting the drum shutter member 28.

[Attachment Method of Shutter Arm]

Now, a method for attaching the shutter arm 27 to the toner developing frame 10*f* will be explained.

As shown in FIGS. 13 and 14, a torsion coil spring 42 is contained in the shutter arm at its root portion. The torsion coil spring 42 for biasing the drum shutter member 28 toward a closed position has a torsion coil portion 42*a* mounted around a rotation bearing portion 27*b* of the shutter arm 27 which is fitted on the shaft 26 (to which the shutter arm 27 is rotatably connected), and straight portions 42*c* at both ends of the torsion coil spring 42 are locked to torsion coil spring support portions 27*a*, 27*c* of the shutter arm 27. The torsion coil spring 42 is already twisted in a condition that the shutter arm 27 is assembled to generate a torsional moment, so that the torsion coil spring 42 is hard to disengage from the shutter arm 27.

FIG. 15 shows the condition before the shutter arm 27 is attached. A shutter arm attaching flange 10*j* of the toner developing frame 10*f* is provided with a hole (engagement portion) 10*k* through which a snap-fit portion 27*d* (FIG. 14) for pivotally connecting the shutter arm 27 to the flange 10*j* passes. Further, as mentioned above, the flange 10*j* is provided with the shaft 26 on which the shutter arm 27 is pivotally mounted.

The performance of the snap-fit portion 27*d* for attaching the shutter arm 27 will be described later. Now, a method for shifting the locked position of the straight portion 42*c* of the torsion coil spring 42 from the torsion coil spring support portion 27*c* of the shutter arm 27 to a locking projection 41 of the toner developing frame 10*f* will be explained.

FIG. 16 shows the condition that the shutter arm 27 is fitted on the shaft 26 of the flange 10*j*. In this condition, when the shutter arm 27 is rotated in the direction shown by the arrow C, one of the straight portions 42*c* of the torsion coil spring 42 abuts against the locking projection 41 of the toner developing frame 10*f* (as shown by the two dot and chain line in FIG. 16). When the shutter arm is further rotated, the straight portion 42*c* of the torsion coil spring 42 is released from the torsion coil spring support portion 27*c* of the shutter arm 27 and then abuts against an inclined surface portion 27*e* shown in FIG. 14. Thus, the straight portion 42*c* of the torsion coil spring 42 is slid in a direction shown by the arrow D by the inclined surface portion 27*e*. When the shutter arm is rotated in the direction C by a predetermined angle, the straight portion 42*c* of the torsion coil spring 42 is shifted from a line E toward the direction D. At this point, when the shutter arm 27 is returned toward a direction shown by the arrow F, the straight portion 42*c* of the torsion coil spring 42 is not returned to the torsion coil spring support portion 27*c* of the shutter arm 27 shown in FIG. 14, and the shutter arm 27 is biased toward the direction F by the torsional torque of the torsion coil spring 42.

[Operation of Torsion Coil Spring]

As mentioned above, when the process cartridge B is inserted along the guide rails 16, a projection 29*b* of the link member 29 abuts against the first and second inclined surfaces 16*a*, 16*b* of the guide rail 16 to open the drum shutter member 28 in the direction C in FIG. 16 (refer to FIGS. 8 to 12), thereby rotating the shutter arm 27 in the direction C. When the process cartridge B is retracted, the drum shutter member 28, the link member 29 and the shutter arm 27 are automatically closed toward the direction F by the biasing force of the torsion coil spring 42. FIG. 17 shows the condition that the torsion coil spring 42 contained in the shutter arm 27 is twisted by the rotation of the shutter arm 27 in the direction C. Particularly, the solid line shows the condition when the drum shutter member 28 is closed, and the two dot and chain line shows the condition when the drum shutter member 28 is opened. When it is assumed that an inner diameter of the torsion coil spring 42 in the condition that the drum shutter member 28 is closed is "42*d*" and an inner diameter of the torsion coil spring 42 in the condition that the drum shutter member 28 is opened is "42*e*", since the number of effective windings of the torsion coil spring 42 is increased by the opening movement of the drum shutter member 28, the inner diameter of the torsion coil spring 42 becomes smaller (42*d*>42*e*). Thus, an outer diameter 27*f* (FIGS. 13 and 20) of the rotation bearing portion 27*b* around which the torsion coil spring 42 of the shutter arm 27 is mounted must be selected to be smaller than the inner diameter 42*e* of the torsion coil spring 42 in the condition that the drum shutter member 28 is opened. If the outer diameter is greater than the inner diameter 42*e*, when the shutter arm 27 is rotated, the torsion coil spring 42 firmly abuts against the peripheral surface of the rotation bearing portion 27*b* to be locked thereto, so that rotational movement of the shutter arm 27 is stopped not to permit further insertion of the process cartridge B.

The torsion coil spring 42 affords the biasing force to the drum shutter member 28, and at the same time, is subjected to reaction forces 42*f*, 42*g*. FIG. 18 shows the torsion coil spring 42 looked at from a direction G in FIG. 17. Since the reaction forces 42*f*, 42*g* acting on the torsion coil spring 42 do not exist in one plane perpendicular to a centerline of the torsion coil spring 42, a rotational moment directing toward a direction H is generated.

FIG. 19 is a schematic view showing the postures of the shutter arm 27, the flange 10*j*, the torsion coil spring 42 and the locking projection 41 when the drum shutter member 28 is closed in the condition that the shutter arm 27 is assembled to the toner developing frame 10*f*. At this point, the torsion coil spring 42 has been twisted from a free condition so that the rotational moment directing toward the direction H acts on the torsion coil spring 42.

FIG. 20 is a schematic view showing postures of the shutter arm 27, the flange 10*j*, the torsion coil spring 42 and the locking projection 41 when the drum shutter member 28 is being opened toward the direction C. The torsion coil spring 42 is twisted from the closed condition of the drum shutter member 28 to reduce the inner diameter of the torsion coil spring 42 and to increase the torsional moment of the torsion coil spring 42, so that the reaction forces 42*f*, 42*g* acting on the torsion coil spring 42 from the locking projection 41 and the torsion coil spring support portion 27*a* are also increased, thereby increasing the rotational moment directing toward the direction H. For the above-mentioned reason, since the inner diameter of the torsion coil spring 42 is selected to be greater than the outer diameter 27*f* of the rotation bearing portion, due to the rotational moment directing toward the direction H, the torsion coil spring 42 can be rotated in the direction H relatively freely, to be abutted against the flange 10*j* and an inner wall 27*g* of the shutter arm.

Consequently, the shutter arm 27 receives a force 27*h* from the torsion coil spring 42 and the flange 10*j* receives a force 10*m* from the torsion coil spring 42, so that the shutter arm 27 tries to disengage from the flange 10*j*.

[Performance of Snap-fit when Shutter Arm is Attached]

FIG. 21 is a schematic sectional view showing the movement of the snap-fit portion 27*d* having a pawl at its tip end when the shutter arm 27 is assembled to the flange 10*j* (the torsion coil spring 42 is not shown). During the assembling while shifting the shutter arm 27 in a direction J, as shown in FIG. 21, the snap-fit portion 27*d* passes through the hole 10*k* of the flange 10*j* while being slightly flexed due to its elasticity. FIG. 22 is a schematic sectional view showing a condition that the snap-fit portion 27*d* has passed through the hole completely. In this condition, the flexed snap-fit portion 27*d* is returned to its initial straight posture.

In order to permit the passage of the snap-fit portion 27*d* through the hole 10*k* of the flange 10*j*, a width 27*i* of the head of the flexed snap-fit portion 27*d* must be selected to be smaller than a width 10*n* of the hole 10*k* of the flange 10*j* and the hole 10*k* must be positioned accurately.

That is to say, the relation (10*n*>27*i*) must be established.

The above relation may be satisfied only when the shutter arm 27 is assembled to the toner developing frame 10*f*. In this case, the width of the hole 10*k* at a position corresponding to the position of the snap-fit portion 27*d* of the shutter arm 27 may be considered. The reason is that, as explained in connection with FIG. 10, when the drum shutter member 28 is opened toward the direction C in FIG. 18, the shutter arm 27 tries to separate from the flange 10*j* as the torsional angle of the torsion coil spring 42 is increased.

In the condition that the drum shutter member 28 is opened, i.e., when the force 27*h* (from the torsion coil spring 42) acting on the shutter arm 27 and tending to separate the shutter arm 27 from the shaft 26 in the axial direction is increased, if the width of the snap-fit portion 27*d* is the same as the width 10*n* of the hole 10*k* of the flange 10*j* at the position corresponding to the position of the snap-fit portion 27*d* when the shutter arm 27 is attached (for example, as is in the conventional case shown in the FIG. 23, in case of the hole configuration defined by two arcuate shapes having different radii disposed around the shaft 26 in such a manner that the width of a hole position 10*p* corresponding to the position of the snap-fit portion 27*d* when the shutter arm 27 is attached becomes the same as the width of a hole position 10*q* corresponding to the position of the snap-fit portion 27*d* when the drum shutter member 28 is opened), as shown in FIG. 24, the snap-fit portion 27*d* will be flexed by the force 27*h* acting on the shutter arm 27 from the torsion coil spring 42, so that the shutter arm 27 may be separated from the flange 10*j*. Further, as shown in FIG. 25, the snap-fit portion 27*d* may be separated from the flange 10*j*.

DETAILED EXPLANATION OF FIRST EMBODIMENT

In FIGS. 26 and 27, the shutter arm 27 is attached at an angle corresponding to the position when the drum shutter member 28 is closed.

The width 10*n* (distance between an inner radius 10*r*1 and an outer radius 10*r*2 defining the hole 10*k*) of the hole within a range of the hole position 10*p* corresponding to the position of the snap-fit portion 27*d* when the shutter arm 27 is attached is selected to be greater than the width of the head of the snap-fit portion 27*d* (including the flexed condition of the snap-fit portion 27*d*) when the snap-fit portion is passed through the hole 10*k* of the flange 10*j* to establish the relation 10*n*>27*i*, thereby making the attachment of the shutter arm 27 the same as that in the conventional case. And, in this condition, within ranges other than the above, as shown in FIGS. 26 and 27, an inner radius 10*r*3 of the hole corresponding to the position of the snap-fit portion when the shutter is opened approaches the inner radius 27*r* of the snap-fit portion 27*d* as can as possible, thereby making the width 10*n*1 (10*r*2–10*r*3) of the hole 10*k* smaller than the width 27*i* of the head of the snap-fit portion 27*d*. That is to say, by establishing a relation 10*n*1<27*i* from a position exceeding a step 10*u*, even when the shutter arm 27 receives the force 27*h* from the torsion coil spring 42, the flexion of the snap-fit portion 27*d* extends only up to the inner radius of the hole 10*k* of the flange 10*j* corresponding to the position of the snap-fit portion when the shutter is opened, and due to the relation 10*n*1<27*i*, the head of the snap-fit portion 27*d* cannot be disengaged from the hole 10*k* physically. With the arrangement as mentioned above, in the condition that the drum shutter member 28 is opened, the shutter arm 27 cannot be disengaged from the flange 10*j*.

In the illustrated embodiment, while an example that the snap-fit portion 27*d* of the shutter arm 27 is convex outwardly relative to center of the shaft 26 was explained, the present invention is not limited to such an example, but, the snap-fit portion may be convex inwardly relative to center of the shaft 26, and at the same time the configuration of the hole 10*k* of the flange 10*j* may be changed in a stepped manner in correspondence to such alteration.

Second Embodiment

The second embodiment will be explained based on FIGS. 28 and 29. The shutter arm 27 is attached at an angle corresponding to the position when the drum shutter member 28 is closed.

The width 10*n* (the distance between an inner radius 10*r*1 and an outer radius 10*r*2 defining the hole 10*k*) of the hole 10*k* within a range of the hole position 10*p* corresponding to the position (corresponding to the angle when the drum shutter member 28 is closed) of the snap-fit portion 27*d* when the shutter arm 27 is attached, is selected to be greater than the width 27*i* of the head of the snap-fit portion 27*d* (including the flexed condition of the snap-fit portion 27*d*) when the snap-fit portion passes through the hole 10*k* of the flange 10*j* to establish the relation 10*n*>27*i*, thereby making the attachment of the shutter arm 27 the same as that in the conventional case. This is the same as the first embodiment. However, in the second embodiment, the relation 10*n*>27*i* is maintained within the whole area of the hole 10*k*.

Further, in the hole position 10*q* corresponding to the position of the snap-fit portion 27*d* of the shutter arm 27 when the drum shutter member 28 is opened, in order to prevent the shutter arm from being disengaged due to the flexion of the snap-fit portion 27*d*, as shown in FIG. 28, there is provided a back-up member 45 facing the hole 10*k* to prevent the flexion of the snap-fit portion 27*d*.

As shown in FIG. 29, the back-up member 45 is secured to the process cartridge B around the shaft of the frame in an arcuate manner to extend up to the vicinity of the position of the inner radius 27*r* of the snap-fit portion. With this arrangement, even when shutter arm 27 receives the force 27*h* from the torsion coil spring 42, the snap-fit portion 27*d* can be flexed only within a small range 10*s* (27*r*–10*r*4) corresponding to a distance through which the snap-fit portion abuts against the back-up member 45, so that the head of the snap-fit portion 27*d* cannot be disengaged from the hole 10*k* physically. In this way, in the condition that the drum shutter member 28 is opened, the shutter arm 27 cannot be disengaged from the flange 10*j*.

In the illustrated embodiment, while an example that the snap-fit portion 27*d* of the shutter arm 27 is convex outwardly relative to center of the shaft 26 was explained, the present invention is not limited to such an example, but, the snap-fit portion may be convex inwardly relative to center of the shaft 26, and at the same time the back-up member 45 may be disposed outside of the hole 10*k* in correspondence to such alteration.

In FIG. 29, while an example that of a back-up member 45 formed as an independent member was explained, the back-up member may be formed integrally with the flange 10*j*.

Third Embodiment

In the first and second embodiments, while an example that the shutter arm 27 is attached at the angle corresponding to the closed position of the shutter member 28 was explained, so long as a space for the flange 10*j* is available, the range of the hole position for attachment may be differentiated from the hole range corresponding to the position of the snap-fit portion 27*d* of the shutter arm 27 rotated in synchronism with the opening and closing of the shutter member 28. FIG. 30 is a schematic view for explaining a third embodiment of the present invention, for such a deformation.

A point different from the first embodiment is that the hole position 10*p* where the shutter arm 27 is attached is completely separated from a hole position 10*q*1 when the drum shutter member 28 is closed.

The width 10*n* and positional relation of the hole at the hole position 10*p* for attaching the shutter arm are the same as the first embodiment to permit the attachment, and the width 10*n*1 and positional relation of the hole at the hole positions 10*q*, 10*q*1 when the drum shutter is opened and closed are the same as the first embodiment. As a result, the shutter arm 27 can be prevented from being disengaged during the opening and closing of the drum shutter member 28.

As is in the illustrated embodiment, when the range of the hole position for attachment is differentiated from the hole range corresponding to the position of the snap-fit portion 27*d* of the shutter arm 27 rotated in synchronism with the opening and closing of the shutter member 28, an arrangement shown in FIG. 31 can also be realized. The difference in FIG. 31 is that the hole position 10*p* for attaching the shutter arm 27 is convex outwardly.

FIG. 32 is a schematic view for explaining the snap-fit portion 27*d* and the hole 10*k* when the shutter arm 27 is attached.

Since the positional relation between the hole 10*k* and the snap-fit portion 27*d* is selected to be 10*r*1<27*r*<(27*r*+27*i*)<10*r*2, when the shutter arm 27 is attached, the snap-fit portion 27*d* can be inserted without abutting against the hole 10*k*. Consequently, since the snap-fit portion is not flexed during the attachment, the shutter arm can be attached with a smaller force.

Fourth Embodiment

In the first and second embodiments, while an example of the shutter arm 27 being attached at the angle corresponding to the closed position of the shutter member 28 was explained, so long as a space for the flange 10*j* is available, the range of the hole position for attachment may be differentiated from the hole range corresponding to the position of the snap-fit portion 27*d* of the shutter arm 27 rotated in synchronism with the opening and closing of the shutter member 28.

FIG. 33 is a schematic view for explaining a fourth embodiment of the present invention. A point of difference from the second embodiment is that the hole position 10*p* where the shutter arm 27 is attached is completely separated from a hole position 10*q*1 when the drum shutter member 28 is closed.

The width 10*n* and positional relation of the hole at the hole position 10*p* for attaching the shutter arm are the same as the second embodiment to permit the attachment, and the positional relation of the back-up member 45 for preventing the flexion of the snap-fit portion 27*d* at the hole positions 10*q*, 10*q*1 when the drum shutter is opened and closed are the same as the second embodiment. As the result, the shutter arm 27 can be prevented from being disengaged during the opening and closing of the drum shutter member 28.

As is in the illustrated embodiment, when the range of the hole position for attachment is differentiated from the hole range corresponding to the position of the snap-fit portion 27*d* of the shutter arm 27 rotated in synchronism with the opening and closing of the shutter member 28, an arrangement shown in FIG. 34 can also be realized. The difference in FIG. 34 is that the hole position 10*p* for attaching the shutter arm 27 convex outwardly.

FIG. 35 is a schematic view for explaining the snap-fit portion 27*d* and the hole 10*k* when the shutter arm 27 is attached. Since the positional relation between the hole 10*k* and the snap-fit portion 27*d* is selected to be 10*r*1<27*r*<(27*r*+27*i*)<10*r*2, when the shutter arm 27 is attached, the snap-fit portion 27*d* can be inserted without abutting against the hole 10*k*. Consequently, since the snap-fit portion 27*d* is not flexed during the attachment, the shutter arm 27 can be attached with a smaller force.

In the illustrated embodiment, while the engagement portion for engaging with the snap-fit portion 27*d* was closed, such engagement portion may be opened as shown in FIG. 36.

Fifth Embodiment

Next, a fifth embodiment of the present invention will be explained based on FIG. 37.

In the first and third embodiments, the step 10*u* (refer to FIGS. 26 and 30) between the inner radius 10*r*1 and the outer radius 10*r*3 defined the hole 10*k*.

If the snap-fit portion 27*d* of the shutter arm 27 is inclined toward the step 10*u* for any reason, after the shutter arm 27 is attached, when the shutter arm 27 is rotated in the direction C in FIG. 16 (opening direction of the drum shutter member 28), the snap-fit portion 27*d* may be caught by the step 10*u*.

To avoid this, as shown in FIG. 37, a transition zone 10*t* is provided in place of the step 10*u* between the inner radius 10*r*1 and the outer radius 10*r*3 defining the hole 10*k* to smoothly connect between the radii so that, even when the snap-fit portion 27*d* passes through the hole, the shutter arm 27 can smoothly be rotated.

Sixth Embodiment

Now, a sixth embodiment of the present invention will be explained based on FIG. 38.

In the second embodiment, there was the step between the inner radius 10*r*1 defining the hole 10*k* and the back-up member 45, when looked at from the shaft 26 side of the shutter arm 27. So, if the snap-fit portion 27*d* of the shutter arm 27 is inclined toward the step 10*u* for any reason, after the shutter arm 27 is attached, when the shutter arm 27 is rotated in the direction C in FIG. 16 (opening direction of the drum shutter member 28), the snap-fit portion 27*d* may be caught by the step 10*u* (FIG. 28).

To avoid this, as shown in FIG. 38, a transition zone 10*t* is provided in place of the step 10*u* between back-up member 45 and the inner radius 10*r*1 defining the hole 10*k* to smoothly connect between them so that, even when the snap-fit portion 27*d* passes through the hole, the shutter arm 27 can smoothly be rotated.

Seventh Embodiment

Now, a seventh embodiment of the present invention will be explained based on FIGS. 39 and 40.

In the above-mentioned first to sixth embodiments, while an combination in which the rotation bearing portion 27*b* is provided on the shutter arm 27 and the shaft 26 is provided on the shutter arm attaching flange 10*j* of the toner developing frame 10*f* in order to pivotally connect the shutter arm 27 to the flange 10*j* was explained, the present invention is not limited to such a combination. That is, as is in an alteration of the first, third and fifth embodiments shown in FIG. 39 or as is in an alteration of the second, fourth and sixth embodiments shown in FIG. 40, the shaft 26 may be formed on the shutter arm 27 and the rotation bearing portion 27*b* may be provided on the shutter arm attaching flange 10*j* of the toner developing frame 10*f*.

In the first to sixth embodiments, the shutter arm 27 and the drum shutter member 28 may be made of synthetic resin, and the link member 29 and the torsion coil spring 42 may be formed from elastic wire such as a steel wire (for example, piano wire).

As mentioned above, according to the present invention, the advantage that the support member for supporting the shutter is hard to be disengaged from the cartridge can be realized.

What is claimed is:

1. A process cartridge detachably mountable to a main body of an electrophotographic image forming apparatus, comprising:

a cartridge frame;

an electrophotographic photosensitive member;

process means acting on said electrophotographic photosensitive member;

a shutter for covering a portion of said electrophotographic photosensitive member exposed from said cartridge frame;

a support member for supporting one longitudinal end of said shutter to said cartridge frame to shift said shutter between an operation position where said electrophotographic photosensitive member is covered by said shutter and a retract position retracted from the operation position;

a support member engagement portion provided on said support member to attach said support member to said cartridge frame; and a frame engagement portion provided on said cartridge frame to attach said support member engagement portion to said cartridge frame, said frame engagement portion including an attachment portion for engaging said support member engagement portion with said frame engagement portion, and a shift path communicating with said attachment portion, said shift path being a path through which said shutter is shifted between the operation position and the retract position, a space of said attachment portion being greater than a space of said shift path in a direction substantially perpendicular to a shifting direction of said shutter;

wherein said support member engagement portion can be shifted along said shift path to permit said shutter to shift between the operation position where said electrophotographic photosensitive member is covered by said shutter and the retract position retracted from the operation position.

2. A process cartridge according to claim 1, wherein said frame engagement portion comprises a hole formed in said cartridge frame, and said support member engagement portion is engaged with said hole.

3. A process cartridge according to claim 2, wherein said attachment portion is provided at one end of said hole.

4. A process cartridge according to claim 2 or 3, wherein said frame engagement portion further comprises a regulation member positioned along a portion of said hole corresponding to said shift path to prevent said support member engagement portion from being disengaged from said frame engagement portion, and wherein said attachment portion comprises a portion of said hole along which said regulation member is not positioned.

5. A process cartridge according to claim 4, wherein said support member engagement portion is a snap-fitted portion, and said regulation member is a back-up member for regulating flexion of said snap-fitted portion.

6. A process cartridge according to claim 1 or 2, wherein said attachment portion and said shift path are interconnected via an inclined surface.

7. A process cartridge according to claim 1, wherein said process means comprises at least one of a developing member for developing a latent image formed on said electrophotographic photosensitive member, a charging member for charging said electrophotographic photosensitive member and a cleaning member for removing developing agent adhered to said electrophotographic photosensitive member.

8. A process cartridge according to claim 1, wherein the process cartridge integrally incorporates therein said electrophotographic photosensitive member, and at least one of a developing member, a charging member and a cleaning member as said process means, as a cartridge unit which is detachably mountable to the main body of said electrophotographic image forming apparatus, and wherein said developing member develops a latent image formed on said electrophotographic photosensitive member, said charging member charges said electrophotographic photosensitive member and said cleaning member removes developing agent adhered to said electrophotographic photosensitive member.

9. A process cartridge detachably mountable to a main body of an electrophotographic image forming apparatus, comprising:

a cartridge frame;

an electrophotographic photosensitive member;

process means acting on said electrophotographic photosensitive member;

a shutter for covering a portion of said electrophotographic photosensitive member exposed from said cartridge frame;

a support member for supporting one longitudinal end of said shutter to said cartridge frame to shift said shutter between an operation position where said electrophotographic photosensitive member is covered by said shutter and a retract position retracted from the operation position;

a support member engagement portion provided on said support member to attach said support member to said cartridge frame, and a frame engagement portion provided on said cartridge frame to attach said support member engagement portion to said cartridge frame, said frame engagement portion including an attachment portion for engaging said support member engagement portion with said frame engagement portion, and a shift path through which said shutter is shifted between the operation position where said electrophotographic photosensitive member is covered by said shutter and the retract position retracted from the operation position, a space of said attachment portion being greater than a space of said shift path in a direction substantially perpendicular to a shifting direction of said shutter, wherein said support member engagement portion can be shifted along said shift path to permit said shutter to shift between the operation position and the retract position, wherein said frame engagement portion comprises a hole formed in said cartridge frame, and said support member engagement portion is engaged with said hole, and wherein said attachment portion comprises a portion in which one end of said hole is opened.

10. A process cartridge detachably mountable to a main body of an electrophotographic image forming apparatus, comprising:

a cartridge frame;

an electrophotographic photosensitive member;

process means acting on said electrophotographic photosensitive member;

a shutter for covering a portion of said electrophotographic photosensitive member exposed from said cartridge frame;

a support member for supporting one longitudinal end of said shutter to said cartridge frame to shift said shutter between an operation position where said electrophotographic photosensitive member is covered by said shutter and a retract position retracted from the operation position;

a support member engagement portion provided on said support member to attach said support member to said cartridge frame; and a frame engagement portion provided on said cartridge frame to attach said support member engagement portion to said cartridge frame, said frame engagement portion including an attachment portion for engaging said support member engagement portion with said frame engagement portion, and a shift path through which said shutter is shifted between the operation position and the retract position, a space of said attachment portion being greater than a space of said shift path in a direction substantially perpendicular to a shifting direction of said shutter, wherein said support member engagement portion can be shifted along said shift path to permit said shutter to shift between the operation position and the retract position, wherein said frame engagement portion comprises a hole formed in said cartridge frame, and said support member engagement portion is engaged with said hole, and wherein said attachment portion is a portion provided at one end of said hole and having a greater width than said shift path.

11. A process cartridge detachably mountable to a main body of an electrophotographic image forming apparatus, comprising:

a cartridge frame;

an electrophotographic photosensitive member;

process means acting on said electrophotographic photosensitive member;

a shutter for covering a portion of said electrophotographic photosensitive member exposed from said cartridge frame;

a support member for supporting one longitudinal end of said shutter to said cartridge frame to shift said shutter between an operation position where said electrophotographic photosensitive member is covered by said shutter and a retract position retracted from the operation position;

a support member engagement portion provided on said support member to attach said support member to said cartridge frame; and a frame engagement portion provided on said cartridge frame to attach said support member engagement portion to said cartridge frame, said frame engagement portion including an attachment portion for engaging said support member engagement portion with said frame engagement portion, and a shift path through which said shutter is shifted between the operation position and the retract position, a space of said attachment portion being greater than a space of said shift path in a direction substantially perpendicular to a shifting direction of said shutter, wherein said support member engagement portion can be shifted along said shift path to permit said shutter to shift between the operation position and the retract position, wherein said frame engagement portion comprises a hole formed in said cartridge frame, and said support member engagement portion is engaged with said hole, and wherein said frame engagement portion further comprises a regulation member positioned along a portion of said hole corresponding to said shift path to prevent said support member engagement portion from being disengaged from said frame engagement portion, and wherein said attachment portion comprises a portion of said hole along which said regulation member is not positioned.

12. A process cartridge detachably mountable to a main body of an electrophotographic image forming apparatus, comprising:

a cartridge frame;

an electrophotographic photosensitive member;

process means acting on said electrophotographic photosensitive member;

a shutter for covering a portion of said electrophotographic photosensitive member exposed from said cartridge frame;

a support member for supporting one longitudinal end of said shutter to said cartridge frame to shift said shutter between an operation position where said electrophotographic photosensitive member is covered by said shutter and a retract position retracted from the operation position;

a support member engagement portion provided on said support member to attach said support member to said cartridge frame; and a frame engagement portion provided on said cartridge frame to attach said support member engagement portion to said cartridge frame, said frame engagement portion including an attachment portion for engaging said support member engagement portion with said frame engagement portion, and a shift path through which said shutter is shifted between the operation position and the retract position, a space of said attachment portion being greater than a space of said shift path in a direction substantially perpendicular to a shifting direction of said shutter, wherein said support member engagement portion can be shifted along said shift path to permit said shutter to shift between the operation position and the retract position, wherein said frame engagement portion comprises a hole formed in said cartridge frame, and said support member engagement portion is engaged with said hole, and wherein said attachment portion and said shift path are interconnected via an inclined surface.

13. A process cartridge according to claim 2, 3, 9, 10, 11, or 12 wherein said hole has an arc shape.

14. A process cartridge according to claim 13, wherein said support member engagement portion is a snap-fitted portion.

15. A process cartridge according to claim 13, further comprising an other end support member for supporting the other longitudinal end of said shutter to said cartridge frame.

16. A process cartridge according to claim 13, further comprising an elastic member for producing an elastic force directing toward said operation position on said support member in order to bias said shutter toward said operation position.

17. A process cartridge detachably mountable to a main body of an electrophotographic image forming apparatus, comprising:

an electrophotographic photosensitive member;

a charging member for charging said electrophotographic photosensitive member;

a developing member for developing a latent image formed on said electrophotographic photosensitive member;

a cartridge frame;

a shutter for covering a portion of said electrophotographic photosensitive member exposed from said cartridge frame;

a one end support member for supporting one longitudinal end of said shutter to said cartridge frame to shift said shutter between an operation position where said electrophotographic photosensitive member is covered by said shutter and a retract position retracted from the operation position;

an other end support member for supporting the other longitudinal end of said shutter to said cartridge frame;

an elastic member for producing an elastic force directed toward said operation position on said one end support member to bias said shutter toward said operation position;

a snap-fit portion provided on said one end support member to attach said one end support member to said cartridge frame; and a hole formed in said cartridge frame to attach said snap-fit portion to said cartridge frame, said hole including a wider portion as an attachment portion for attaching said snap-fit portion to said hole and a narrower portion as a shift portion which is narrower than said wider portion and through which said shutter is shifted between the operation position where said electrophotographic photosensitive member is covered by said shutter and the retract position retracted from the operation position;

wherein said snap-fit portion can be shifted along said shift path to permit said shutter to shift between the operation position where said electrophotographic photosensitive member is covered by said shutter and the retract position retracted from said operation position.

18. A process cartridge according to claim 17, wherein said hole has an arc shape.

19. A process cartridge according to claim 17, wherein said wider portion and said narrower portion are interconnected by an inclined surface.

20. A process cartridge according to claim 17, 18, or 19, wherein said elastic member is a coil spring.

21. An electrophotographic image forming apparatus to which a process cartridge is detachably mountable for forming an image on a recording medium, said electrophotographic image forming apparatus comprising:

(a) a mounting member to which is detachably mountable the process cartridge including a cartridge frame, and electrophotographic photosensitive member, process means acting on said electrophotographic photosensitive member, a shutter for covering a portion of said electrophotographic photosensitive member exposed from said cartridge frame, a support member for supporting one longitudinal end of said shutter to said cartridge frame to shift said shutter between an operation position where said electrophotographic photosensitive member is covered by said shutter and a retract position, a shutter member engagement portion provided on said support member to attach said support member to said cartridge frame, and a frame engagement portion provided on said cartridge frame to attach said support member engagement portion to said cartridge frame, said frame engagement portion including an attachment portion for engaging said support member engagement portion with said frame engagement portion, and a shift path communicating with said attachment portion, said shift path providing a path through which said shutter is shifted between the operation position and the retract position, a space of said attachment portion being greater than a space of said shift path in a direction substantially perpendicular to a shifting direction of said shutter, and wherein said support member engagement portion can be shifted along said shift path to permit said shutter to shift between the operation position where said electrophotographic photosensitive member is covered by said shutter and the retract position retracted from the operation position;

(b) an abutment portion capable of abutting against a portion of said support member to shift said shutter from the operation position to the retract position when said process cartridge is mounted to said mounting member; and (c) a convey member for conveying the recording medium.

22. An electrophotographic image forming apparatus to which a process cartridge is detachably mountable for forming an image on a recording medium, said electrophotographic image forming apparatus comprising:

(a) a mounting member capable of detachably mounting a process cartridge including an electrophotographic photosensitive member, a charging member for charging said electrophotographic photosensitive member, a developing member for developing a latent image formed on said electrophotographic photosensitive member, a cartridge frame, a shutter for covering a portion of said electrophotographic photosensitive exposed from said cartridge frame, a one end support member for supporting one longitudinal end of said shutter to said cartridge frame to shift said shutter between an operation position where said electrophotographic photosensitive member is covered by said shutter and a retract position retracted from the operation position, an other end support member for supporting the other longitudinal end of said shutter to said cartridge frame, an elastic member for producing an elastic force directed toward said operation position on said one end support member to bias said shutter toward said operation position, a snap-fit portion provided on said one end support member to attach said one end support member to said cartridge frame, and a hole formed in said cartridge frame to attach said snap-fit portion to said cartridge frame, said hole including a wider portion as an attachment portion for attaching said snap-fit portion to said hole and a narrower portion as a shift path which is narrower than said wider portion and through which said shutter is shifted between the operation position where said electrophotographic photosensitive member is covered by said shutter and the retract position retracted from the operation position, and wherein said snap-fit portion can be shifted along said shift path to permit said shutter to shift between the operation position where said electrophotographic photosensitive member is covered by said shutter and the retract position retracted from said operation position;

(b) an abutment portion capable of abutting against a portion of said one end support member to shift said shutter from the operation position to the retract position when said process cartridge is mounted to said mounting member; and (c) a convey member for conveying the recording medium.

23. A process cartridge detachably mountable to a main body of an electrophotographic image forming apparatus, comprising:

a cartridge frame;

an electrophotographic photosensitive member;

process means acting on said electrophotographic photosensitive member;

a shutter for covering a portion of said electrophotographic photosensitive member exposed from said cartridge frame;

a support member for supporting one longitudinal end of said shutter to said cartridge frame to shift said shutter between an operation position where said electrophotographic photosensitive member is covered by said shutter and a retract position retracted from the operation position;

a support member engagement portion provided on said support member to attach said support member to said cartridge frame;

a frame engagement portion provided on said cartridge frame to attach said support member engagement portion to said cartridge frame, said frame engagement portion including an attachment portion for engaging said support member engagement portion with said frame engagement portion, and a shift path through which said shutter is shifted between the operation position and the retract position, a space of said attachment portion being greater than a space of said shift path in a direction substantially perpendicular to a shifting direction of said shutter; and an elastic member for producing an elastic force directed toward said operation position on said support member in order to bias said shutter toward said operation position, wherein said support member engagement portion can be shifted along said shift path to permit said shutter to shift between the operation position and the retract position, and wherein said frame engagement portion comprises a hole formed in said cartridge frame, and said support member engagement portion is engaged with said hole.

24. A process cartridge according to claim 9, 10, 11, 12, or 23, wherein said shift path communicates with said attachment portion.

25. A process cartridge detachably mountable to a main body of an electrophotographic image forming apparatus, comprising:

a cartridge frame;

an electrophotographic photosensitive member;

process means acting on said electrophotographic photosensitive member;

a shutter for covering a portion of said electrophotographic photosensitive member exposed from said cartridge frame;

a support member for supporting one longitudinal end of said shutter to said cartridge frame to shift said shutter between an operation position where said electrophotographic photosensitive member is covered by said shutter and a retract position retracted from the operation position;

a support member engagement portion provided on said support member to attach said support member to said cartridge frame; and a frame engagement portion provided on said cartridge frame to attach said support member engagement portion to said cartridge frame, said frame engagement portion including an attachment portion for engaging said support member engagement portion with said frame engagement portion, and a shift path communicating with said attachment portion, a space of said attachment portion being greater than a space of said shift path in a direction substantially perpendicular to a shifting direction of said shutter;

wherein said support member engagement portion can be shifted along said attachment portion and said shift path to permit said shutter to shift between the operation position and the retract position.

26. A process cartridge according to claim 25, wherein said frame engagement portion comprises a hole formed in said cartridge frame, and said support member engagement portion is engaged with said hole.

27. A process cartridge according to claim 26, wherein said attachment portion is provided at one end of said bole.

28. A process cartridge according to claim 26 or 27, wherein said frame engagement portion further comprises a regulation member positioned along a portion of said hole corresponding to said shift path to prevent said support member engagement portion front being disengaged from said frame engagement portion, and wherein said attachment portion comprises a portion of said hole along which said regulation member is not positioned.

29. A process cartridge according to claim 28, wherein said support member engagement portion is a snap-fitted portion, and said regulation member is a back-up member for regulating flexion of said snap-fitted portion.

30. A process cartridge according to claim 26 or 27, wherein said hole has an arc shape.

31. A process cartridge according to claim 30, wherein said support member engagement portion is a snap-fitted portion.

32. A process cartridge according to claim 30, further comprising an other end support member for supporting the other longitudinal end of said shutter to said cartridge frame.

33. A process cartridge according to claim 30, further comprising an elastic member for producing an elastic force directing toward said operation position on said support member in order to bias said shutter toward said operation position.

34. A process cartridge according to claim 25 or 26, wherein said attachment portion and said shift path are interconnected via an inclined surface.

35. A process cartridge according to claim 25, wherein said process means comprises at least one of a developing member for developing a latent image formed on said electrophotographic photosensitive member, a charging member for charging said electrophotographic photosensitive member and a cleaning member for removing developing agent adhered to said electrophotographic photosensitive member.

36. A process cartridge according to claim 25, wherein the process cartridge integrally incorporates therein said electrophotographic photosensitive member, and at least one of a developing member, a charging member and a cleaning member as said process means, as a cartridge unit which is detachably mountable to the main body of said electrophotographic image forming apparatus, and wherein said developing member develops a latent image formed on said electrophotographic photosensitive member, said charging member charges said electrophotographic photosensitive member and said cleaning member removes developing agent adhered to said electrophotographic photosensitive member.

37. A process cartridge according to claim 25, wherein the frame engagement portion comprises a hole having an arc shape.

* * * * *